US010482736B2

(12) United States Patent
Kariniemi et al.

(10) Patent No.: US 10,482,736 B2
(45) **Date of Patent: *Nov. 19, 2019**

(54) RESTRICTED AREA AUTOMATED SECURITY SYSTEM AND METHOD

(71) Applicant: Comtrol Corporation, New Brighton, MN (US)

(72) Inventors: Nolan Kariniemi, New Brighton, MN (US); Mark Pikkarainen, New Brighton, MN (US)

(73) Assignee: PEPPERL+FUCHS GMBH, Mannheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/957,377

(22) Filed: Apr. 19, 2018

(65) Prior Publication Data

US 2018/0247503 A1 Aug. 30, 2018

Related U.S. Application Data

(63) Continuation of application No. 15/483,643, filed on Apr. 10, 2017, now Pat. No. 9,978,233.

(60) Provisional application No. 62/320,685, filed on Apr. 11, 2016.

(51) Int. Cl.
*G08B 13/183* (2006.01)

(52) U.S. Cl.
CPC ..... *G08B 13/183* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,875,761 | A * | 10/1989 | Fetzer | G01V 8/26 359/218.1 |
| 5,063,288 | A * | 11/1991 | Hsu | G01V 8/22 250/221 |
| 6,124,586 | A * | 9/2000 | De Coi | F16P 3/144 250/221 |
| 6,507,278 | B1 | 1/2003 | Brunetti et al. | |
| 8,749,344 | B2 | 6/2014 | Brunetti | |
| 9,978,233 | B2 * | 5/2018 | Kariniemi | G08B 13/183 |
| 2005/0052639 | A1 * | 3/2005 | Hartl | G01V 8/20 356/139.03 |
| 2007/0069114 | A1 * | 3/2007 | Clifton | G01V 8/20 250/221 |
| 2008/0204704 | A1 * | 8/2008 | Rankin | A63B 24/0021 356/28 |
| 2011/0007139 | A1 | 1/2011 | Brunetti | |
| 2011/0234797 | A1 | 9/2011 | Tian et al. | |
| 2013/0214136 | A1 * | 8/2013 | Schoenleitner | G01V 8/20 250/222.1 |
| 2013/0221204 | A1 * | 8/2013 | Mueller | G01V 8/20 250/208.2 |
| 2017/0074039 | A1 * | 3/2017 | Gregoriou | E05F 15/74 |

* cited by examiner

*Primary Examiner* — Travis R Hunnings
(74) *Attorney, Agent, or Firm* — Dicke, Billig & Czaja, PLLC

(57) ABSTRACT

A security system includes a plurality of laser scanners to establish light shields in an area to be monitored, with each of the light shields including at least one detection zone, and a controller to detect unauthorized entry to the area to be monitored based on a position and timing of breaks in the detection zones of the light shields.

13 Claims, 51 Drawing Sheets

Activity: Individuals have egressed from secured area to public area. Nothing is in the detection area. No alarms.

Overhead Zone Map Example: 5 Laser, 15 deg mount angle, 10 ft Ht.

Example: Zone detection size as it would appear on the floor, with 15 deg mount angle at 10' mount height.

Ex: Zone detection size with 6' 0" person and 15 deg mounting angle and 10' mount ht.

Example: Zone detection size with 5' 1" person and 15 deg mounting angle, 10' mount ht.

Ex: Zone detection size with 6' 0" person and 15 deg mounting angle, 10' mount ht.

Overhead Zone Map Example: 5 Laser, 15 deg mount angle, 10 ft Ht.

Overhead Zone Map Example: 5 Laser, 15 deg mount angle, 10 ft Ht.

Overhead Zone Map Example: 5 Laser, 15 deg mount angle, 10 ft Ht.

Overhead Zone Map Example: 5 Laser, 15 deg mount angle, 10 ft Ht.

Laser Array Data (dig. Out based method)

Laser 1: 0 0 0
Laser 2: 0 0 0
Laser 3: 0 0 0
Laser 4: 0 0 0
Laser 5: 0 0 1

SECURED AREA

Laser Array Data (dig. Out based method)

Laser 1: 0 0 0
Laser 2: 0 0 0
Laser 3: 0 0 0
Laser 4: 0 0 0
Laser 5: 0 0 0

SECURED AREA

Analytical Logic Routine

Analytical Logic Routine

Analytical Logic Routine

Analytical Logic Routine

Analytical Logic Routine

Analytical Logic Routine

Analytical Logic Routine

RESTRICTED AREA AUTOMATED SECURITY SYSTEM AND METHOD

CROSS-REFERENCE TO RELATED APPLICATIONS

This application is a Continuation of copending U.S. patent application Ser. No. 15/483,643, filed on Apr. 10, 2017, which claims priority under 35 U.S.C. § 119(e) to U.S. Provisional Patent Application Ser. No. 62/320,685, filed on Apr. 11, 2016, and both of which are incorporated herein by reference.

FIELD OF THE INVENTION

The present invention relates generally to a restricted area automated security system and method and, more specifically, to monitoring access to a restricted area and detecting unauthorized breach of such access.

BACKGROUND OF THE INVENTION

Many structures and spaces include restricted or "secured" areas where ingress and/or egress of living and/or non-living entities (e.g., people, objects) is to be monitored. For example, in an airport, there may be public or "unsecured" areas and restricted or "secured" areas, where accessing a secured area (for example, from a public or unsecured area) may include clearing a screening process. Such screening, however, may be resource intensive. For example, the screening process may rely on dedicated personnel and designated areas to screen individuals for ingress to the secured area. Additionally, significant resources may be expended in areas where egress from a restricted or secured area back to a public or unsecured area occurs. Often, human guards may be present in such an egress area to monitor and prevent access to the restricted or secured area.

DETAILED DESCRIPTION

The present disclosure provides a system and method for monitoring an area (or areas) and detecting unauthorized intrusion(s).

In one implementation, the system and method described herein uses a plurality or array of laser sensors/scanners, namely, two dimensional (2D) laser sensors/scanners, that individually each scan a planar area with a plane of light and detect (and report) breaches or breaks in the plane or planes of light. By collecting positional plane break data from the laser sensors/scanners in the array and analyzing the position and timing of the plane breaks, a host, such as, for example, a CPU or PLC, can detect if an unauthorized ingress (or egress) of a living and/or non-living entity (e.g., person, object) has occurred, and can then raise an alarm and/or change the state of an auxiliary output.

In one embodiment, the restricted area automated security system and method incorporates a plurality or array of time-of-flight (TOF) laser sensors/scanners (Lidar), and a control unit with which the laser sensors/scanners (and other components) are operatively and/or communicatively coupled so as to operate as a restricted area automated security system. The control unit may include a memory and a processor, with associated hardware and/or machine readable instructions (including firmware and/or software) embodied on a computer readable medium, for implementing and/or executing computer-readable, computer-executable instructions for data processing functions and/or functionality of the system and method. As such, and as described below, the system and method uses the time-of-flight (TOF) laser sensors/scanners to automatically monitor and detect breach of a monitored area, including unauthorized entry or attempted entry to a restricted area.

Figure 1:
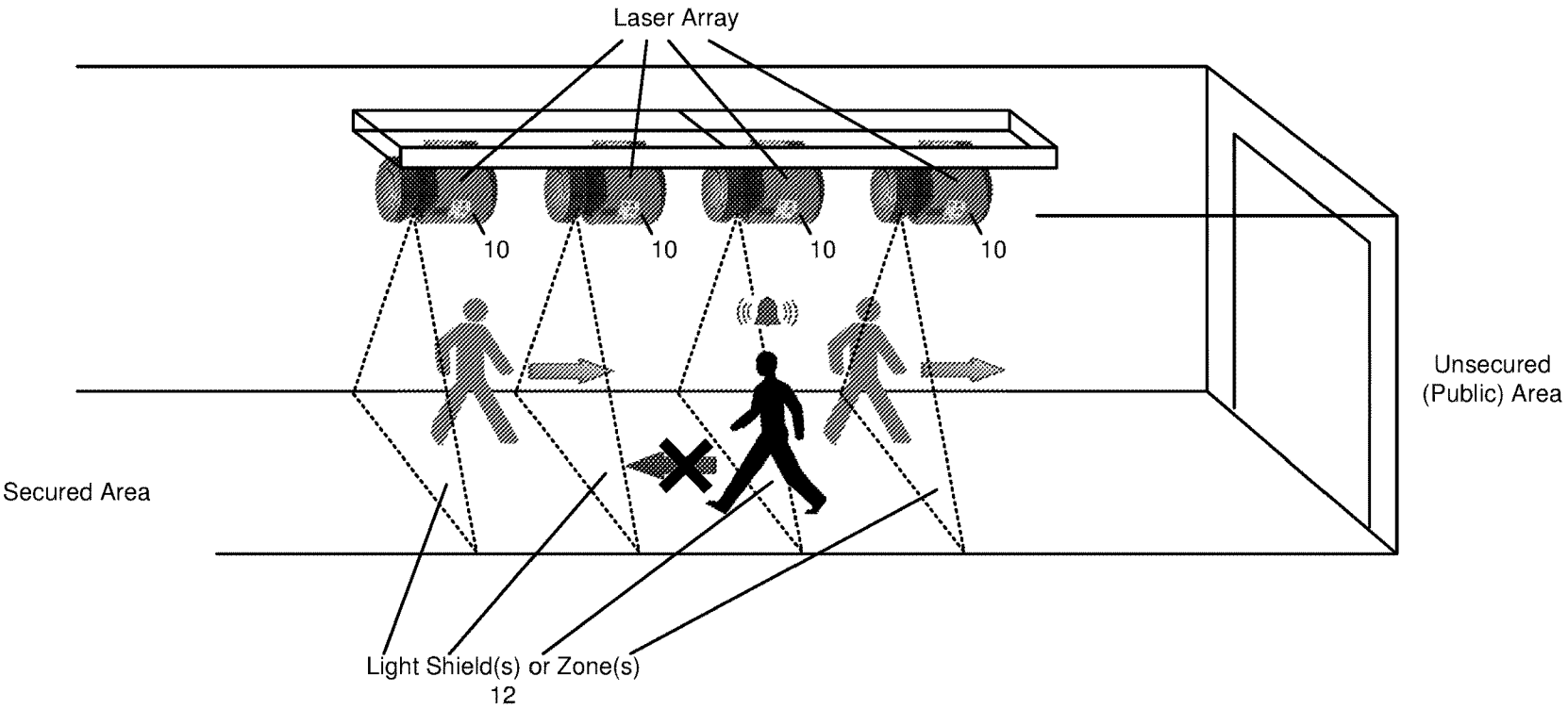
FIG. 1 illustrates one embodiment of a restricted area automated security system and method.

In one embodiment, as illustrated for example in FIG. 1, a plurality of laser sensors/scanners 10, namely, time-of-flight (TOF) laser sensors/scanners, are mounted to scan an area to be monitored, such as a region or zone between a secured (or restricted) area and an unsecured (or public) area. In one implementation, the laser sensors/scanners 10 are mounted over the monitored area, for example, suspended from (or recessed into) a ceiling (FIG. 1). In this regard, the restricted area automated security system may be installed without extensive modification or alteration of a surrounding structure.

The laser sensors/scanners 10 of the restricted area automated security system individually each have a field of view and create or establish an invisible light shield or plane 12 (e.g., class-1 infra-red eye safe light shield). In one implementation, the invisible light shields or planes 12 include vertical light shields or planes (FIG. 1). In one example, the laser sensors/scanners 10 create a three dimensional (3D) matrix of 2D detection zones. Although the laser sensors/scanners 10 are illustrated and described as creating or establishing vertical light shields or planes, the laser sensors/scanners 10 (or other laser sensor(s)/scanner(s)) may be used to create or establish light shields at any angle or combination of angles. While four laser sensors/scanners creating four light shields or zones are illustrated in the example of FIG. 1, the number of laser sensors/scanners and corresponding light shields or zones may vary. Exemplary time-of-flight (TOF) laser sensors/scanners useable with the system and method described herein include LMS Laser Scanners by Sick AG.

As illustrated in the example of FIG. 1, travel or movement (e.g., walking, running) from the secured area to the unsecured area (e.g., from the left to the right in the illustrated example) is allowed. However, travel or movement (e.g., walking, running) from the unsecured area to the secured area (e.g., from the right to the left in the illustrated example) is not allowed and will result in breach of the monitored area. As such, the restricted area automated security system and method will monitor and detect the breach of the monitored area, and trigger an alarm (or other action) in response to the breach.

Figure 2:
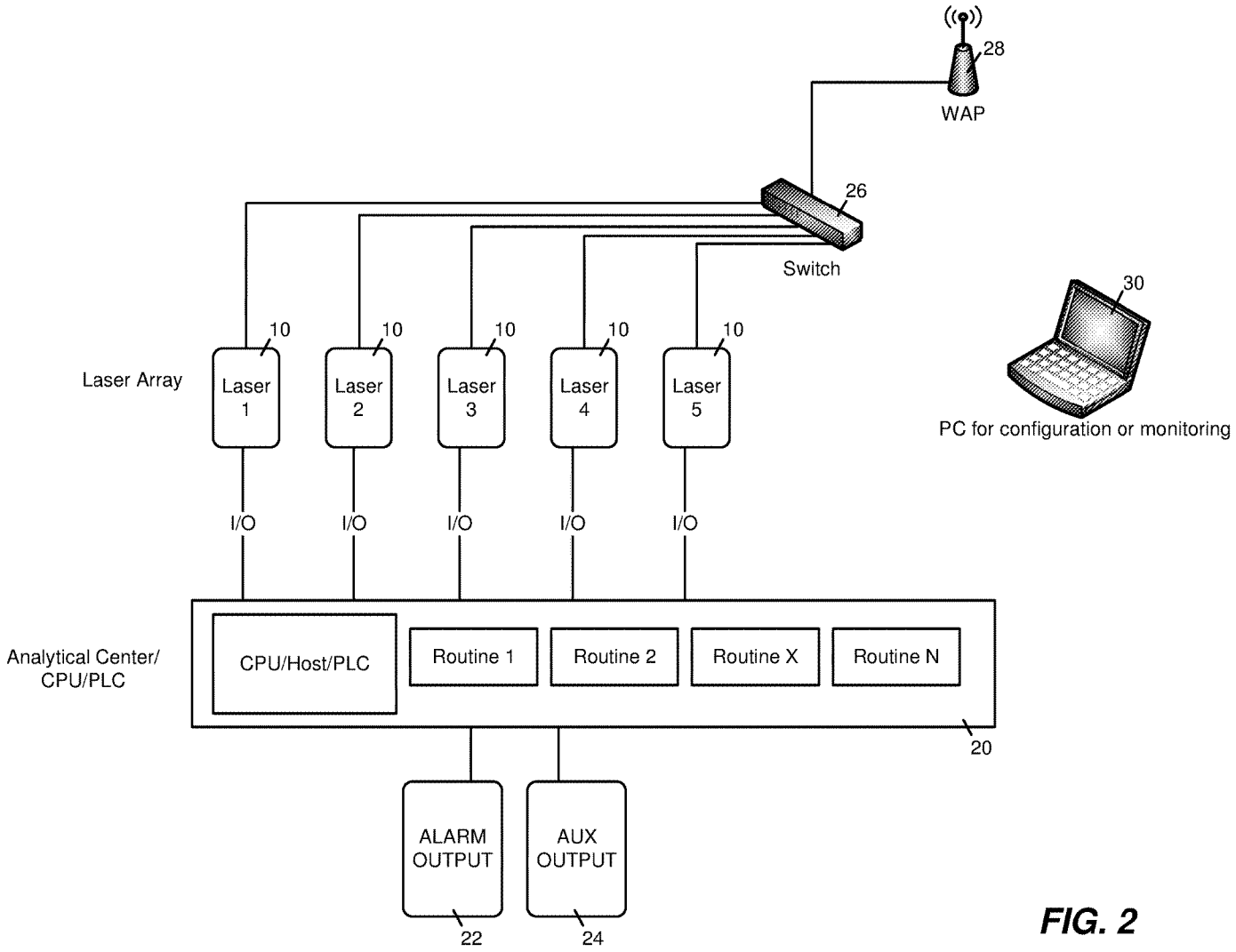
FIG. 2 schematically illustrates one embodiment of a restricted area automated security system.

In one embodiment, as illustrated, for example, in FIG. 2, the restricted area automated security system includes a plurality or array of laser sensors/scanners 10, and a control unit 20 with which the laser sensors/scanners 10 are operatively and/or communicatively coupled. In one implementation, the laser sensors/scanners 10 communicate with the control unit 20 using hardwired outputs. In another implementation, the laser sensors/scanners 10 communicate with the control unit 20 using an Ethernet communication protocol. While five laser sensors/scanners are illustrated, the number of laser sensors/scanners may vary.

In one embodiment, the control unit 20 provides processing, for example, by a CPU or PLC, to analyze output data of the laser sensors/scanners 10, including, for example, the position and timing of plane breaks in the light shields 12 of the laser sensors/scanners 10 to detect unauthorized intrusion. In one embodiment, different analytical routines are used to analyze the output data and determine whether an alarm or other output event is to be triggered. In one embodiment, the control unit 20 communicates with alarm output(s) 22 and/or auxiliary output(s) 24 to initiate such events.

In one embodiment, the laser sensors/scanners 10 communicate with a network switch 26 which allows for configuration and deployment of the system and monitoring or adjustment of system internals, for example, by a PC or other computing device, such as PC 30. In one implementation, the laser sensors/scanners 10 communicate with the network switch 26 using an Ethernet communication protocol. In one embodiment, a wireless access point (WAP) 28 is communicated with (or included in) the network switch 26 to allow for wireless communications with the system to facilitate, for example, configuration, deployment, monitoring, and/or adjustment of the system.

Figure 3:
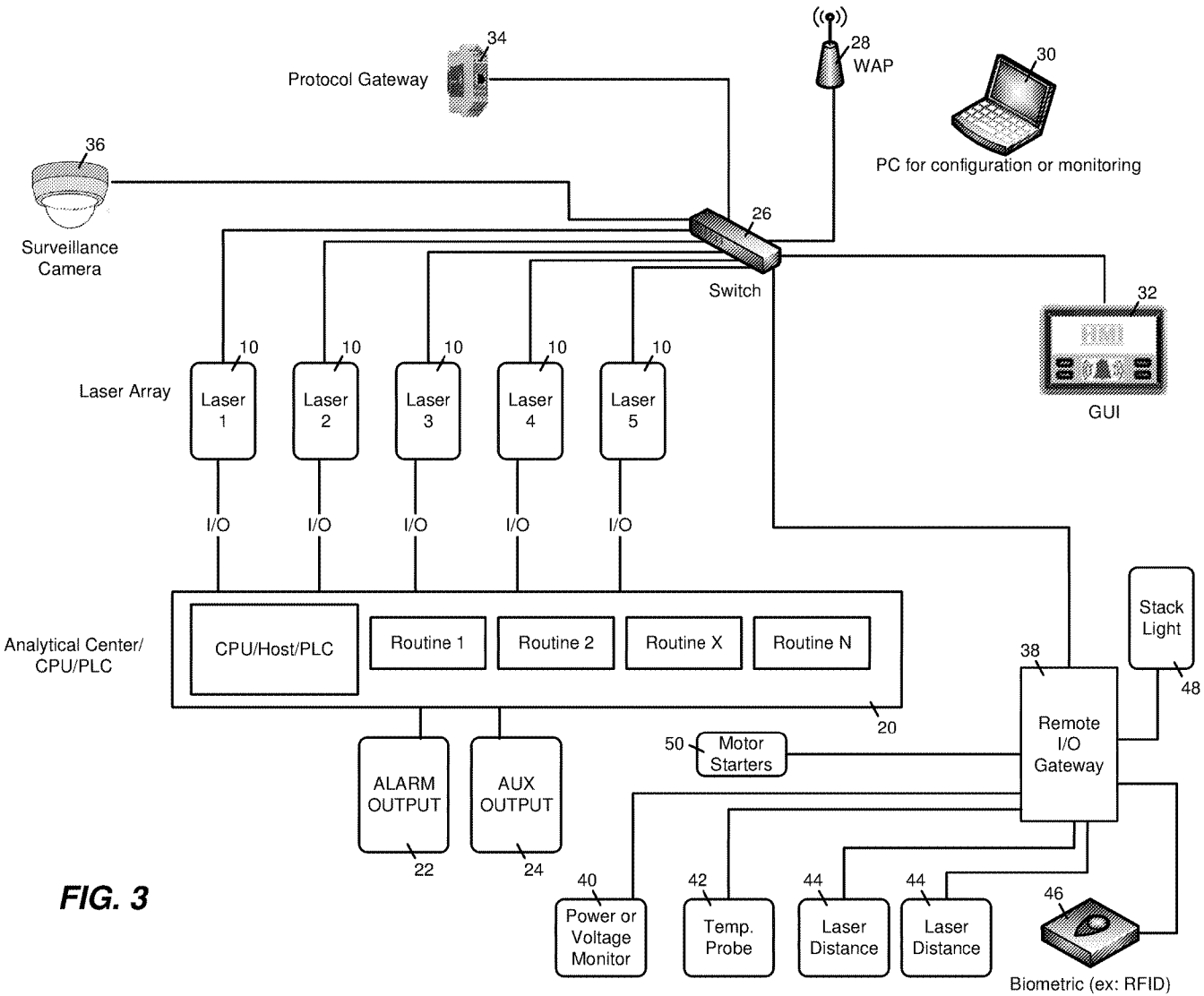
FIG. 3 schematically illustrates one embodiment of a restricted area automated security system.

Similar to the restricted area automated security system of FIG. 2, the restricted area automated security system of FIG. 3 includes a plurality or array of laser sensors/scanners 10, and a control unit 20 with which the laser sensors/scanners 10 are operatively and/or communicatively coupled. In addition, the control unit 20 includes different analytical routines to analyze the output data and determine whether an alarm or other output event is to be triggered, and communicates with alarm output(s) 22 and/or auxiliary output(s) 24 to initiate such events. In addition, the restricted area automated security system of FIG. 3 includes a network switch 26 which allows for configuration and deployment of the system and monitoring or adjustment of system internals, for example, by a PC or other computing device, such as PC 30, and includes a WAP 28 to allow for wireless communications with the system.

Further to the example illustrated in FIG. 2, in one embodiment, the restricted area automated security system of FIG. 3 includes communication to a graphical user interface (GUI) or human machine interface (HMI), such as GUI 32, which can be used, for example, by security personnel to acknowledge events, such as alarms, and/or to monitor the system. The GUI or HMI may be used by security personnel remote to the area being monitored, and may include touch-screen input. In one embodiment, the restricted area automated security system includes a protocol gateway 34 which may be used to add communication interface options in the system, and/or expand performance of communication methods provided in the programmable host.

In one embodiment, the restricted area automated security system includes one or more image capture devices, such as a surveillance camera 36, to capture and record one or more images (including still images and/or video) of the area being monitored. The image capture device may include a still image camera and/or a video camera which supports onboard recording (e.g., storing to secure data (SD) card of the image capture device) and/or network recording (e.g., sending to a network video recorder (NVR) or network-attached storage (NAS)). In one implementation, the image capture device is used to verify and track when a breach has occurred. Recording with the image capture device may be enabled before, during, and/or after the incident.

In one embodiment, the restricted area automated security system includes a remote I/O gateway 38 to facilitate communication with other sensors/actuators, including, for example, a power and/or voltage monitor 40 for monitoring of one or more power supplies, and/or a temperature probe 42 for monitoring temperature at one or more system points of interest. In one embodiment, the remote I/O gateway 38 facilitates communication with one or more laser distance sensors 44 for "auto-leveling" of the laser sensors/scanners 10 and/or providing other positional or mounting information of the laser sensors/scanners 10. Such information may be used, for example, for trigonometric calculations in facilitating commissioning of the system, including positioning and shaping of planar detection zones. In one embodiment, the remote I/O gateway facilitates communication with a biometric device 46, such as an RFID reader, to allow bypass of alarming (i.e., "authorized access") for an action which would normally generate an alarm. In one embodiment, the remote I/O gateway facilitates communication with an indicator light (e.g., a "stack light" 48) which can display multiple colors and be controlled to signify different states/actions. In one embodiment, the remote I/O gateway facilitates communication with one or more motor starters 50 which may be used, for example, to actuate a physical barrier such as a gate.

Figure 4:
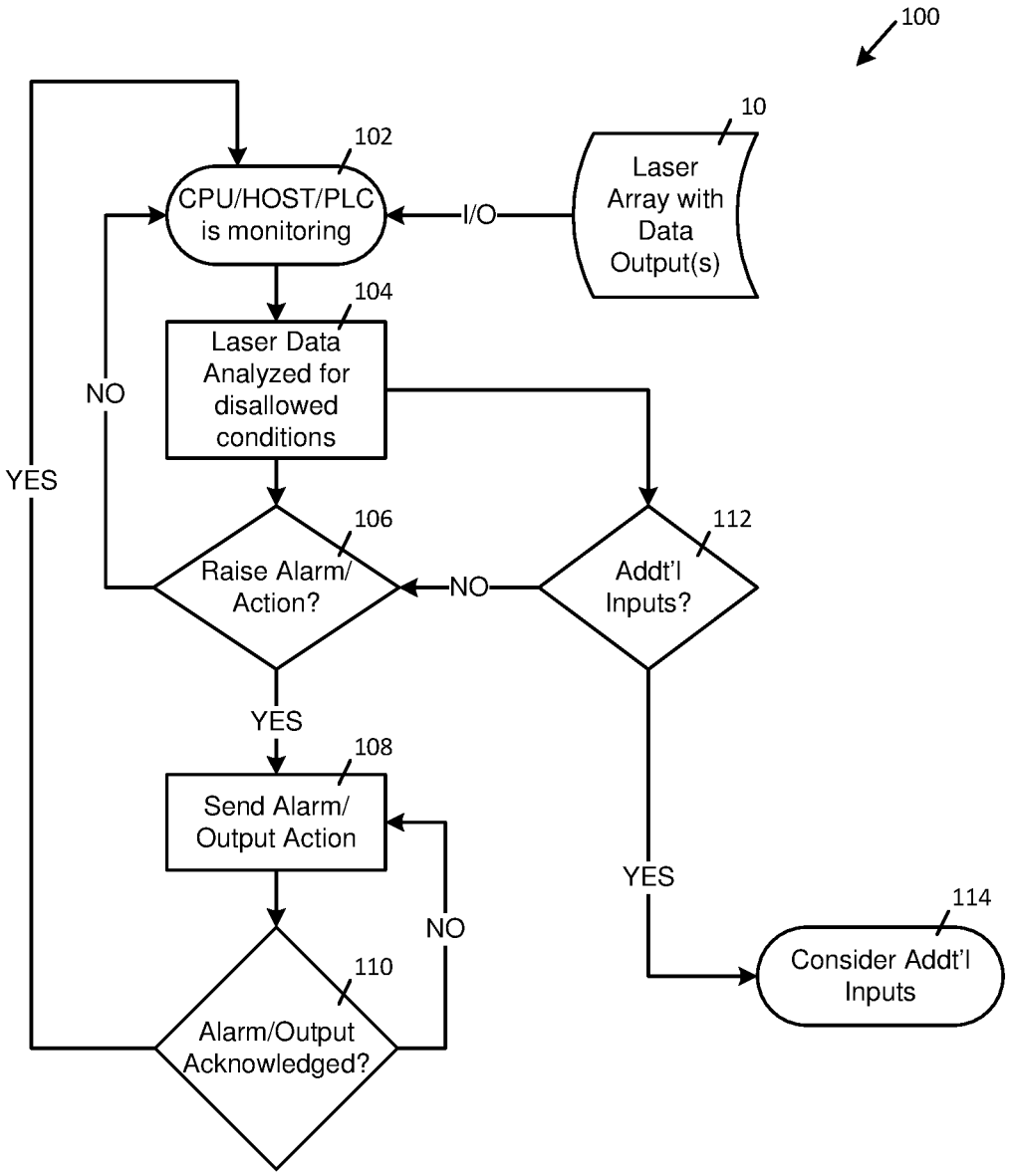
FIG. 4 is a flow chart illustrating one embodiment of a restricted area automated security method.

One example of a restricted area automated security method is illustrated in FIG. 4. The method 100 includes, at 102, monitoring by the control unit, for example, monitoring by the CPU/HOST/PLC, of data output(s) received from the laser sensors/scanners 10 (i.e., the laser array). At 104, the data from the laser array is analyzed, for example, by different analytical routines, for disallowed conditions. As such, at 106, the method determines whether an alarm or other action (i.e., output event) is to be raised or triggered. If not, monitoring by the control unit continues, at 102. If so, at 108, the alarm or other output action is initiated. In one embodiment, at 110, the method determines whether acknowledgement of the alarm or output event has occurred. If so, monitoring by the control unit continues, at 102. If not, the alarm or other output action is repeated, at 108. In one embodiment, at 112, the method determines whether the system includes additional inputs, such as, for example, power and/or voltage, temperature, and/or biometric information. If so, at 114, such additional inputs are considered in determining whether to initiate an alarm or other output action.

Figure 5:
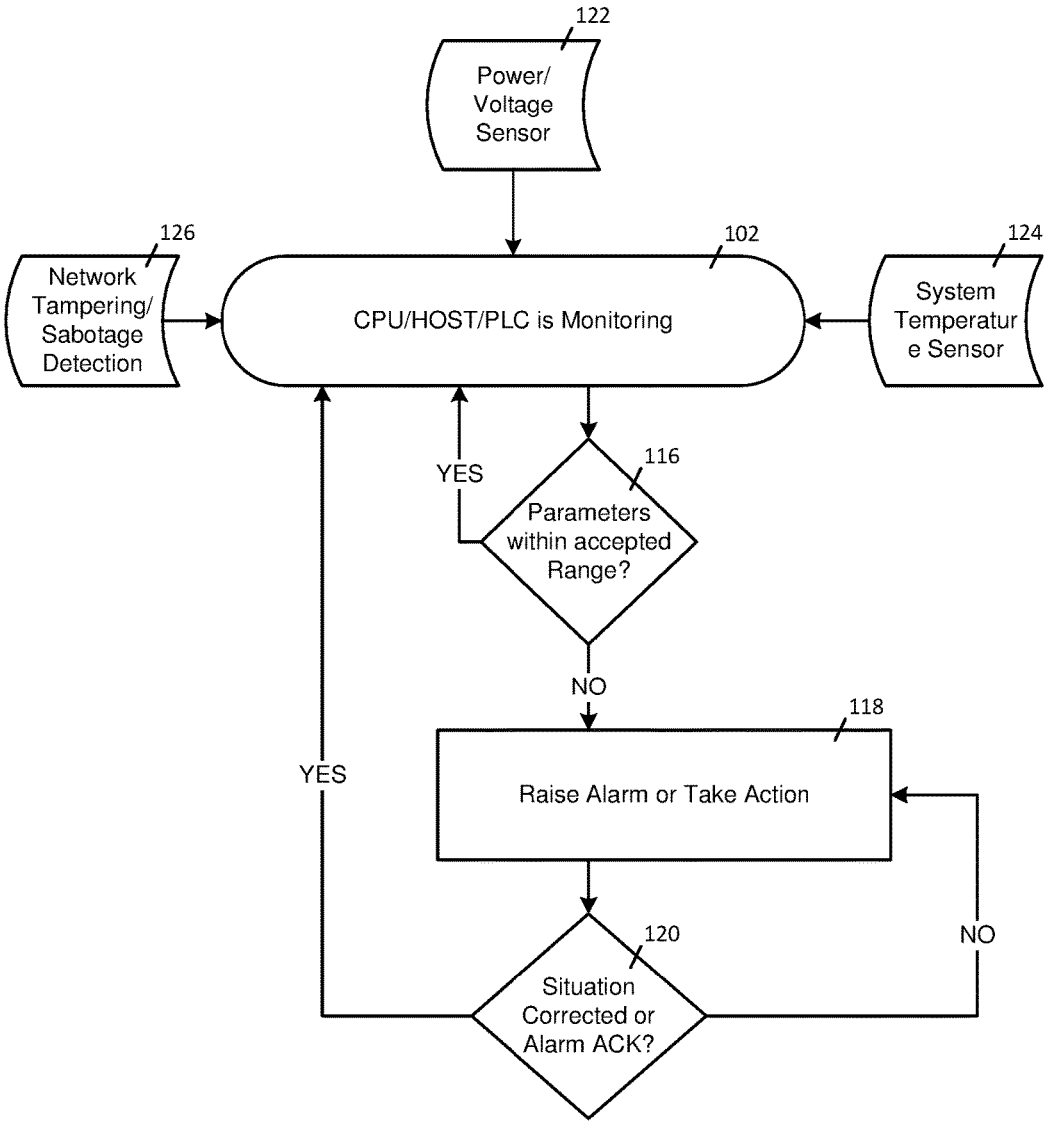
FIG. 5 is a flow chart illustrating one embodiment of a restricted area automated security method.

For example, as illustrated in FIG. 5, the restricted area automated security method considers additional inputs such as power/voltage, temperature, and/or network tampering/sabotage. As such, the method 100 includes, at 102, monitoring by the control unit, for example, monitoring by the CPU/HOST/PLC, of data received from a power/voltage sensor 122, a system temperature sensor 124, and/or network tampering/sabotage detection 126. In one embodiment, at 116, the method determines whether parameters of such inputs are within accepted range(s). If so, monitoring by the control unit continues, at 102. If not, at 118, an alarm or other action (i.e., output event) is raised or triggered. Such actions may include, for example, activating an uninterruptable power supply (UPS), closing a gate, notifying an operator, or other. In one embodiment, at 120, the method determines whether acknowledgement of the alarm or correction of the situation has occurred. If so, monitoring by the control unit continues, at 102. If not, the alarm or other action is repeated, at 118.

Figure 6:
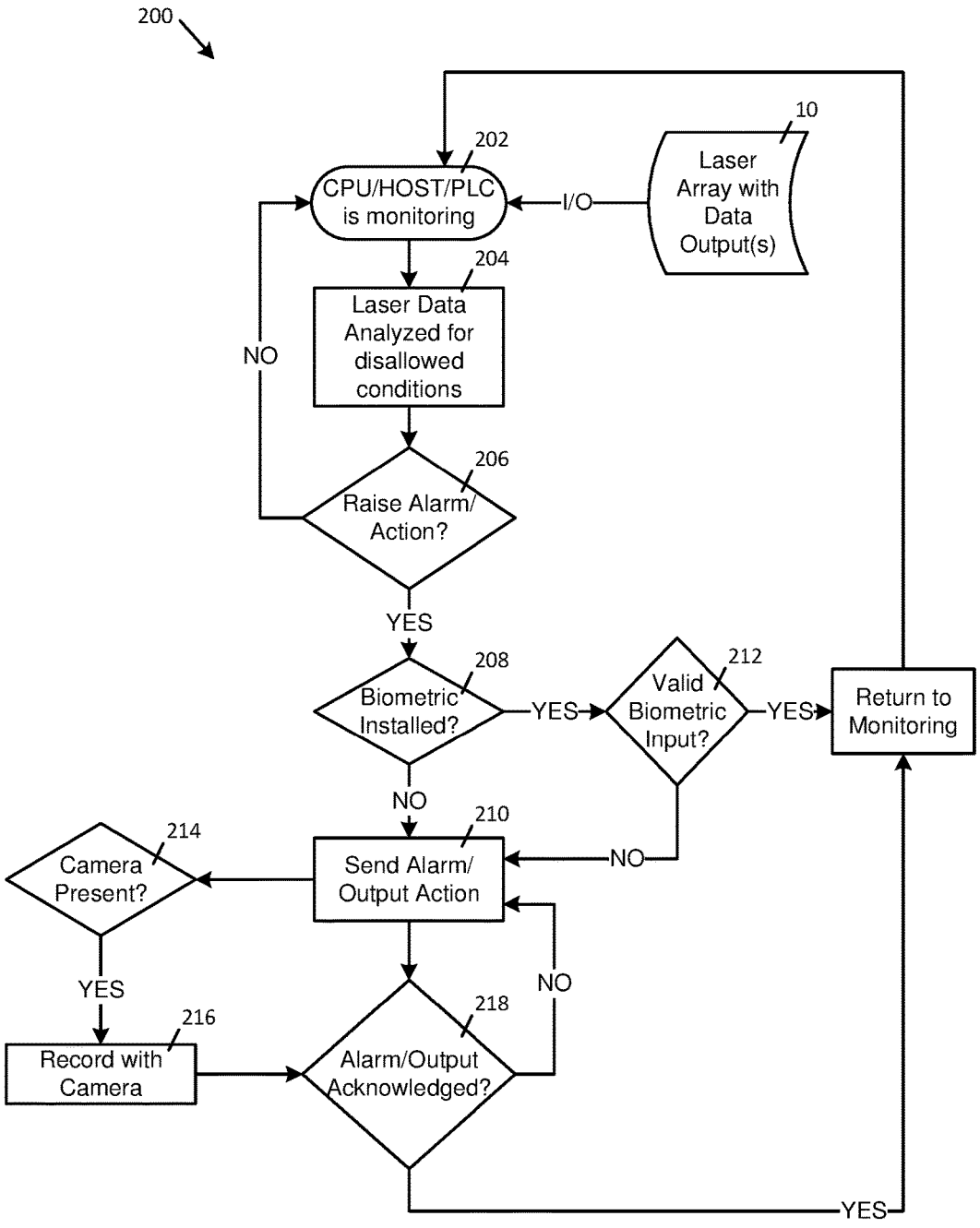
FIG. 6 is a flow chart illustrating one embodiment of a restricted area automated security method.

Another example of a restricted area automated security method is illustrated in FIG. 6. The method 200 includes, at 202, monitoring by the control unit, for example, monitoring by the CPU/HOST/PLC, of data output(s) received from the laser sensors/scanners 10 (i.e., the laser array). At 204, the data from the laser array is analyzed, for example, by different analytical routines, for disallowed conditions. As such, at 206, the method determines whether an alarm or other action (i.e., output event) is to be raised or triggered. If not, monitoring by the control unit continues, at 202. If so, at 208, the method determines whether the system includes a biometeric device. If not, at 210, an alarm or other action (i.e., output event) is raised or triggered. If so, at 212, the method determines whether input for the biometric device is (present and) valid. If so, monitoring by the control unit continues, at 202. If not, at 210, the alarm or other output action is initiated. In one embodiment, at 214, the method determines whether the system includes an image capture device (e.g., camera). If so, at 216, the image capture device captures or records one or more images (still images and/or video) of the area being monitored. In one embodiment, at 218, the method determines whether acknowledgement of the alarm or output event has occurred. If so, monitoring by the control unit continues, at 202. If not, the alarm or other output action is repeated, at 210.

Figure 7:
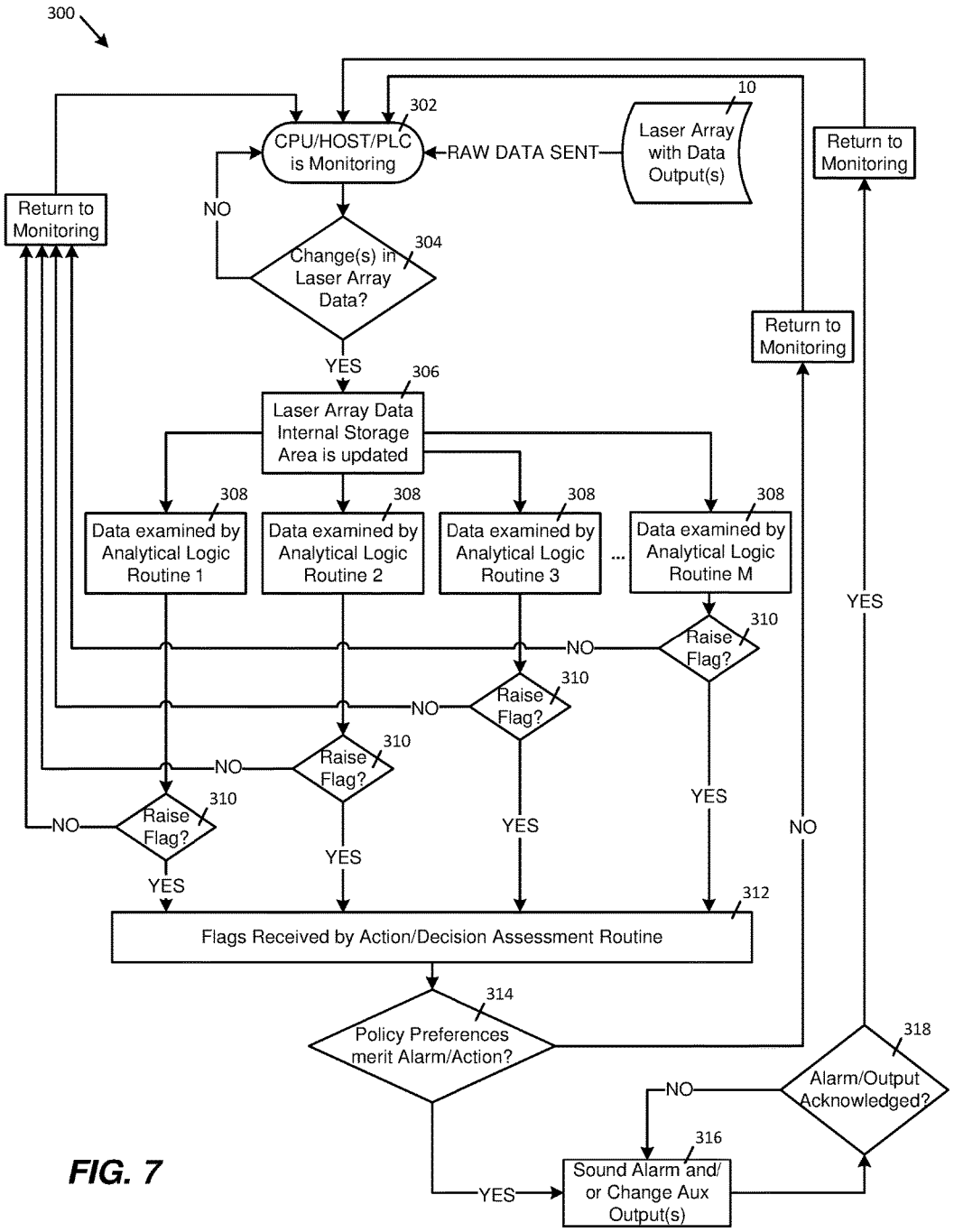
FIG. 7 is a flow chart illustrating one embodiment of a restricted area automated security method.

FIG. 7 illustrates one embodiment of a restricted area automated security method. The method 300 includes, at 302, monitoring by the control unit, for example, monitoring by the CPU/HOST/PLC, of data output(s) received from the laser sensors/scanners 10 (i.e., the laser array). As such, at 304, the method determines whether there are any changes in the data from the laser array. If not, monitoring by the control unit continues, at 302. If so, at 306, an internal storage area for the data from the laser array is updated. In one embodiment, at 308, the data from the laser array is examined, for example, by different analytical logic routines. As such, based on the laser array data and a respective analytical logic routine, the method, at 310, determines whether an event "flag" is to be raised or triggered. If not, monitoring by the control unit continues, at 302. If so, at 312, the "flags" are received by an action/decision assessment routine. As such, at 314, the method determines whether policy preferences, for example, of the end user, merit alarm and/or action. If not, monitoring by the control unit continues, at 302. If so, at 316, an alarm or other action (e.g., auxiliary output) is initiated. In one embodiment, at 318, the method determines whether acknowledgement of the alarm or output has occurred. If so, monitoring by the control unit continues, at 302. If not, the alarm or other output action is repeated, at 316.

Figure 8A:
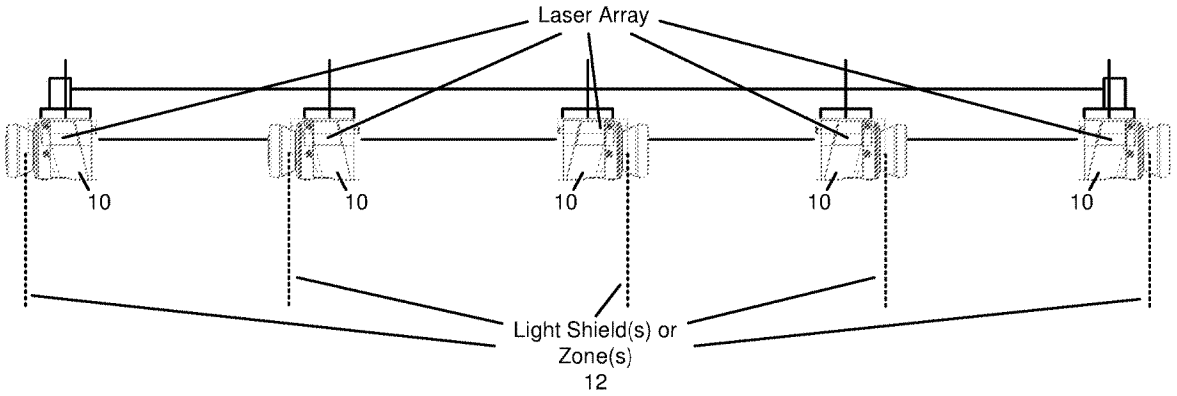
FIGS. 8A, 8B, 8C illustrate embodiments of a restricted area automated security system.
Figure 8B:
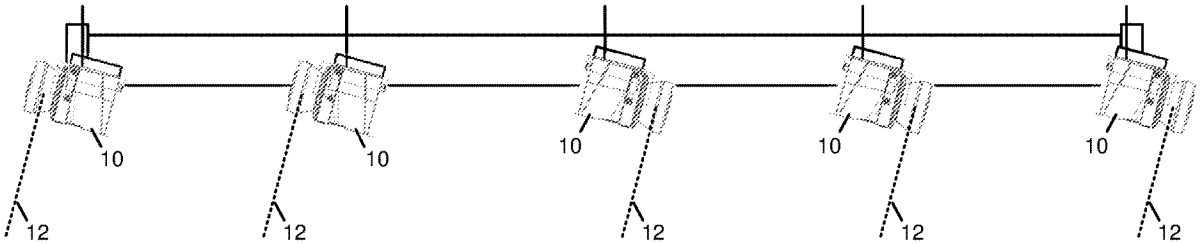
Figure 8C:
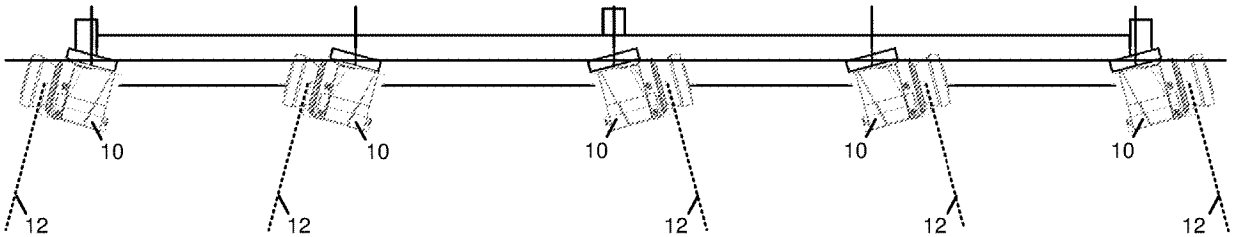

As described above, the light shields or zones created by the individual laser sensors/scanners of the laser array may be oriented at any angle or combination of angles, including the same or different angles. For example, FIGS. 8A, 8B, 8C illustrate side views of example embodiments of light shields or zones 12 of the individual laser sensors/scanners 10 of the laser array oriented at different angles. More specifically, FIG. 8A illustrates the light shields or zones 12 of the individual laser sensors/scanners 10 of the laser array oriented substantially parallel with each other at a substantially vertical angle, FIG. 8B illustrates the light shields or zones 12 of the individual laser sensors/scanners 10 of the laser array oriented substantially parallel with each other at the same non-orthogonal angle, and FIG. 8C illustrates the light shields or zones 12 of the individual laser sensors/scanners 10 of the laser array oriented at different non-orthogonal angles, including two light shields or zones oriented substantially parallel with each other at a first non-orthogonal angle, and three light shields or zones oriented substantially parallel with each other at a second non-orthogonal angle.

Figure 9:
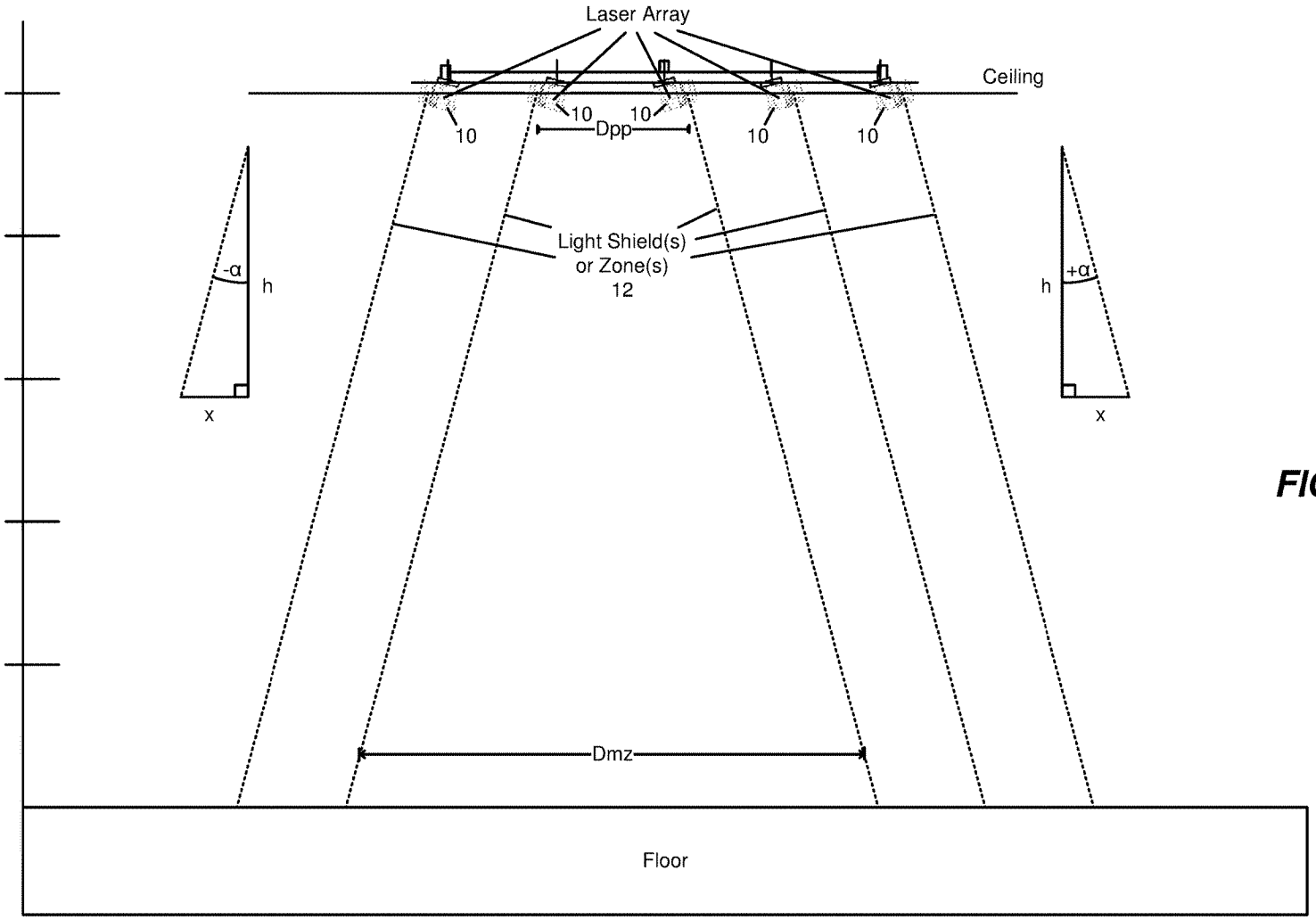
FIG. 9 illustrates one embodiment of a restricted area automated security system.

FIG. 9 illustrates one embodiment of the restricted area automated security system with the light shields or zones 12 of the individual laser sensors/scanners 10 of the laser array oriented at different non-orthogonal angles, including two light shields or zones oriented substantially parallel with each other at a first non-orthogonal angle, and three light shields or zones oriented substantially parallel with each other at a second non-orthogonal angle.

FIGS. 10A-10D, 11A-11C, 12A-12E, and 13A-13E illustrate embodiments of detecting example events with the restricted area automated security system and method disclosed herein.

Figure 10A:
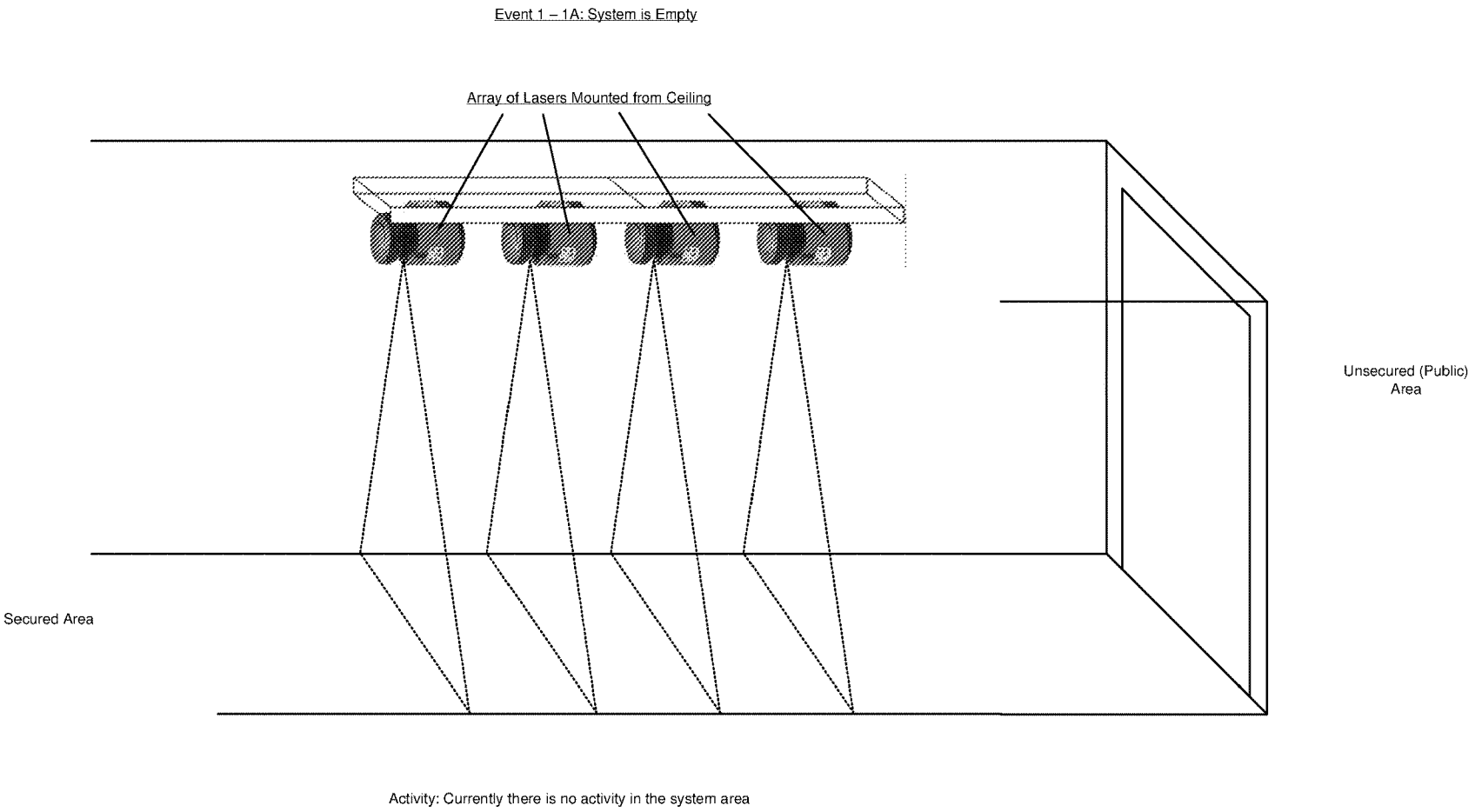
FIGS. 10A-10D illustrate one embodiment of a restricted area automated security system and method detecting one example of an event.
Figure 10B:
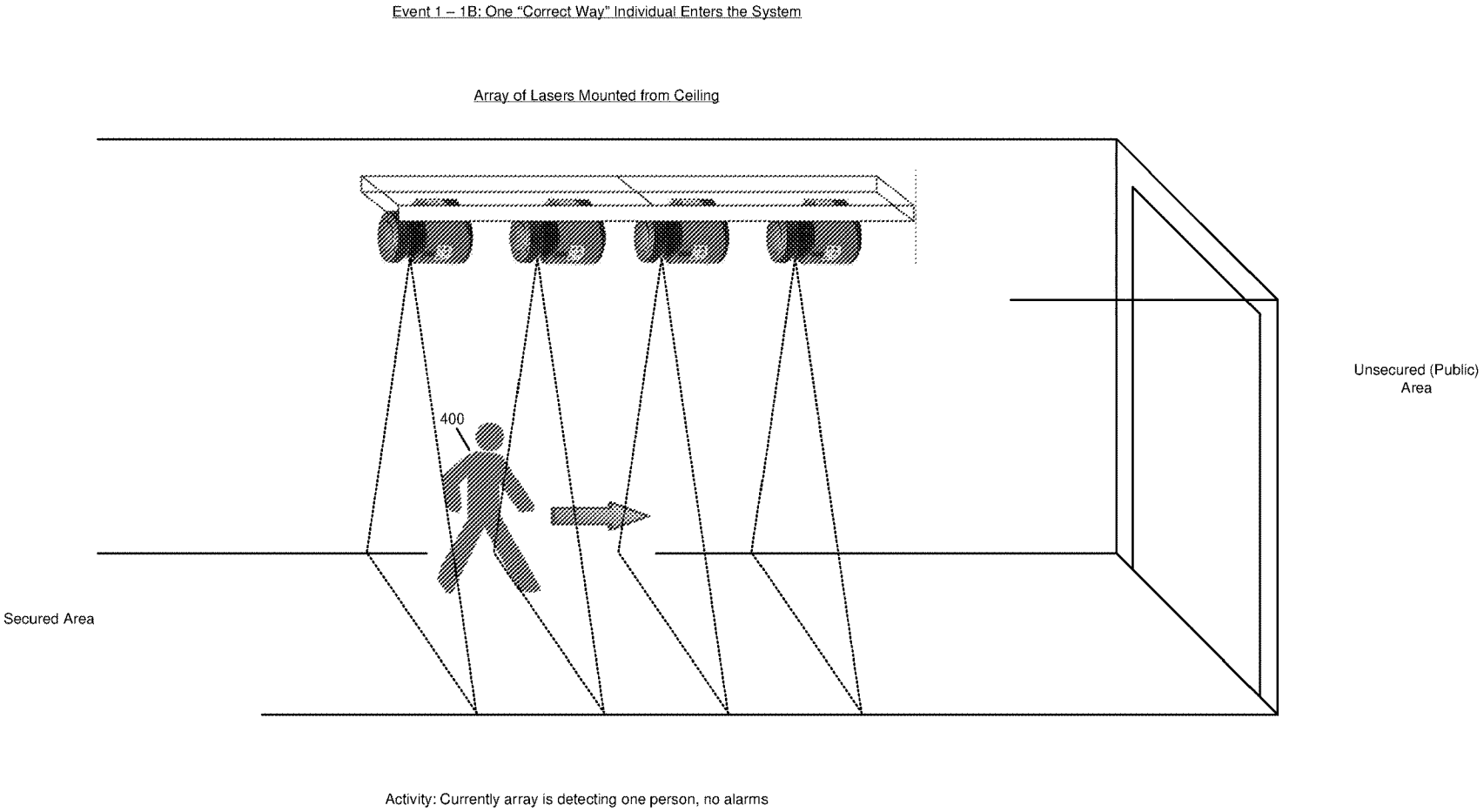
Figure 10C:
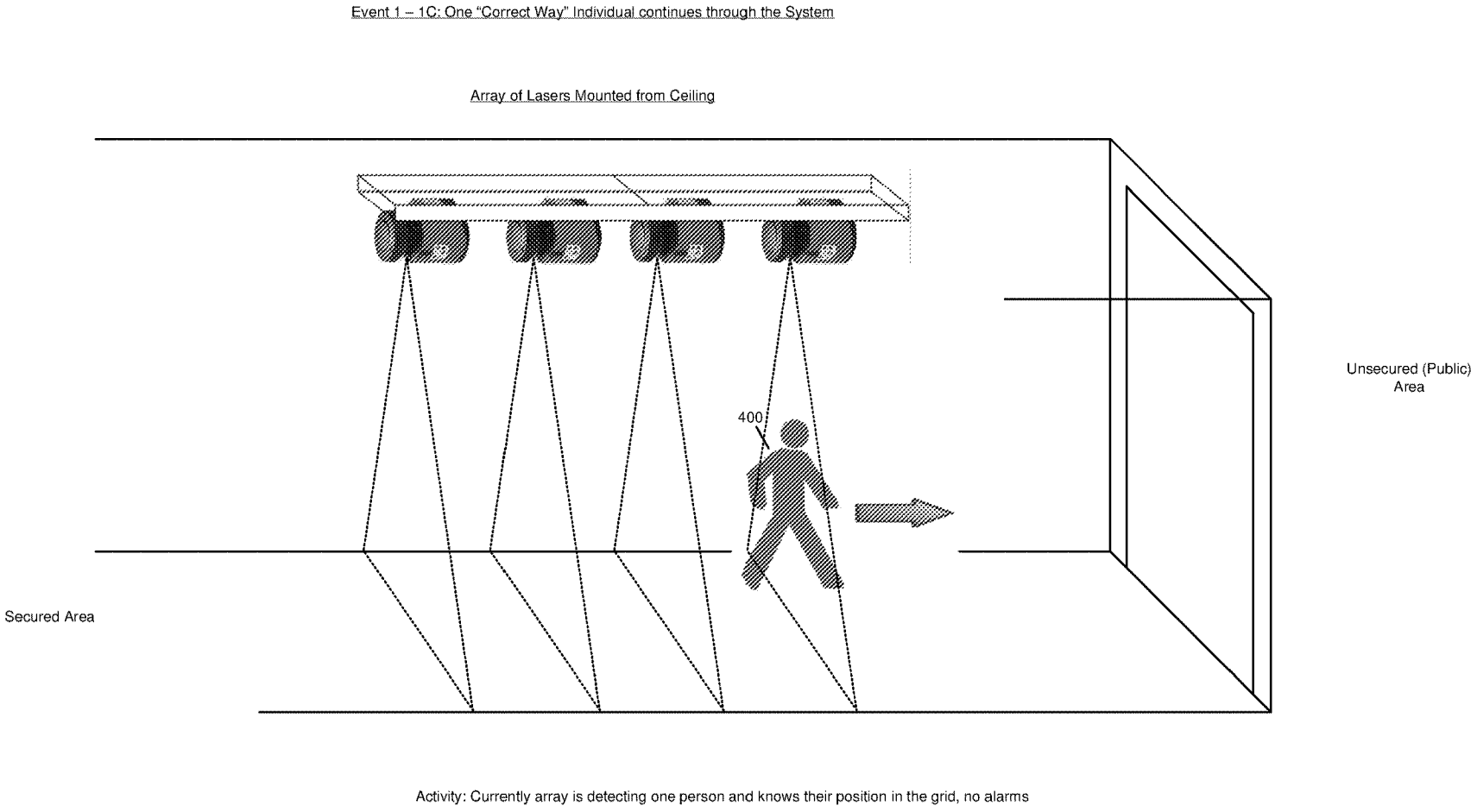
Figure 10D:
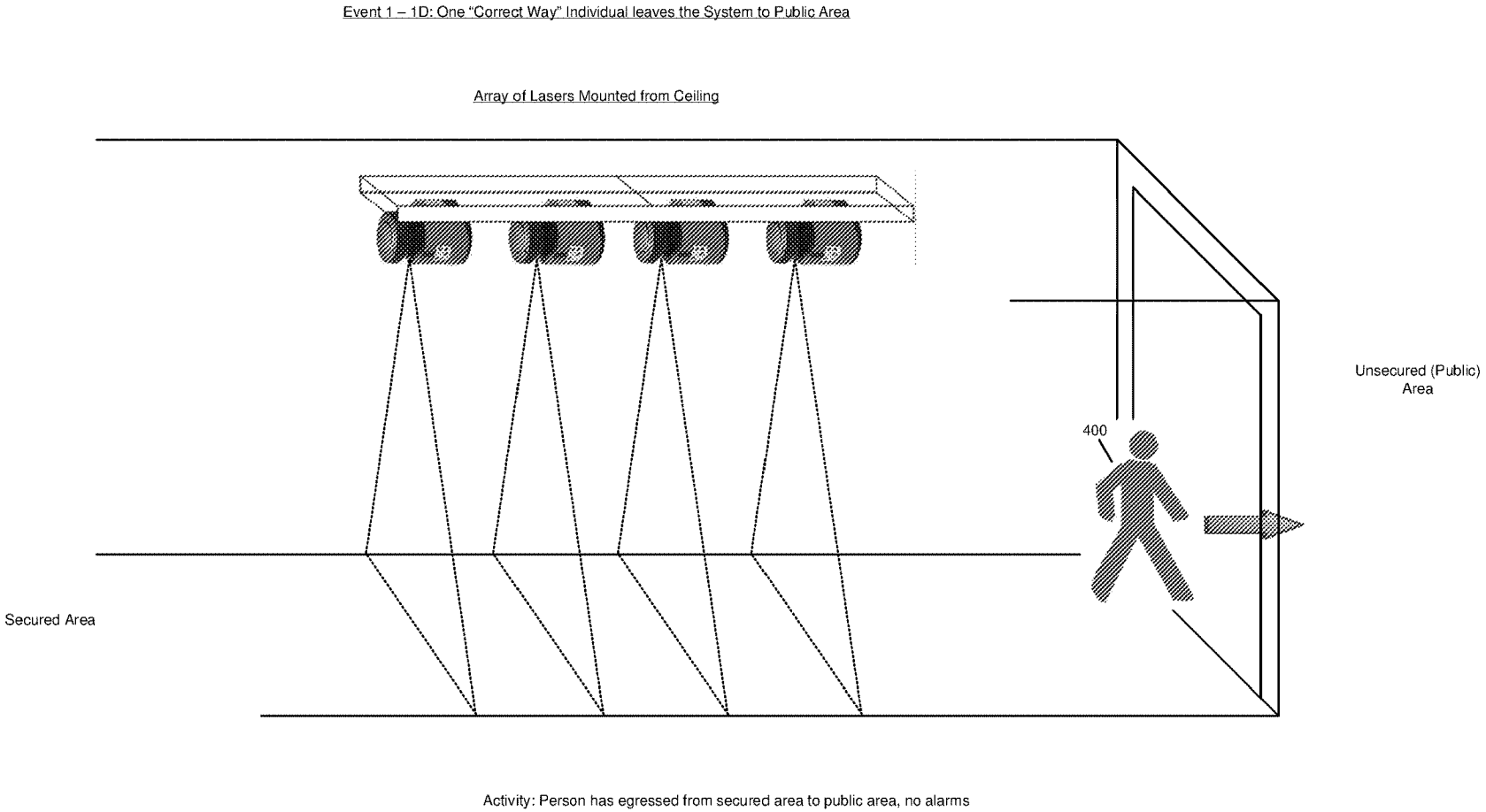

For example, FIGS. 10A-10D illustrate travel or movement between a secured area and an unsecured (public) area in the correct direction, with FIG. 10A illustrating no activity in the detection area of the system, with FIG. 10B illustrating an individual 400 entering the detection area of the system and the laser array detecting one person traveling in the correct direction, with FIG. 10C illustrating the individual 400 continuing to travel through the detection area of the system and the laser array continuing to detect the person traveling in the correct direction such that the system knows the position of the person within the matrix or grid created by the laser array, and with FIG. 10D illustrating the individual 400 leaving the detection area of the system and entering the unsecured (public) area such that the individual 400 has egressed from the secured area to the unsecured (public) area with no alarm or other alert.

Figure 11A:
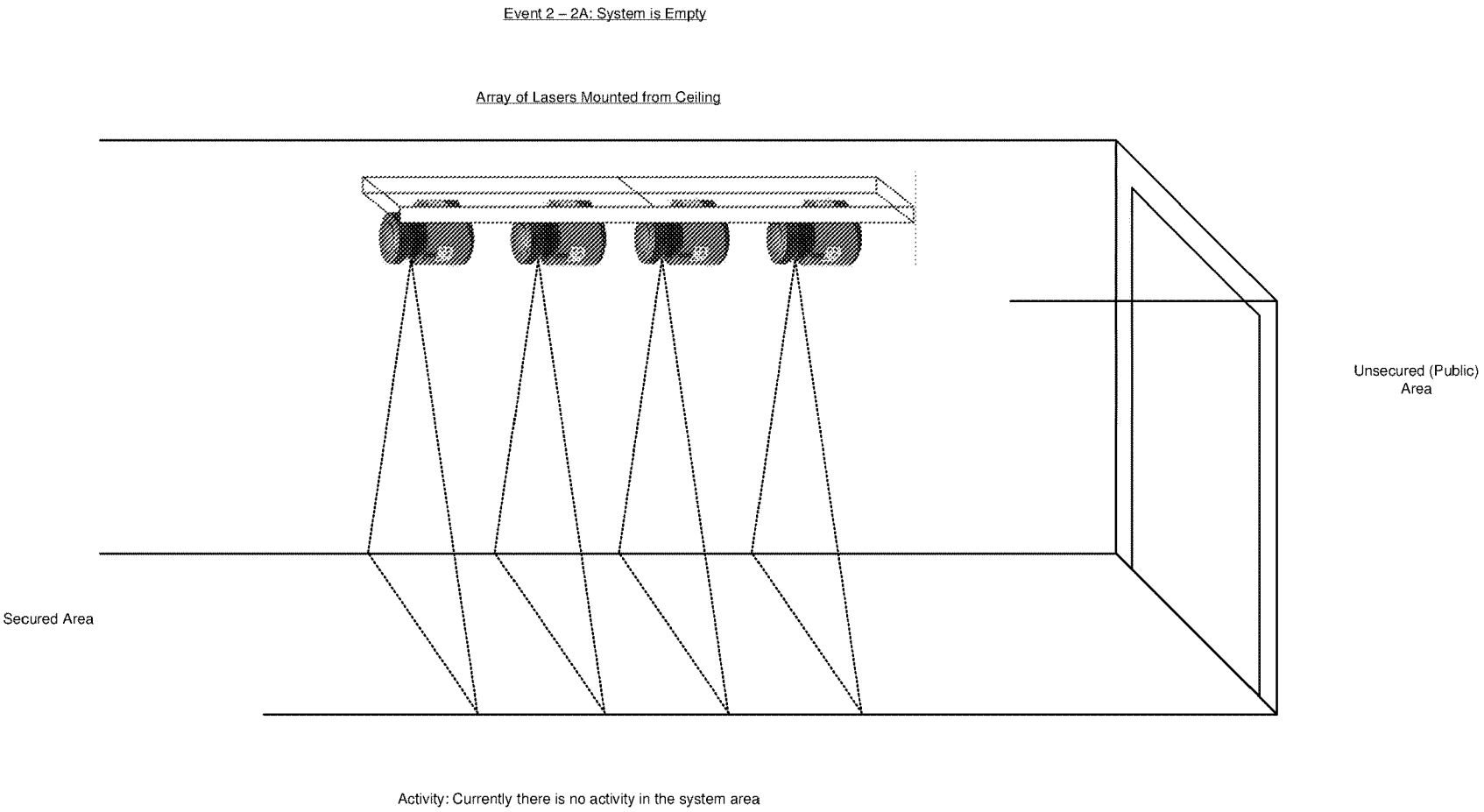
FIGS. 11A-11C illustrate one embodiment of a restricted area automated security system and method detecting one example of an event.
Figure 11B:
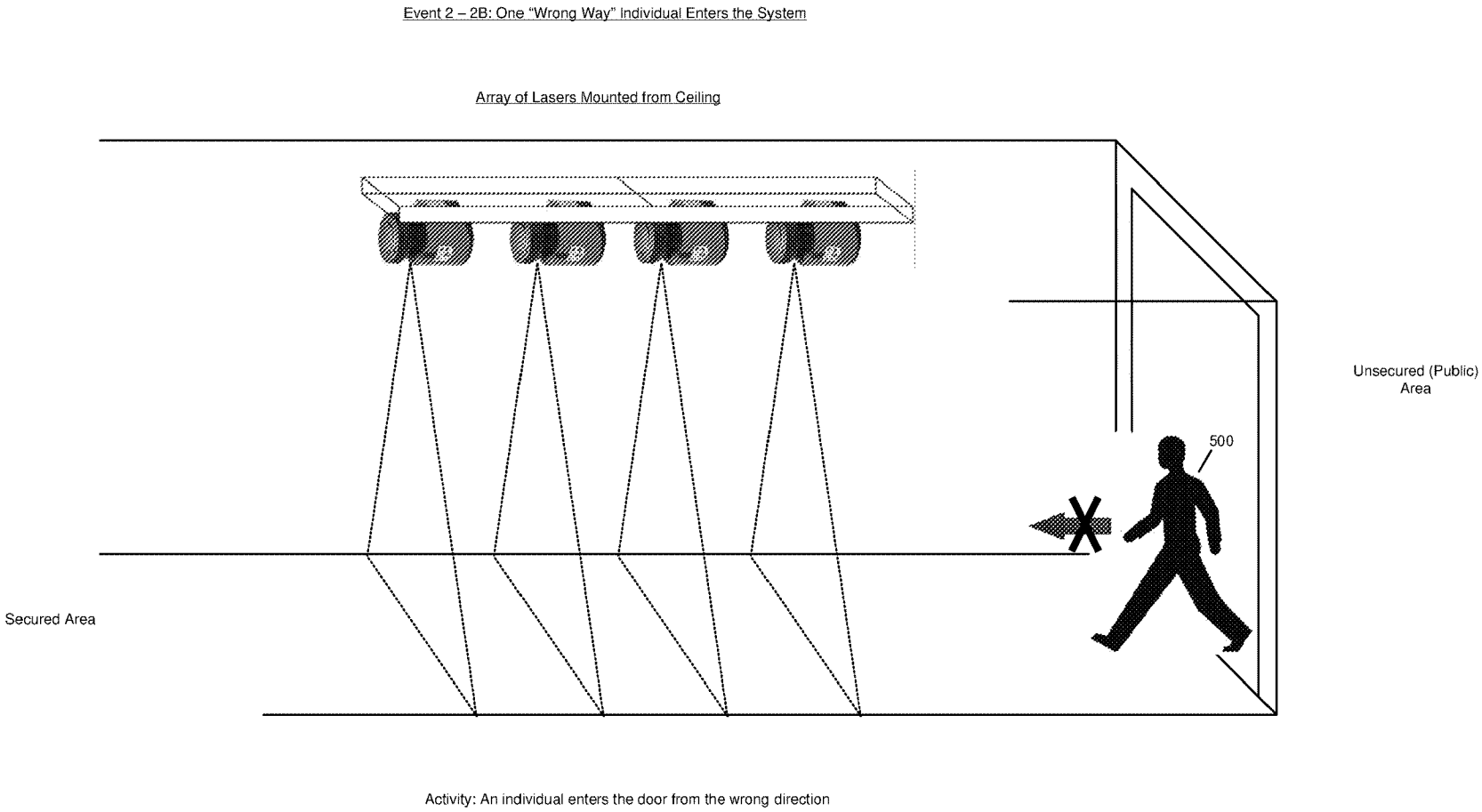
Figure 11C:
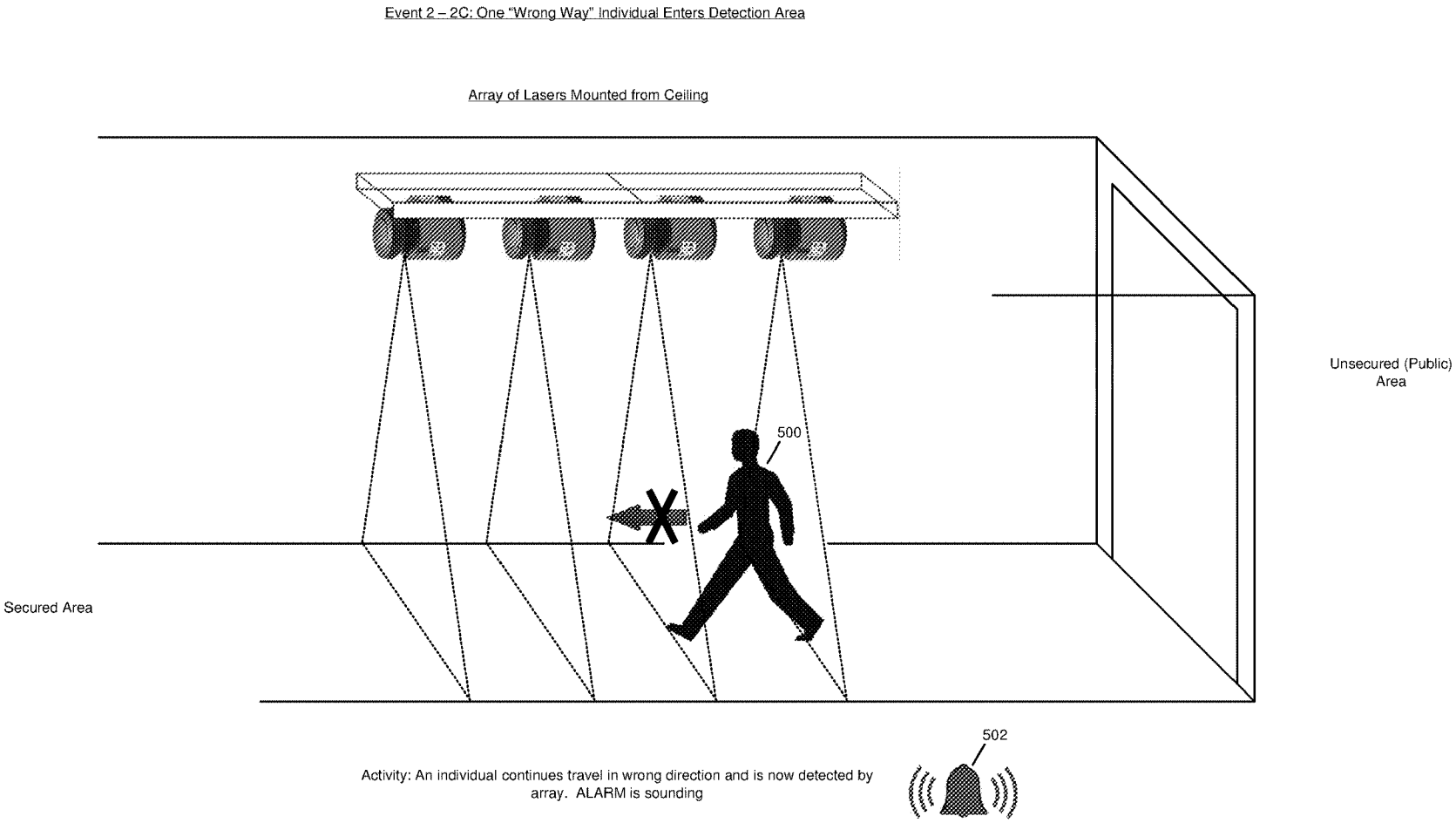

For example, FIGS. 11A-11C illustrate travel or movement between a secured area and an unsecured (public) area in the wrong direction, with FIG. 11A illustrating no activity in the detection area of the system, with FIG. 11B illustrating an individual 500 approaching the detection area of the system and traveling in the wrong direction, and with FIG. 11C illustrating the individual 500 traveling through the detection area of the system and the laser array detecting the person traveling in the wrong direction such that an alarm or other alert is initiated, such as alarm 502.

Figure 12A:
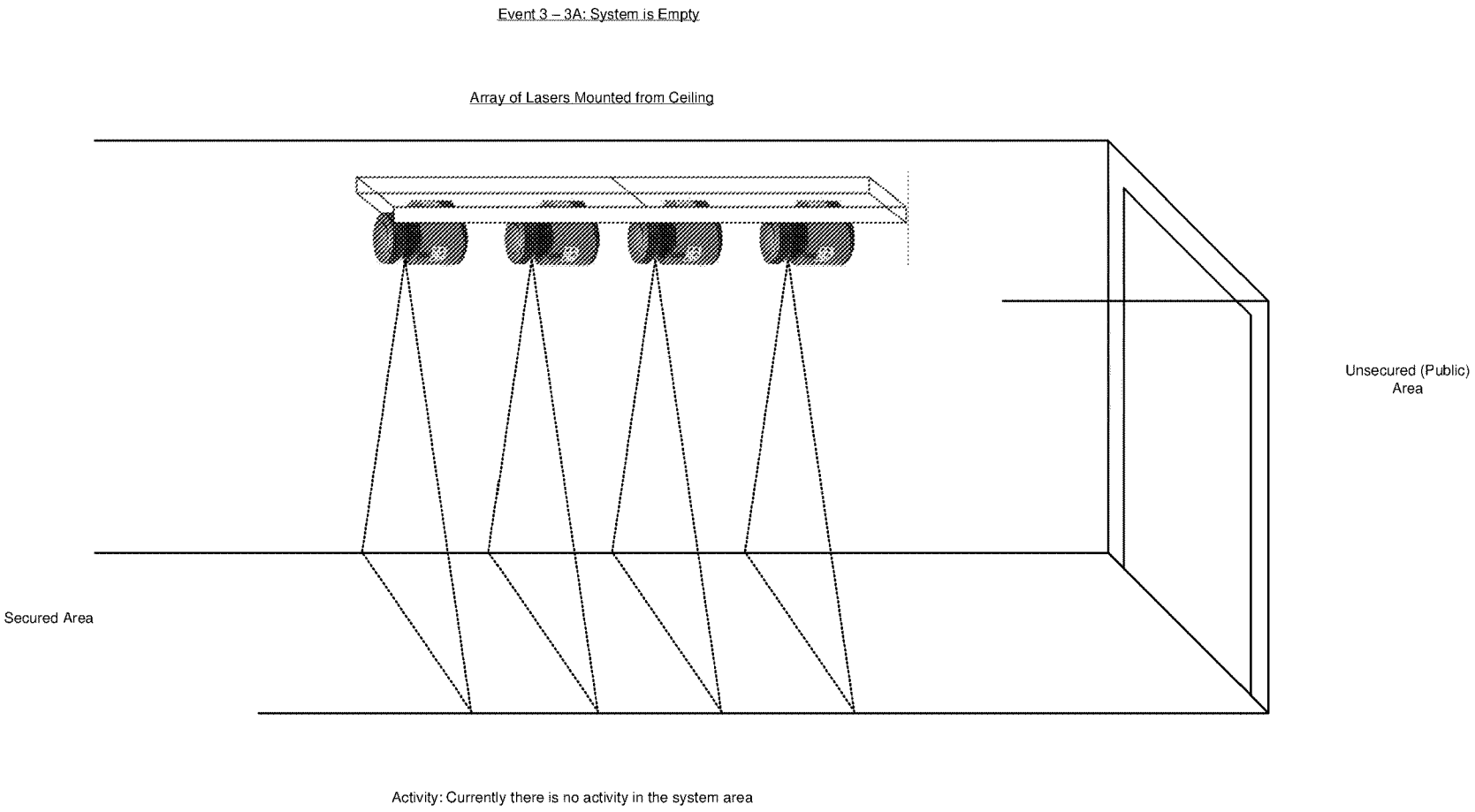
FIGS. 12A-12E illustrate one embodiment of a restricted area automated security system and method detecting one example of an event.
Figure 12B:
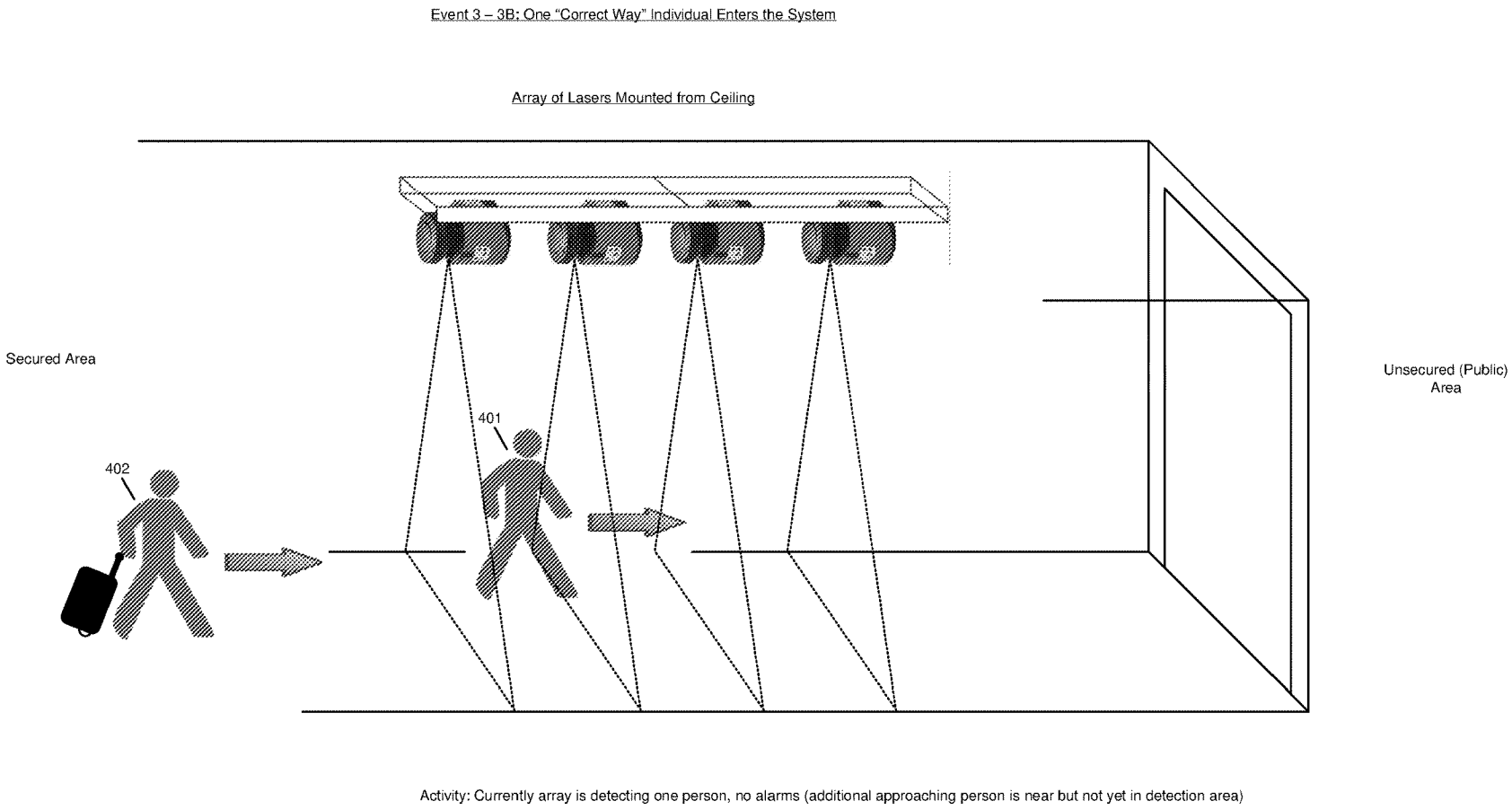
Figure 12C:
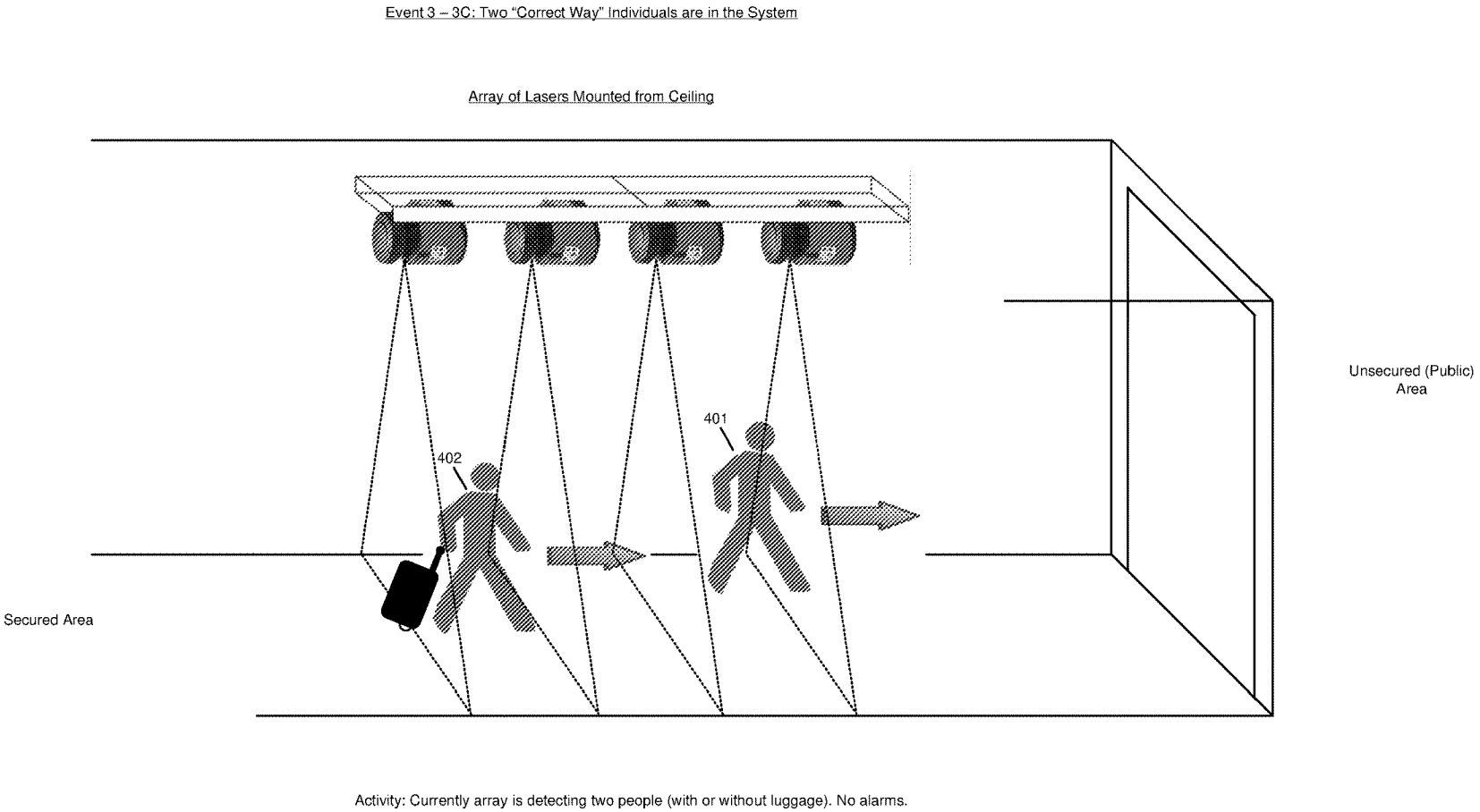
Figure 12D:
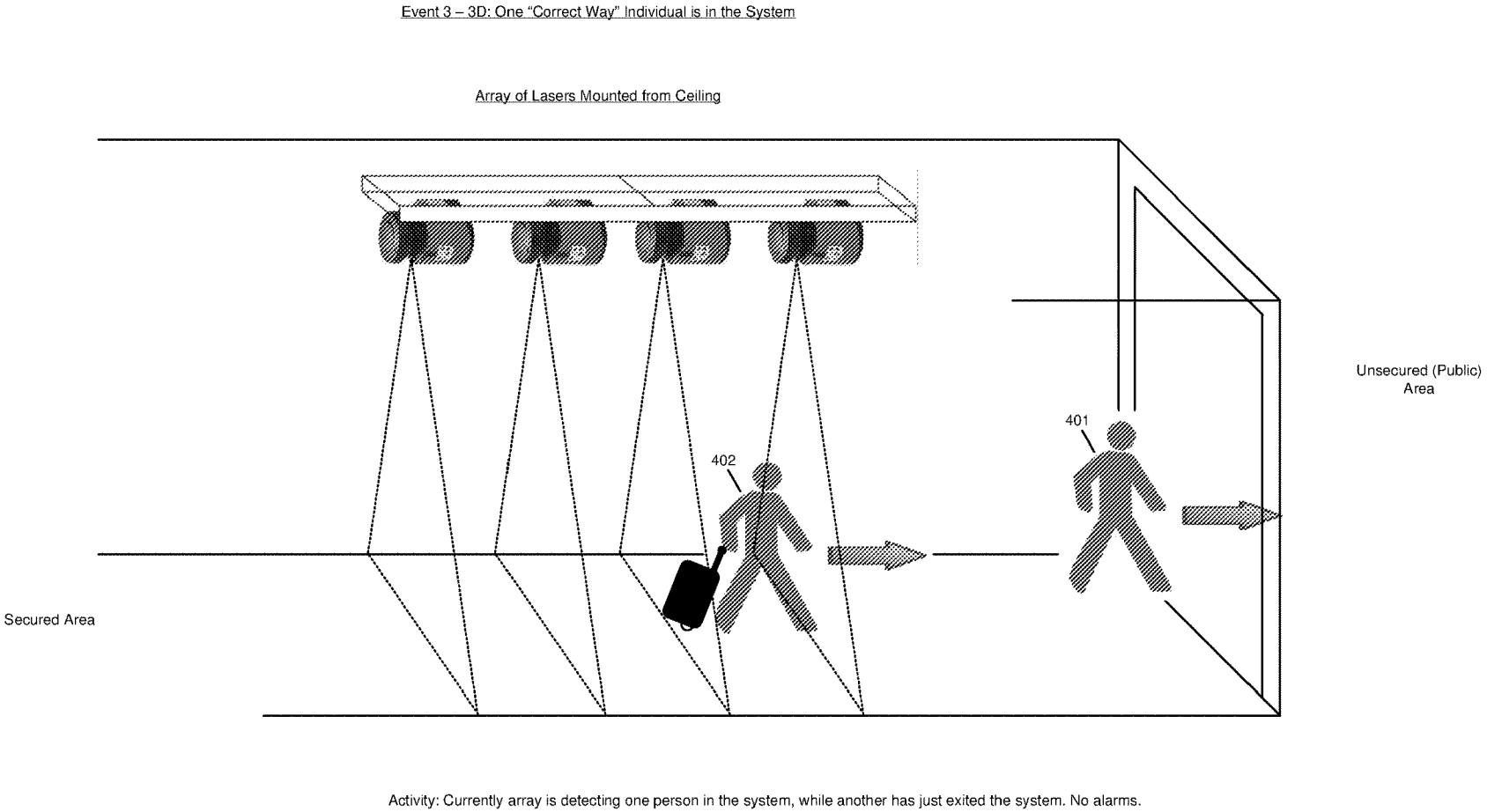
Figure 12E:
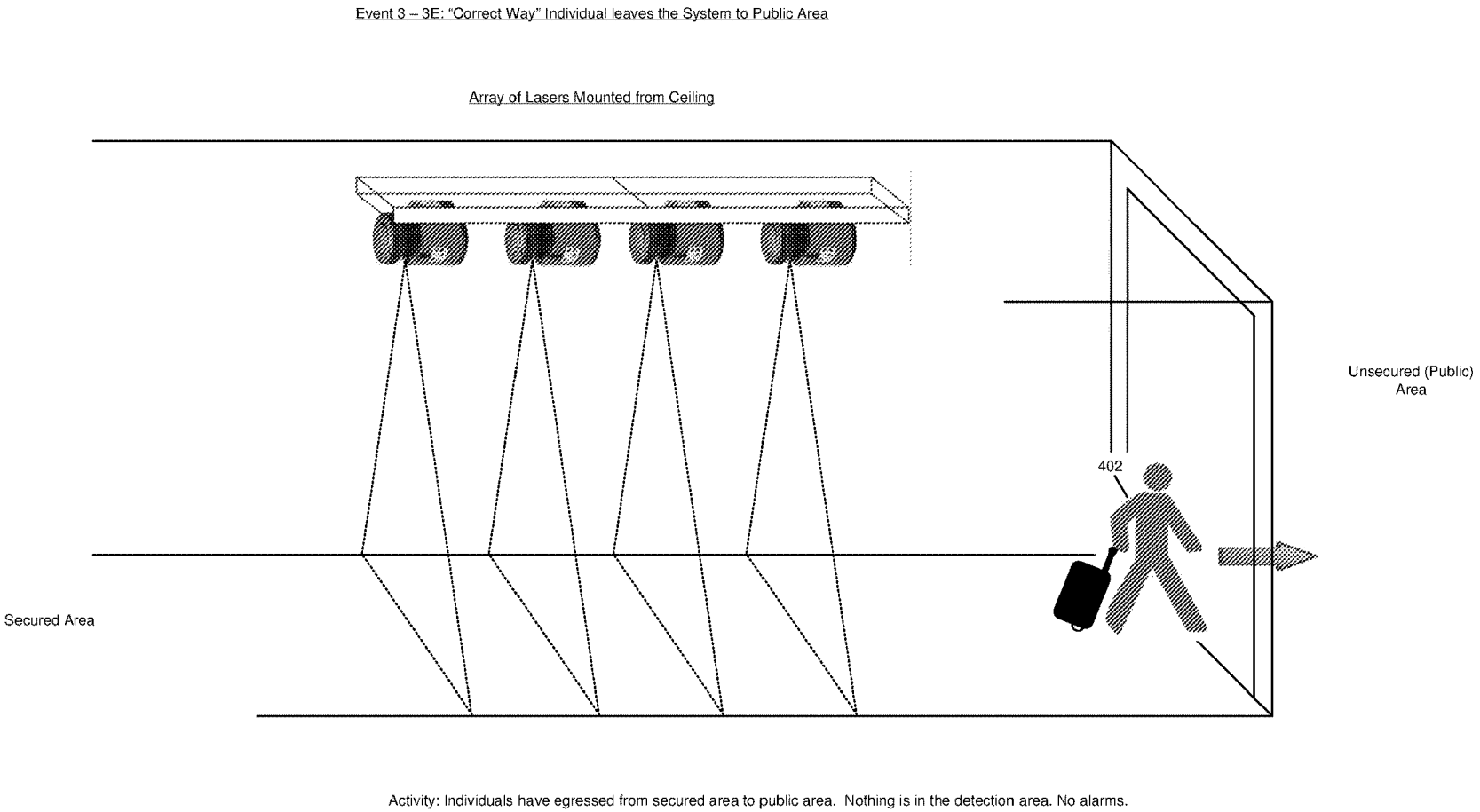

For example, FIGS. 12A-12E illustrate travel or movement between a secured area and an unsecured (public) area in the correct direction, with FIG. 12A illustrating no activity in the detection area of the system, with FIG. 12B illustrating a first individual 401 entering the detection area of the system, a second individual 402 approaching the detection area of the system, and the laser array detecting one person traveling in the correct direction, with FIG. 12C illustrating the first individual 401 continuing to travel through the detection area of the system, the second individual 402 entering the detection area of the system, and the laser array detecting two people traveling in the correct direction, with FIG. 12D illustrating the first individual 401 leaving the detection area of the system and entering the unsecured (public) area, the second individual 402 continuing to travel through the detection area of the system, and the laser array detecting one person traveling in the correct direction, and with FIG. 12E illustrating the second individual 402 leaving the detection area of the system and entering the unsecured (public) area such that both individuals 401, 402 have egressed from the secured area to the unsecured (public) area with no alarm or other alert.

Figure 13A:
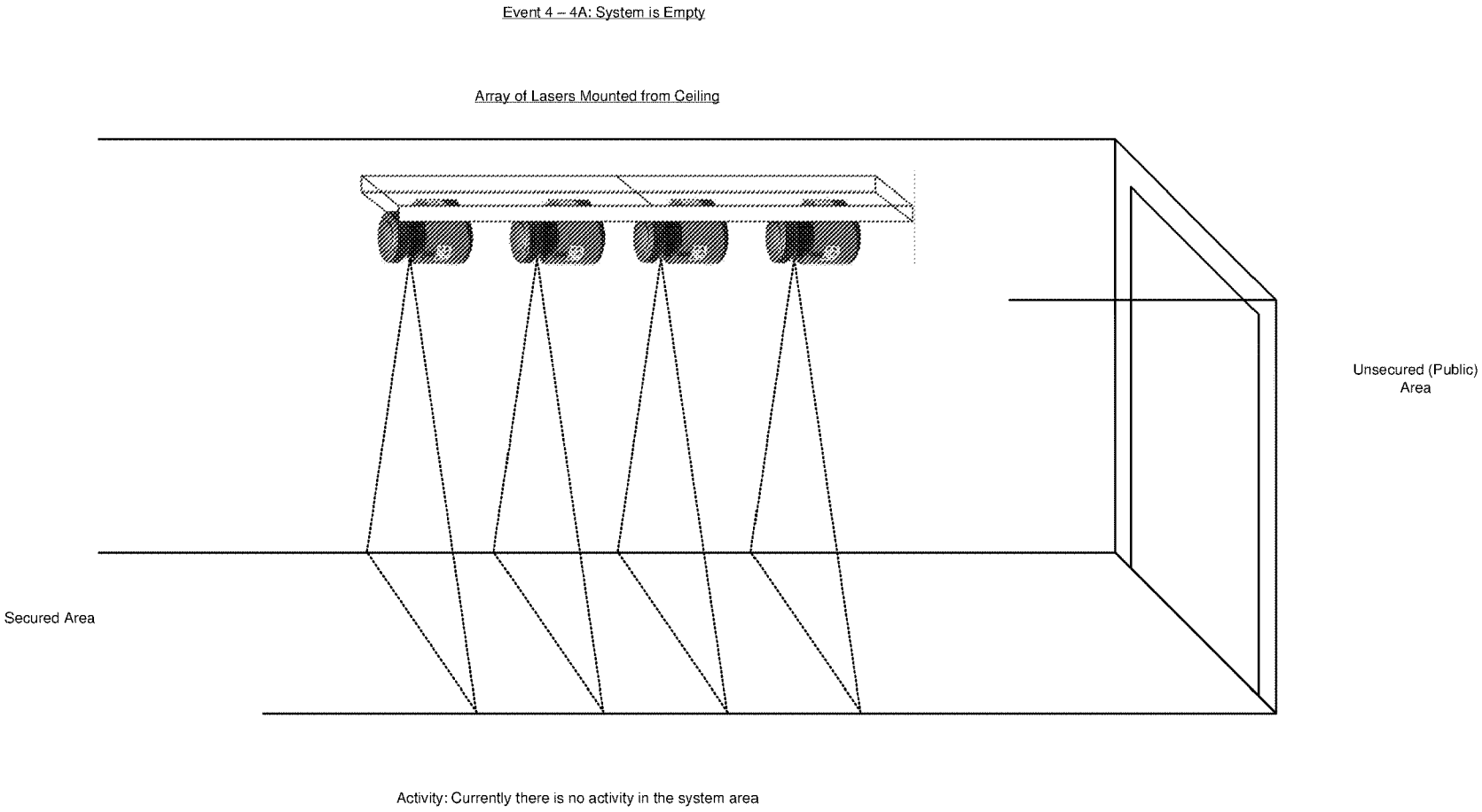
FIGS. 13A-13E illustrate one embodiment of a restricted area automated security system and method detecting one example of an event.
Figure 13B:
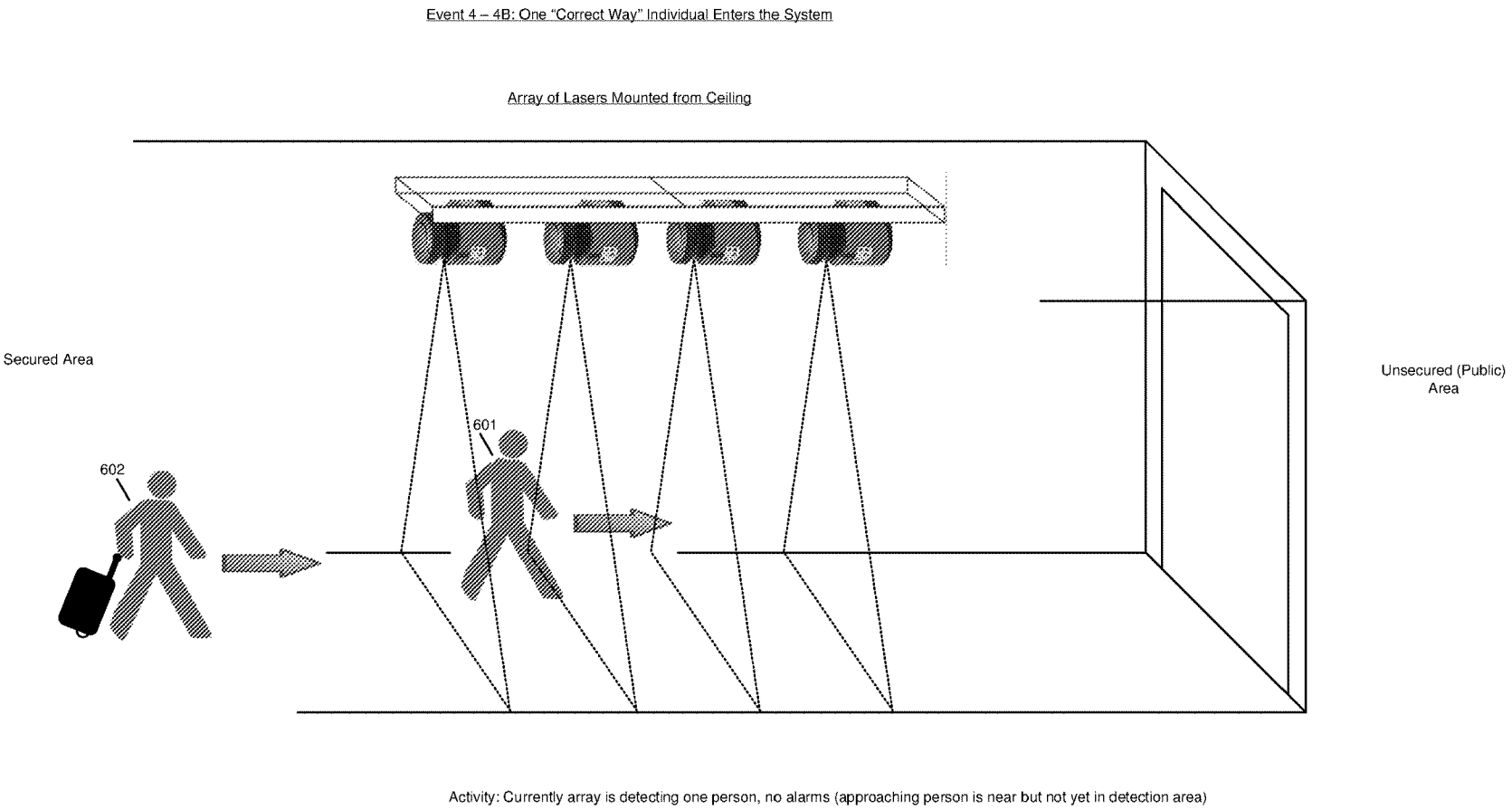
Figure 13C:
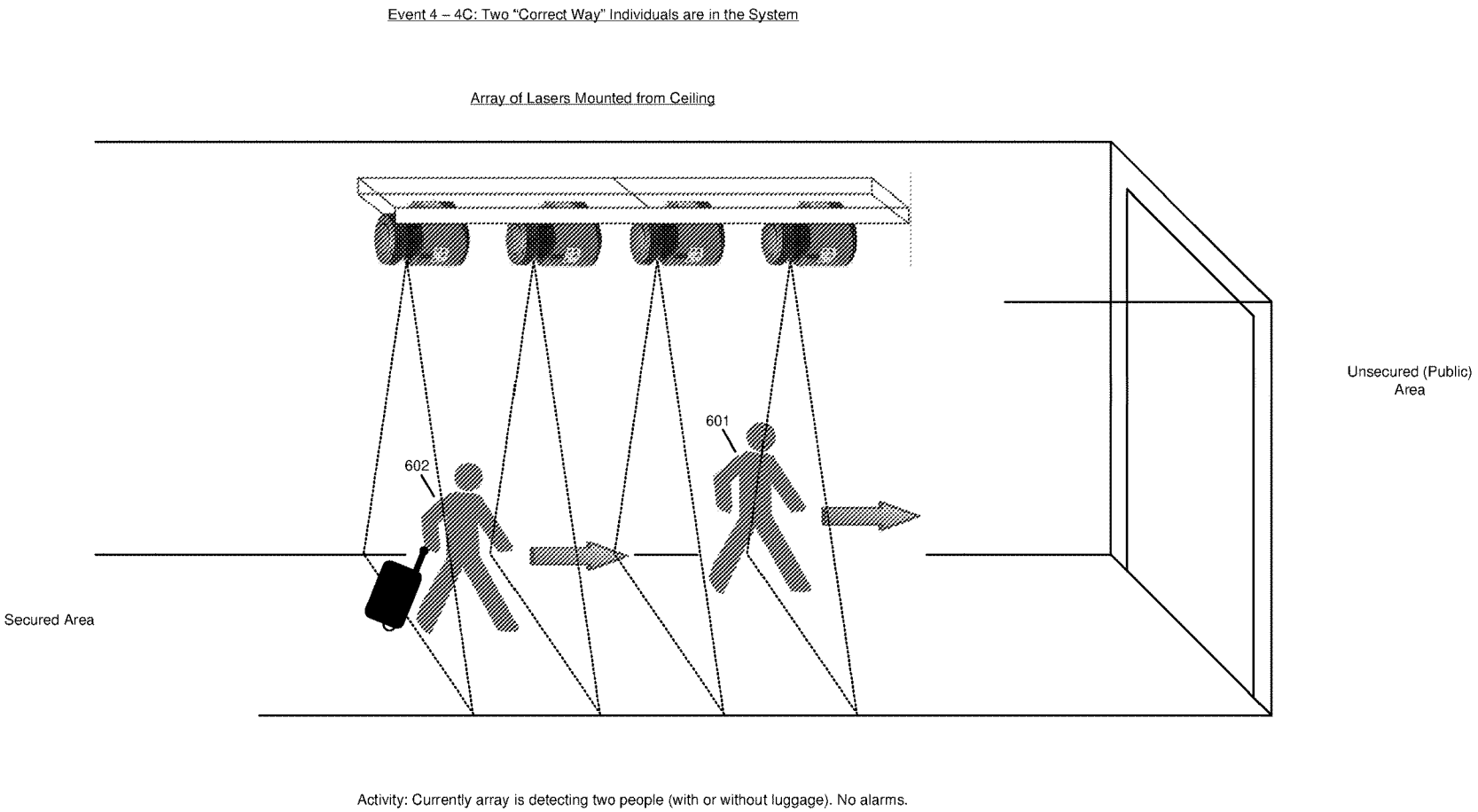
Figure 13D:
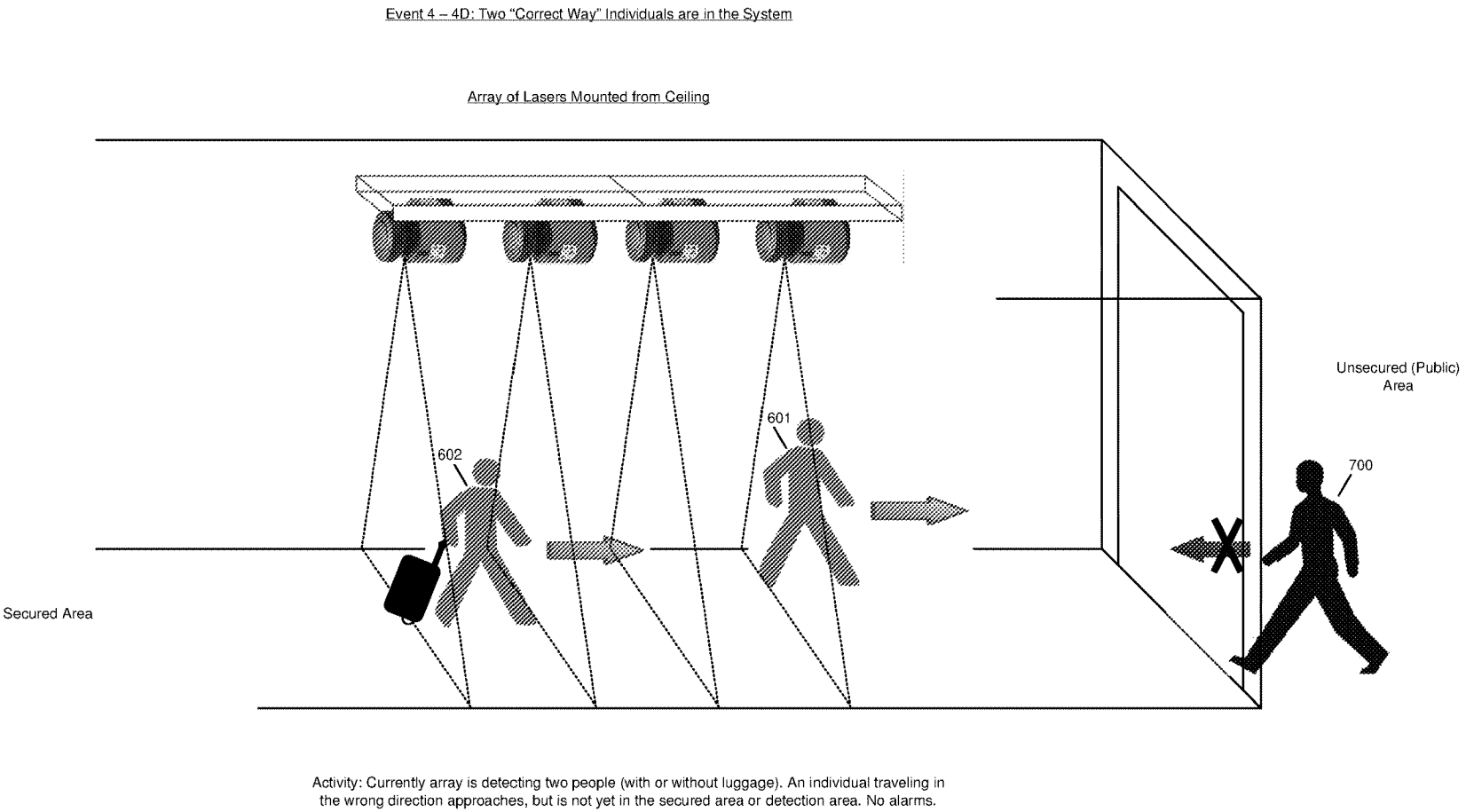
Figure 13E:
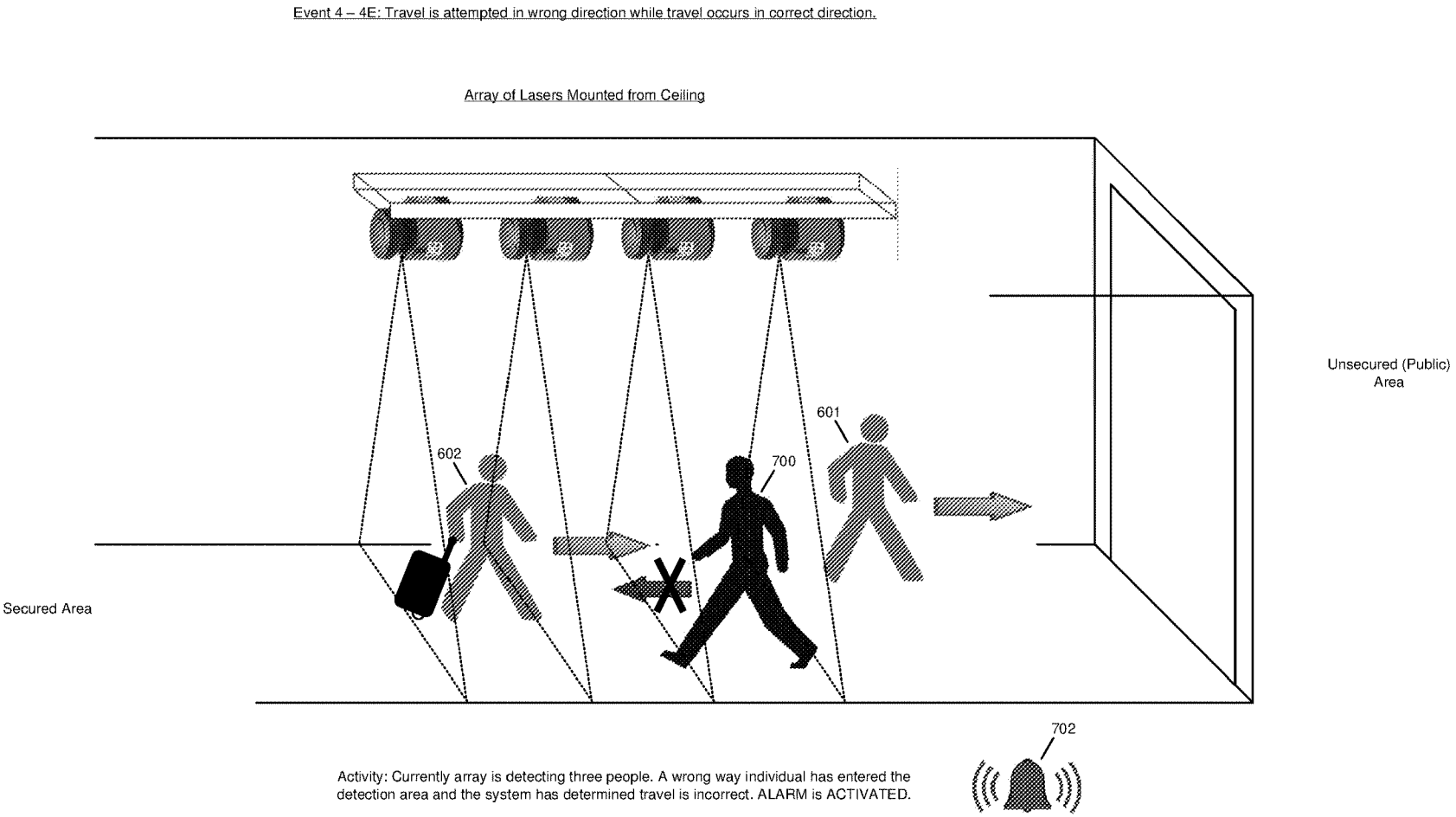

For example, FIGS. 13A-13E illustrate travel or movement between a secured area and an unsecured (public) area in the correct direction and the wrong direction, with FIG. 13A illustrating no activity in the detection area of the system, with FIG. 13B illustrating a first individual 601 entering the detection area of the system, a second individual 602 approaching the detection area of the system, and the laser array detecting one person traveling in the correct direction, with FIG. 13C illustrating the first individual 601 continuing to travel through the detection area of the system, the second individual 602 entering the detection area of the system, and the laser array detecting two people traveling in the correct direction, with FIG. 13D illustrating the first individual 601 continuing to travel through the detection area of the system, the second individual 602 continuing to travel through the detection area of the system, a third individual 700 approaching the detection area of the system and traveling in the wrong direction, and the laser array detecting two people traveling in the correct direction, and with FIG. 13E illustrating the first and second individuals 601, 602 continuing to travel through the detection area of the system, the third individual 700 traveling through the detection area of the system, and the laser array detecting two people traveling in the correct direction and a third person traveling in the wrong direction such that an alarm or other alert is initiated, such as alarm 702.

Figure 14:
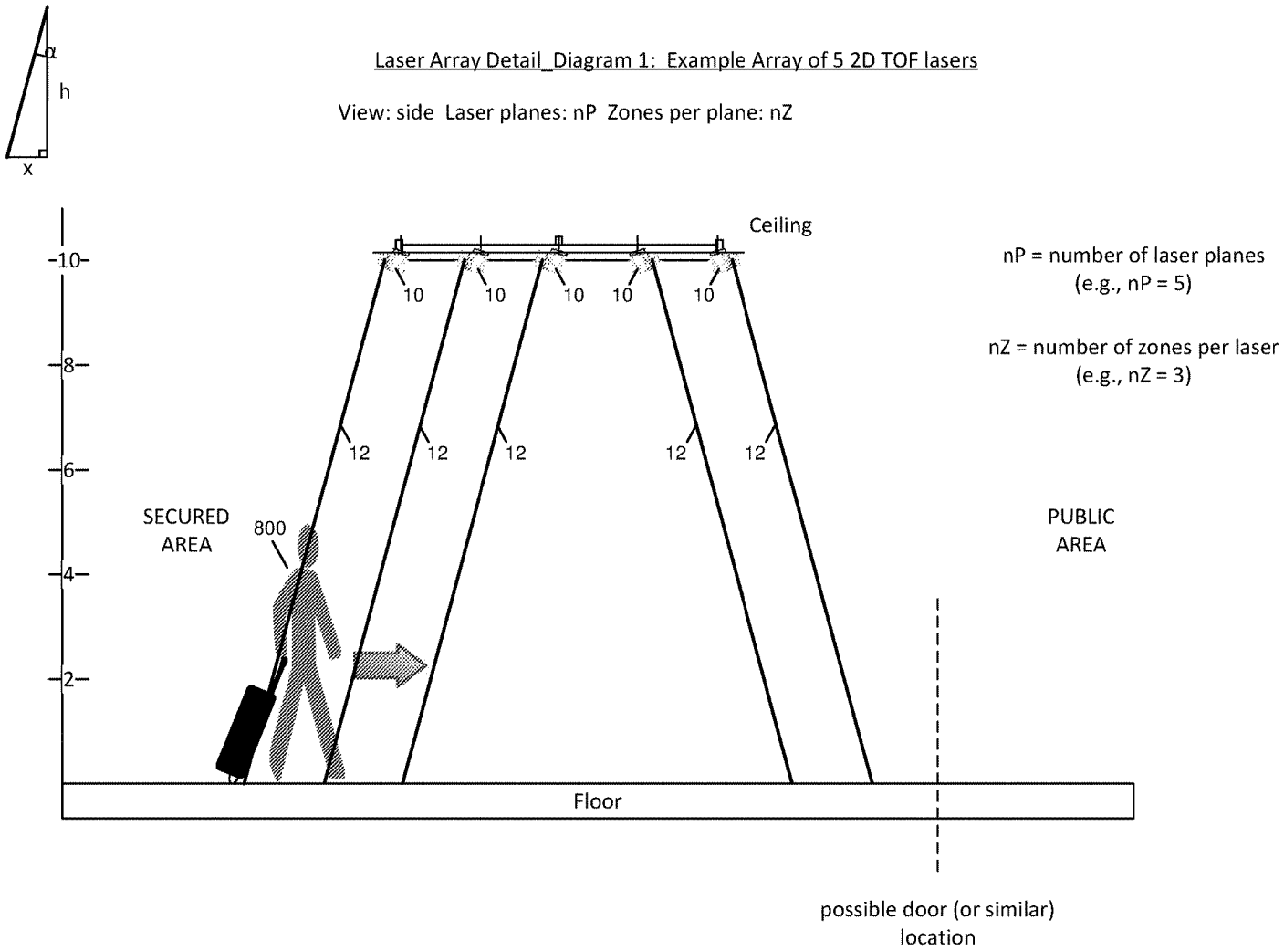
FIG. 14 illustrates one embodiment of a restricted area automated security system.

FIG. 14 illustrates one embodiment of a restricted area automated security system with light shields or planes 12 of individual laser sensors/scanners 10 of a laser array oriented at different non-orthogonal angles. In this example, an individual 800 is illustrated as passing from a secured area through the system to an unsecured (public) area. In one implementation, each laser sensor/scanner 10 creates a laser plane 12, where the number of laser planes for the system is identified as "nP". In addition, as illustrated and described below, each laser plane 12 includes one or more than one detection "zone", with the number of zones (i.e., detection zones) per laser plane identified as "nZ".

In the example of FIG. 14, five lasers are each mounted at an angle of approximately 15 degrees (to vertical) at a height of approximately 10 feet (from the floor). Although the lasers are illustrated and described as having a 15 degree mount angle and 10 foot mount height, the mount angle and/or mount height may vary.

Although examples below are illustrated and described as including five lasers, each with one laser plane thereby resulting in 5P laser planes, the number of lasers and laser planes may vary. In one implementation, the system includes at least three lasers creating at least 3P laser planes. In addition, although examples below are illustrated and described as including three zones per laser plane, thereby resulting in 3Z zones per laser plane, the number of zones (i.e., detection zones) per laser plane may vary (e.g., from one to eight or more).

The system, method, and analytical routines described herein are scalable to use more zones which can provide wider coverage area for larger spaces while retaining the same performance characteristics. In addition, use of additional lasers may enable optional user-dictated areas of interest to be defined (such as a "Warning Zone" or "Change-My-Mind Zone").

Figure 15:
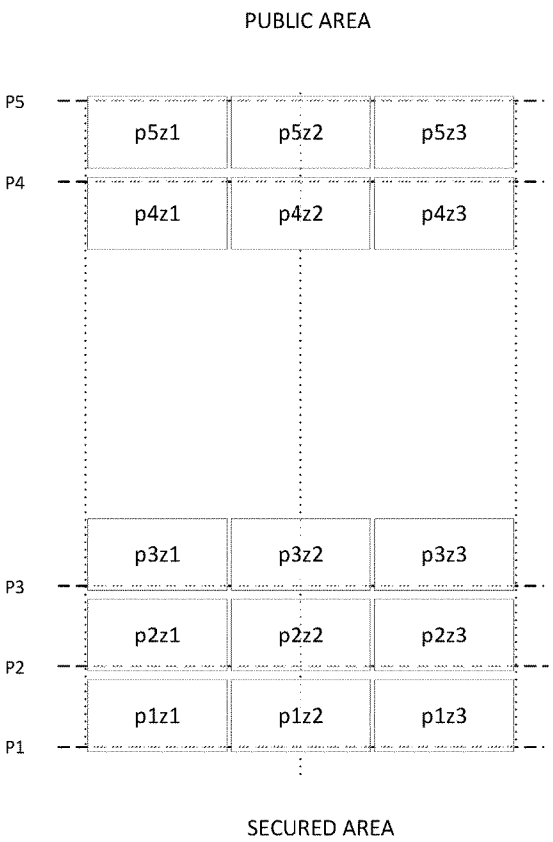
FIG. 15 schematically illustrates one embodiment of a restricted area automated security system.

FIG. 15 provides an example of an overhead illustration of the detection area (e.g., between a secured area and an unsecured (public) area) with the laser planes of the laser sensors/scanners (e.g., P1, P2, P3, P4, P5) indicated by dashed lines in the locations they would appear at the floor level (e.g., 5 lasers, 15 degree angled mount, 10 foot mount height). Additionally, an "Apparent Detection Area" (referred to herein as "ADA") is boxed for each zone (i.e., detection zone) within each laser plane to illustrate the additional detection space that is created by mounting the lasers at an angle. For example, the ADA for the three zones of laser plane P1 are identified as p1z1 (plane1/zone1), p1z2 (plane1/zone2), and p1z3 (plane 1/zone3). The ADA for the three zones of laser planes P2, P3, P4, and P5 are identified similarly.

In one implementation, the ADA is a function of mounting angle, mounting height, and individual height. The illustrated ADA typically would be first entered, for example, by the feet of an individual and last departed by the head of the individual or other trailing item associated with the individual (e.g., pull-behind luggage, cart, wagon). In one implementation, for a shorter individual (e.g., 5 foot 1 inch in height in the illustrated example), the last activation of a zone by the head may occur just before the floor position of the beginning of the next zone. For taller individuals, the detection areas may overlap.

Figure 16:
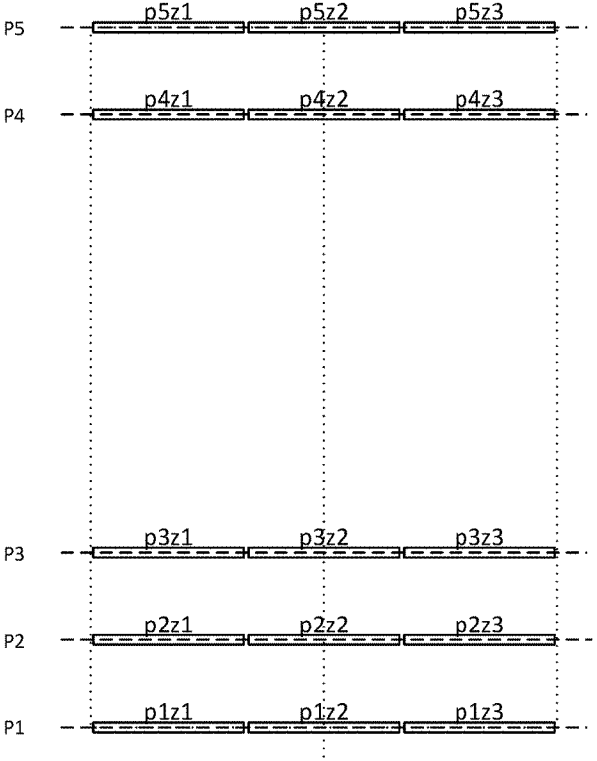
FIG. 16 schematically illustrates one embodiment of a restricted area automated security system.

FIG. 16 provides an example of an overhead illustration of the laser planes of the laser sensors/scanners (e.g., P1, P2, P3, P4, P5) as they would appear at the floor level (e.g., 5 lasers, 15 degree angled mount, 10 foot mount height). In the example of FIG. 16, no entity is within the detection field.

Figure 17:
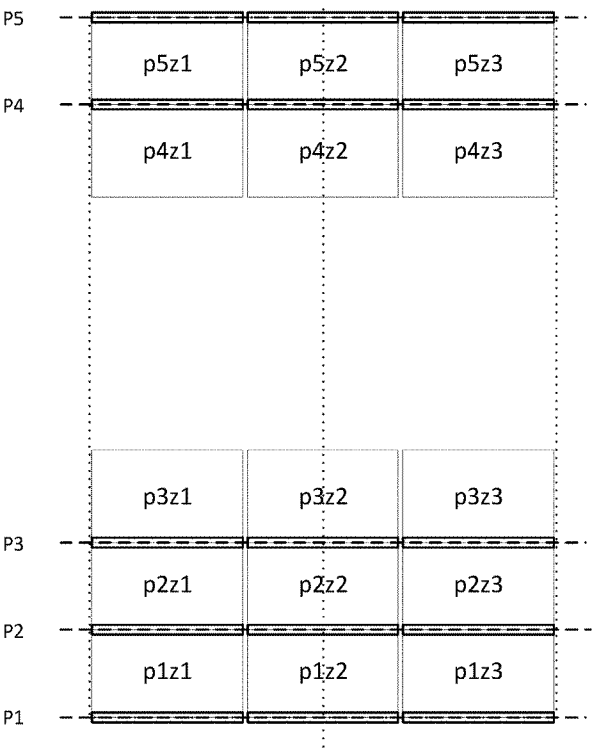
FIG. 17 schematically illustrates one embodiment of a restricted area automated security system.

FIG. 17 provides an example of an overhead illustration of the laser planes of the laser sensors/scanners (e.g., P1, P2, P3, P4, P5) as they would appear at the floor level (e.g., 5 lasers, 15 degree angled mount, 10 foot mount height). In the example of FIG. 17, an increased ADA is illustrated as would effectively be observable for a taller individual (e.g., 6 foot in height). As illustrated, in one implementation, the detection zones of one laser plane overlap the detection zones of an adjacent laser plane. For example, the detection zones of laser plane P1 overlap the detection zones of laser plane P2 (i.e., p1z1 overlaps p2z1, p1z2 overlaps p2z2, p1z3 overlaps p2z3).

Figure 18:
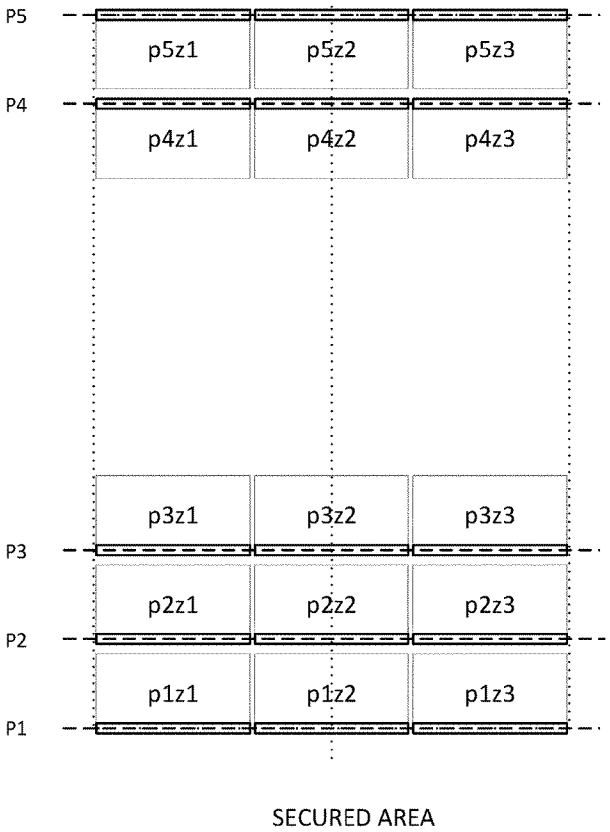
FIG. 18 schematically illustrates one embodiment of a restricted area automated security system.
Figure 19:
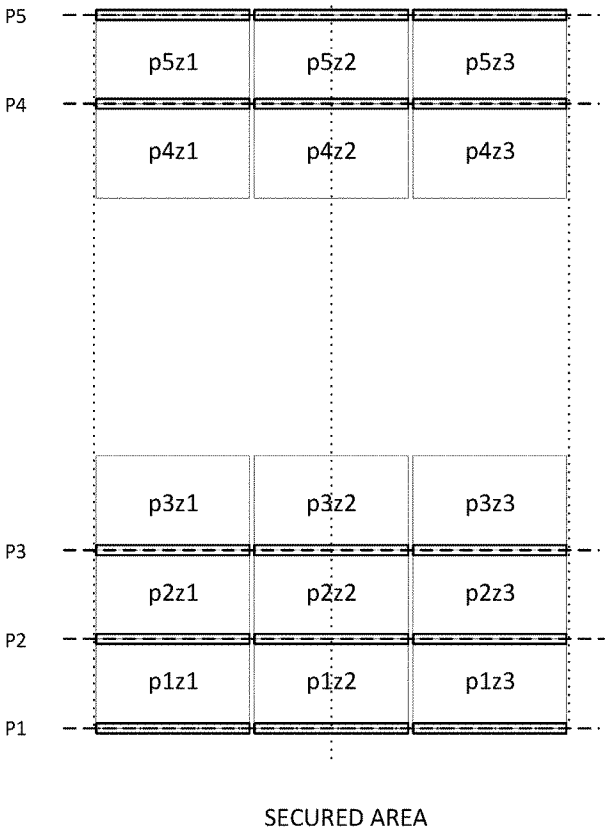
FIG. 19 schematically illustrates one embodiment of a restricted area automated security system.

As a comparison, FIGS. 18 and 19 provide example overhead illustrations of the laser planes of the laser sensors/scanners (e.g., P1, P2, P3, P4, P5), and the resulting ADAs of the zones (i.e., detection zones), as they would appear at the floor level (e.g., 5 lasers, 15 degree angled mount, 10 foot mount height), for individuals of different height. For example, FIG. 18 illustrates the ADA of the zones for a shorter individual (e.g., 5 foot 1 inch in height in the illustrated example), and FIG. 19 illustrates the ADA of the zones for a taller individual (e.g., 6 foot in height in the illustrated example). The increase in the apparent detection area per zone (and resulting overlap of zones between adjacent laser planes) for individuals of different height is due to the angle of the laser planes.

Figures 20A, 20B:
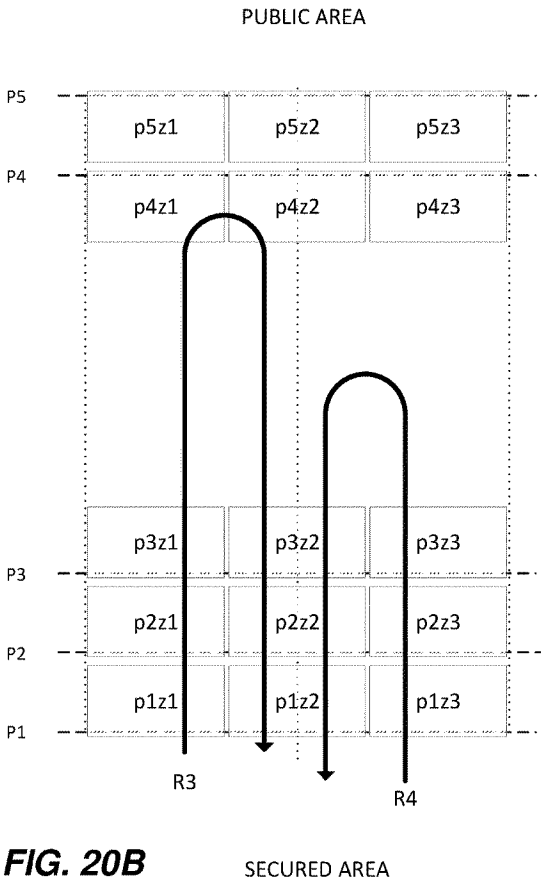
FIGS. 20A and 20B schematically illustrate one embodiment of a restricted area automated security system and method detecting example events.

FIGS. 20A and 20B provide example overhead illustrations of the laser planes of the laser sensors/scanners (e.g., P1, P2, P3, P4, P5), and the resulting ADAs of the zones (i.e., detection zones), as they would appear at the floor level (e.g., 5 lasers, 15 degree angled mount, 10 foot mount height), for example events. For example, FIG. 20A includes illustration of "Shallow U-turn Forgiveness" and FIG. 20B includes illustration of "Deeper U-turn Alarming" as examples of events that may (or may not) be of interest to an end user in defining, for example, examples of end user "Policy Preferences" as illustrated and described above with reference to FIG. 7. In one implementation, an end user may define U-turn event R1 to result in no alarm and/or action while U-turn event R2 may trigger an alarm and/or action. In one implementation, an end user may define U-turn event R1 to provoke a "warning" while U-turn events R2, R3, or R4 trigger an alarm and/or action.

Figure 21A:
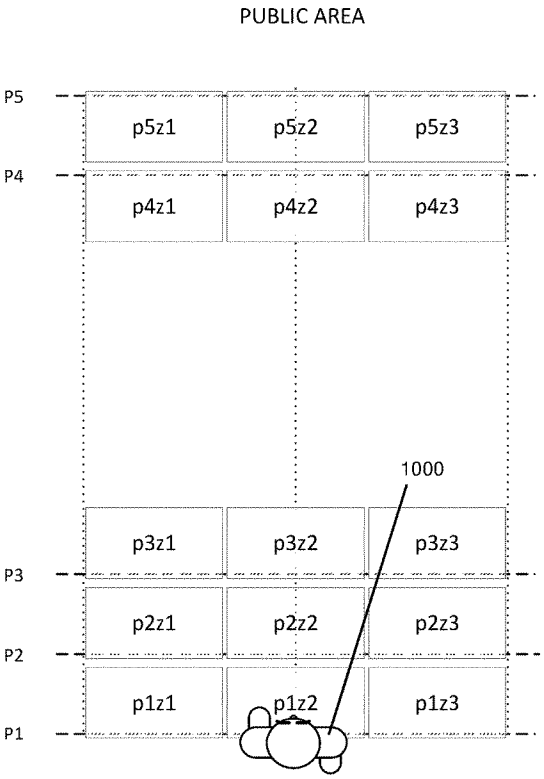
FIGS. 21A and 21B schematically illustrate one embodiment of a restricted area automated security system and method detecting example events.
Figure 21B:
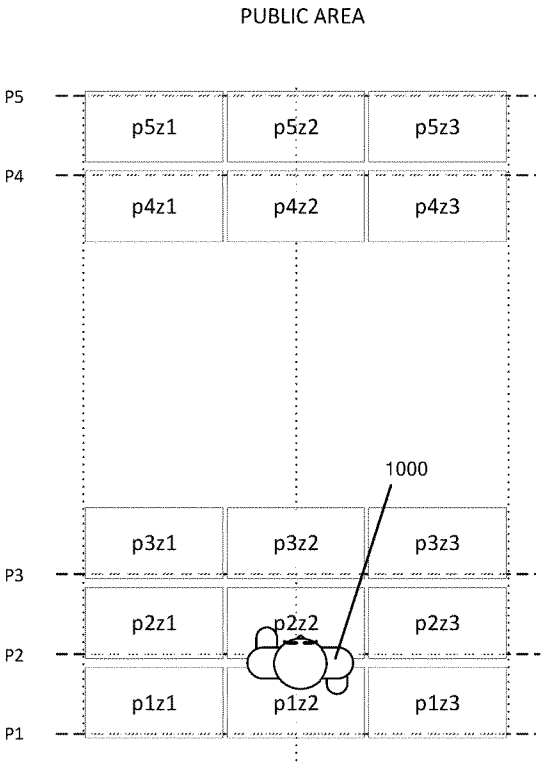

FIGS. 21A and 21B provide example overhead illustrations of the laser planes of the laser sensors/scanners (e.g., P1, P2, P3, P4, P5), and the resulting ADAs of the zones (i.e., detection zones), as they would appear at the floor level (e.g., 5 lasers, 15 degree angled mount, 10 foot mount height), with corresponding laser array data as an individual 1000 moves into the detection area. In one embodiment, the laser sensors/scanners of the system use digital outputs as a method of telemetry to provide information of the field conditions within the defined measurement criteria. In one implementation, the light shields or planes of the fields of view of the laser sensors/scanners may be configured to define the above-referenced detection "zones", whereby the zones may be monitored and linked to output bits which may be set true (1) for an intrusion into a respective zone and remain false (0) for an empty zone. Such data represents an example of "Laser Data" and "Laser Array Data" as illustrated and described above with reference to FIGS. 4, 6, and 7.

Figure 22A:
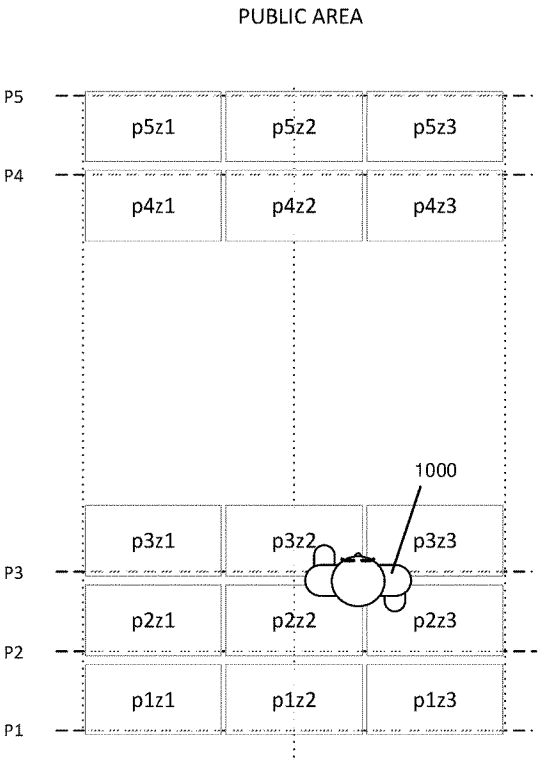
FIGS. 22A and 22B schematically illustrate one embodiment of a restricted area automated security system and method detecting example events.
Figure 22B:
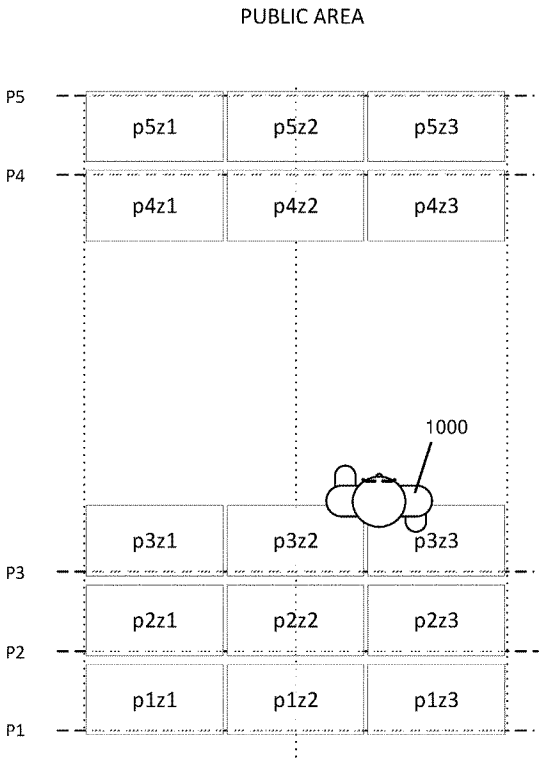

FIGS. 22A and 22B provide example overhead illustrations of the laser planes of the laser sensors/scanners (e.g., P1, P2, P3, P4, P5), and the resulting ADAs of the zones (i.e., detection zones), as they would appear at the floor level (e.g., 5 lasers, 15 degree angled mount, 10 foot mount height), with corresponding laser array data as an individual 1000 moves through the detection area. In the illustrated examples, output data of the laser array indicates intrusion (movement) in more than one zone simultaneously. For example, output data of Laser 3 (i.e., 0 1 1) indicates simultaneous intrusion (movement) in zones 2 and 3 of laser plane P3 (i.e., p3z2, p3z3).

Figure 23B:
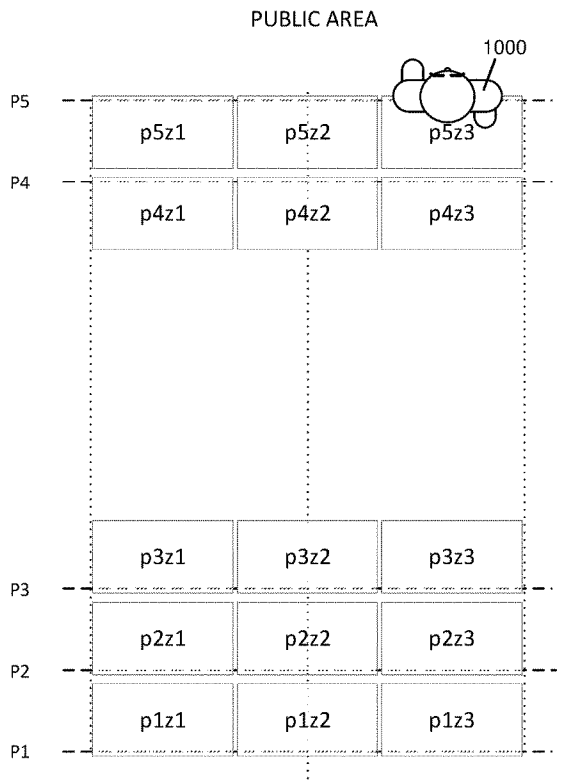
FIGS. 23A and 23B schematically illustrate one embodiment of a restricted area automated security system and method detecting example events.
Figure 23A:
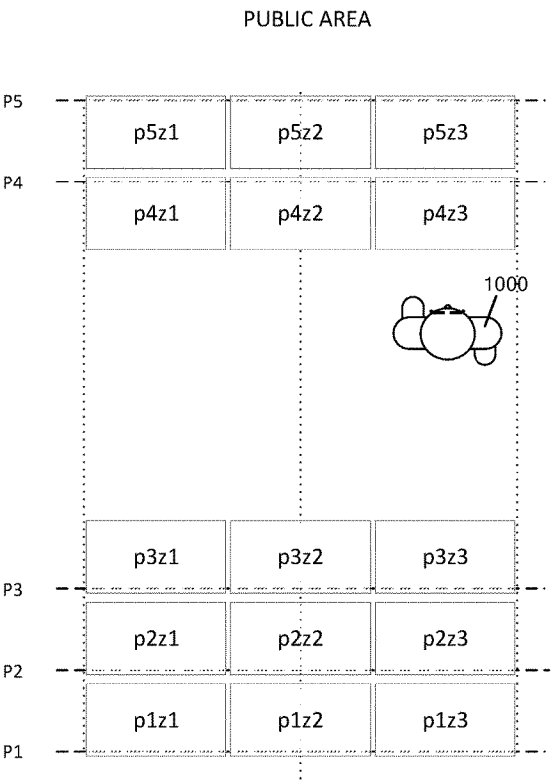

FIGS. 23A and 23B provide example overhead illustrations of the laser planes of the laser sensors/scanners (e.g., P1, P2, P3, P4, P5), and the resulting ADAs of the zones (i.e., detection zones), as they would appear at the floor level (e.g., 5 lasers, 15 degree angled mount, 10 foot mount height), with corresponding laser array data as an individual 1000 moves through the detection area. For example, the laser array output data is illustrated for an individual 1000 in a central gap between the laser planes (i.e., no detection), and for the individual 1000 as they exit the system.

Figure 24:
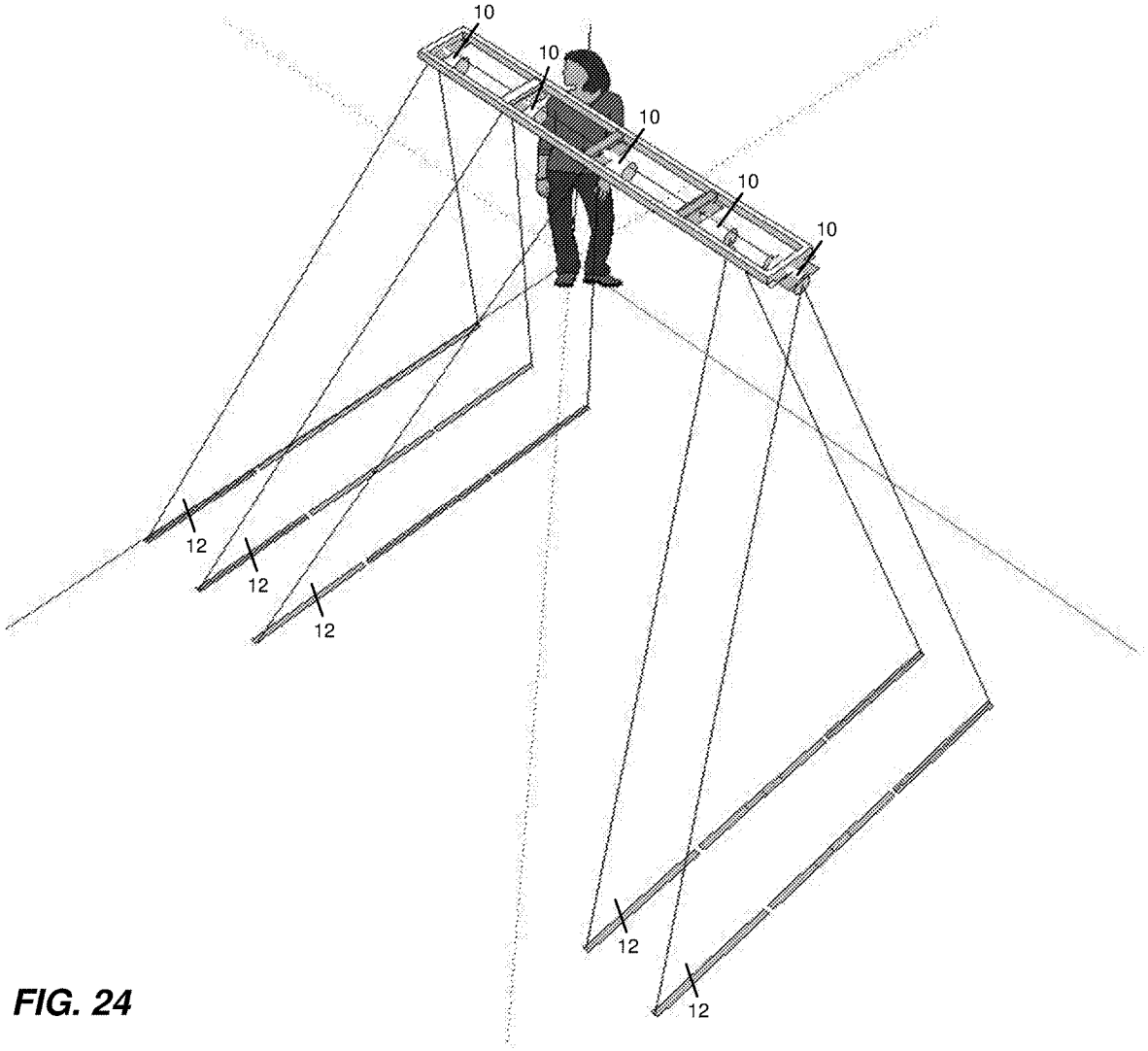
FIGS. 24 and 25 illustrate one embodiment of a restricted area automated security system.
Figure 25:
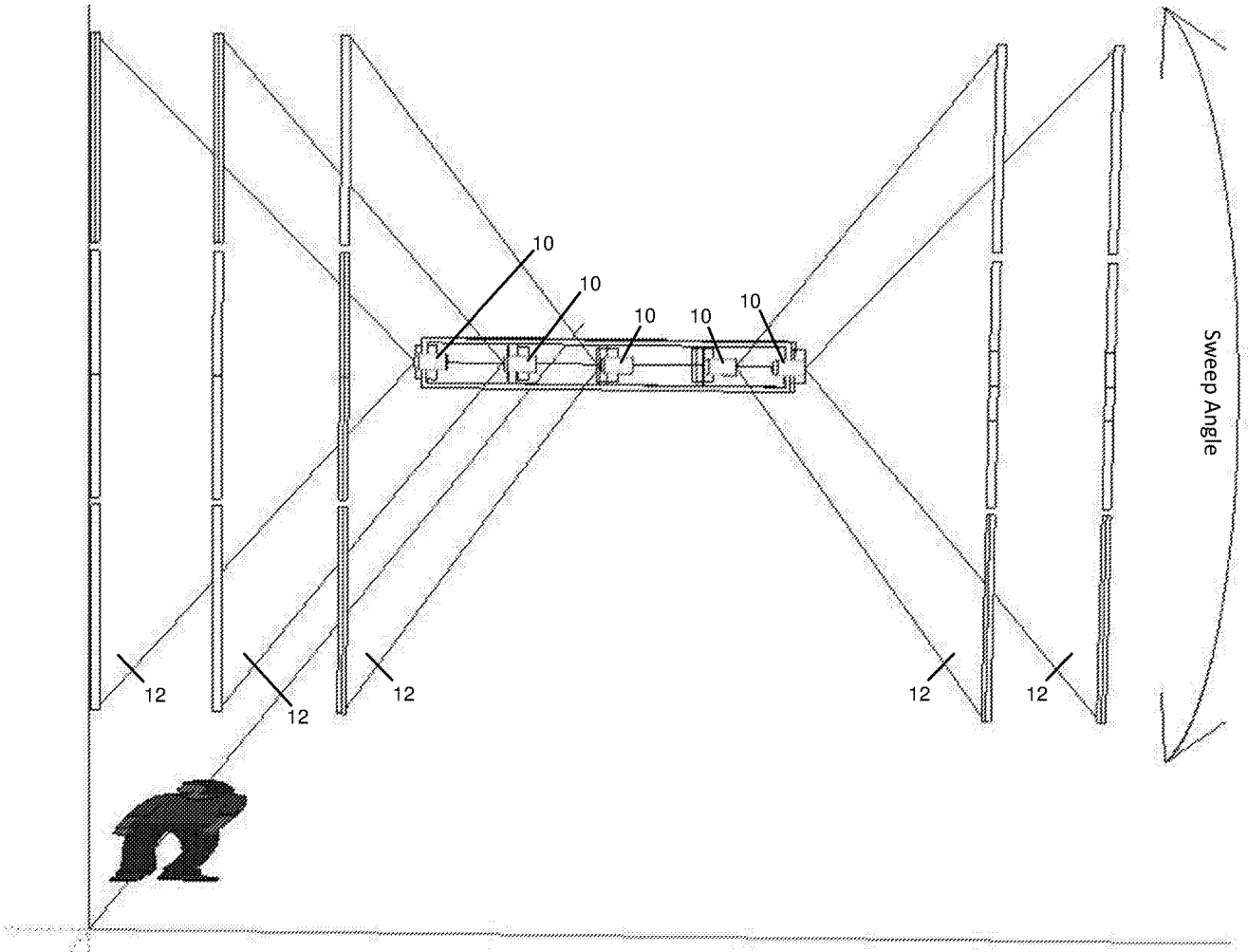

FIGS. 24 and 25 illustrate one embodiment of an installation of the restricted area automated security system. For example, FIG. 24 provides a perspective view of the installation from above (e.g., from a public (unsecured) side looking toward a secured side) and depicts an area of impingement of the light shields or planes 12 of the laser sensors/scanners 10 on the floor (with an empty system), and FIG. 25 provides a perspective view of the installation from below. The acute triangles illustrated as emanating from each laser sensor/scanner represents a subset of an available total angular range (sweep angle) of the laser sensors/scanners 10. In one embodiment, the sweep angle of each laser may be 180 degrees or less. In one embodiment, the sweep angle of each laser may be up to 270 degrees.

In the illustrated embodiment of FIGS. 24 and 25, five lasers are each mounted at an angle of approximately 15 degrees (to vertical) at a height of approximately 10 feet (from the floor). In one implementation, the laser sensors/scanners 10 each have a sweep angle of approximately 270 degrees, and the depicted installation provides detection for an area that is approximately 8 feet wide by approximately 12 feet long by approximately 10 feet high, with travel occurring along the 12 foot dimension. Thus, by combining multiple laser sensors/scanners, the system and method is able to monitor a 3D space.

Figure 26:
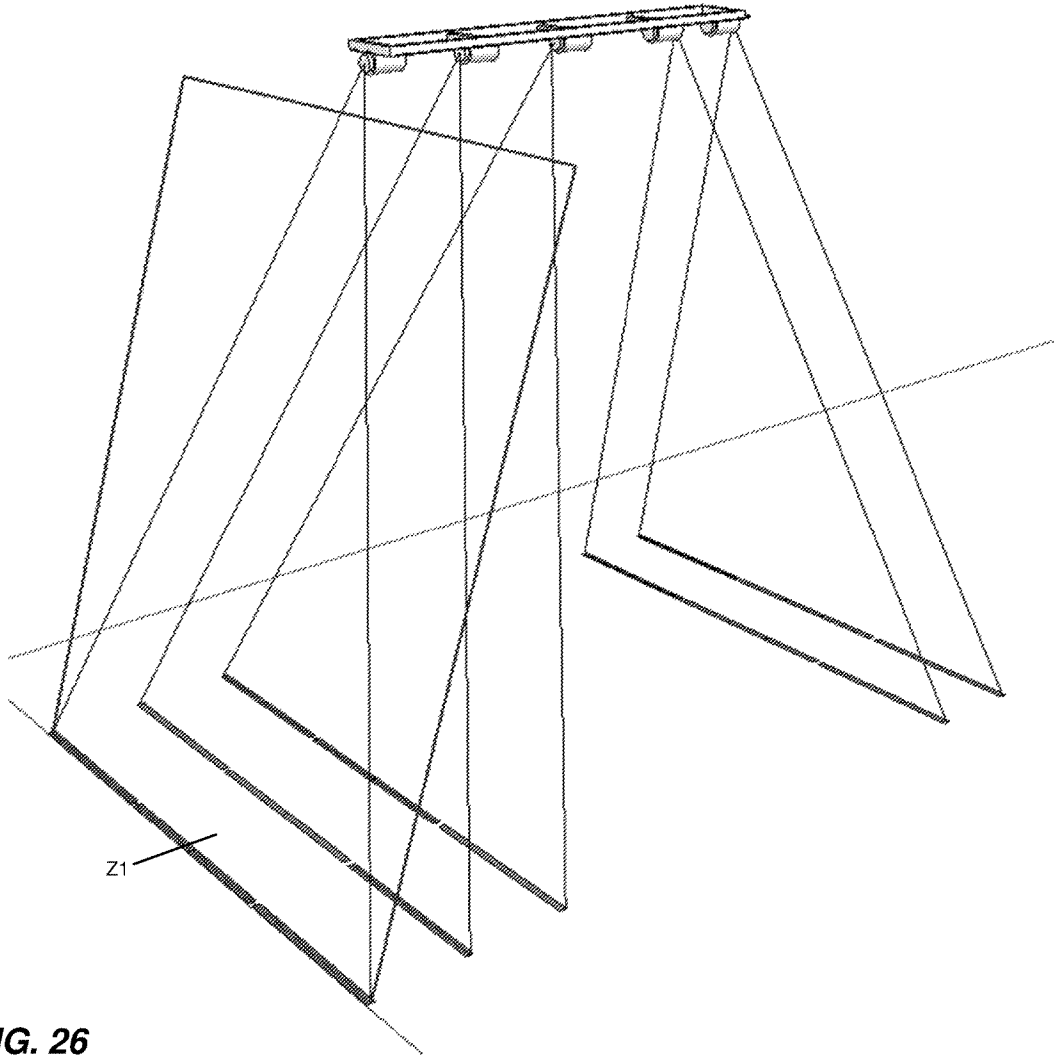
FIG. 26 illustrates one embodiment of a restricted area automated security system.
Figure 27:
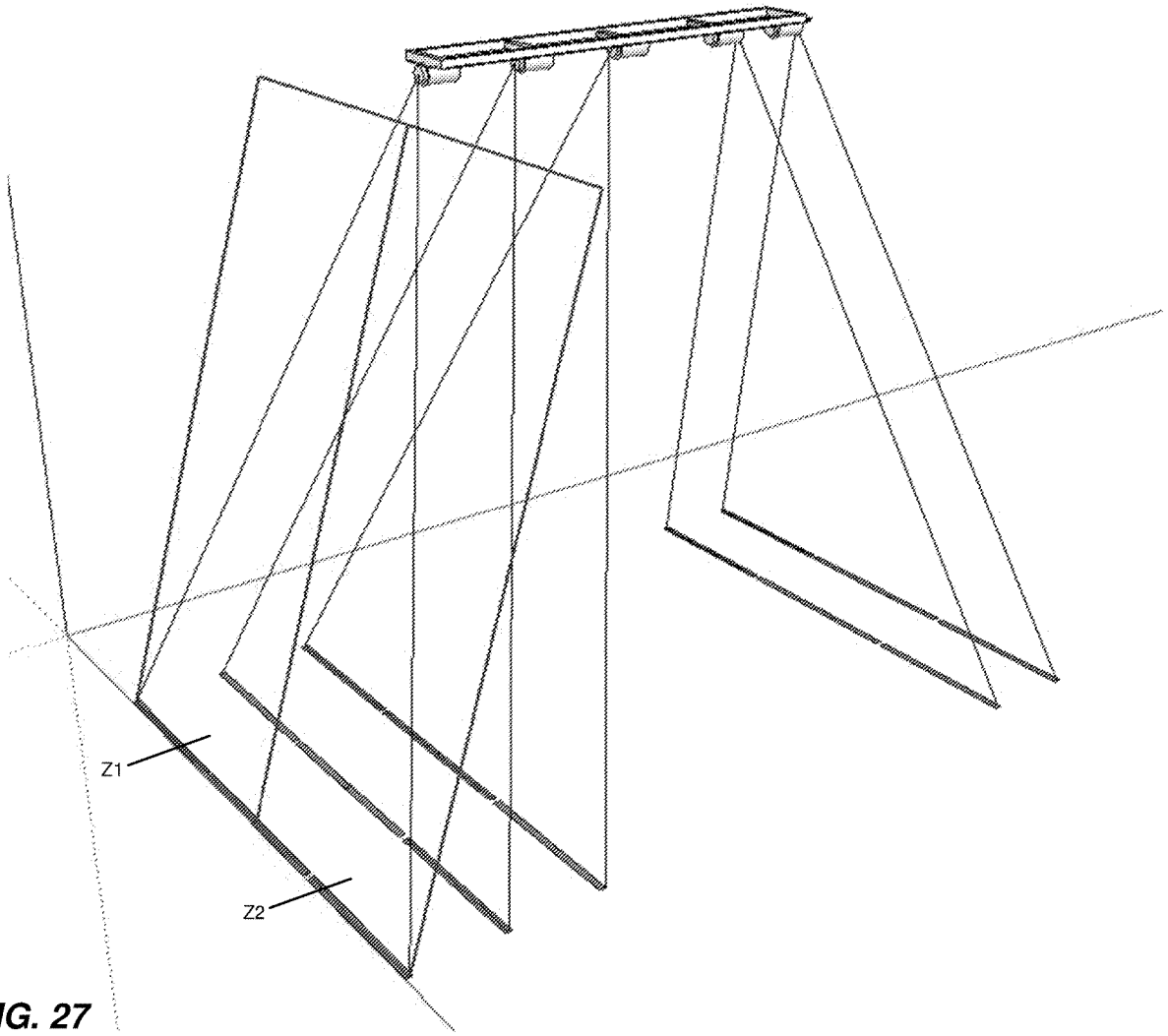
FIG. 27 illustrates one embodiment of a restricted area automated security system.
Figure 28:
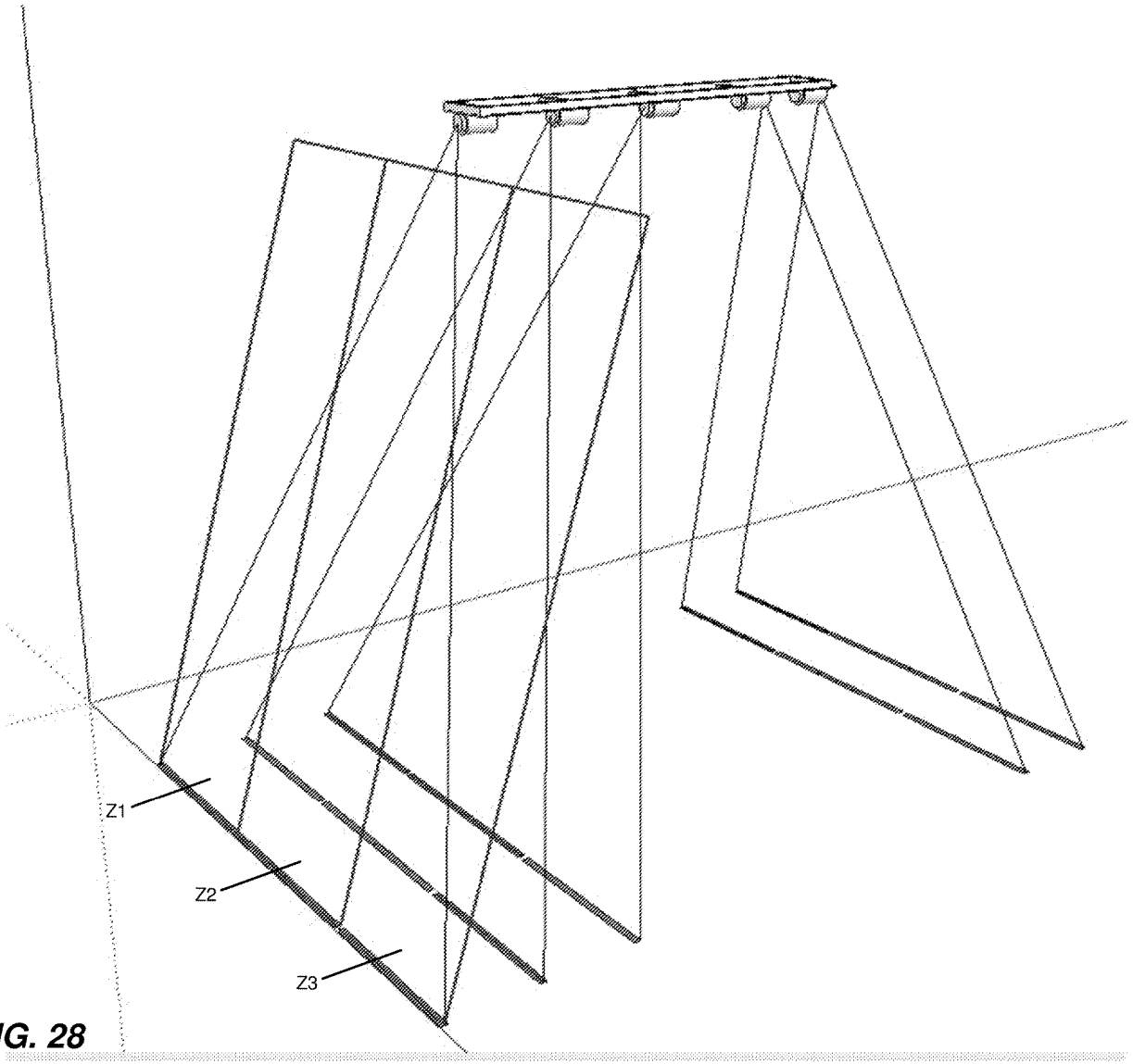
FIG. 28 illustrates one embodiment of a restricted area automated security system.

In one embodiment, the light shields or planes 12 of the fields of view of each of the laser sensors/scanners 10 may be configured to define one or more than one detection "zone". In one implementation, as illustrated for example in FIG. 26, one zone (Z1) is defined for each laser plane. In one implementation, as illustrated for example in FIG. 27, two zones (Z1, Z2) are defined for each laser plane. In one implementation, as illustrated for example in FIG. 28, three zones (Z1, Z2, Z3) are defined for each laser plane. Although illustrated as being rectangular in shape, the zones may be defined to have other polygonal shapes. Although illustrated as visible solid lines, the projected planes and defined zones of the laser sensors/scanners, are, as noted above, invisible to the human eye.

Figure 29:
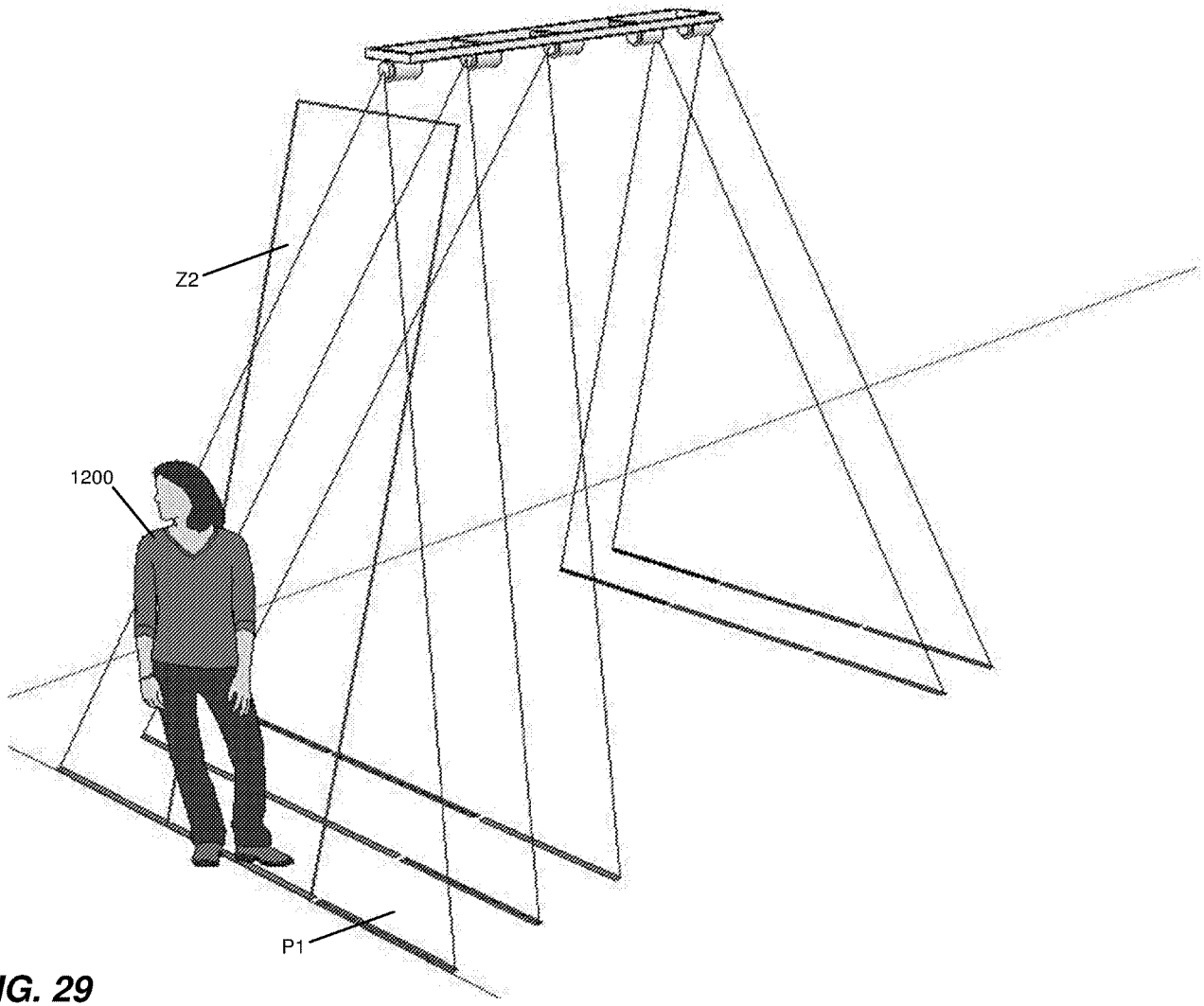
FIGS. 29 and 30 illustrate one embodiment of a restricted area automated security system.
Figure 30:
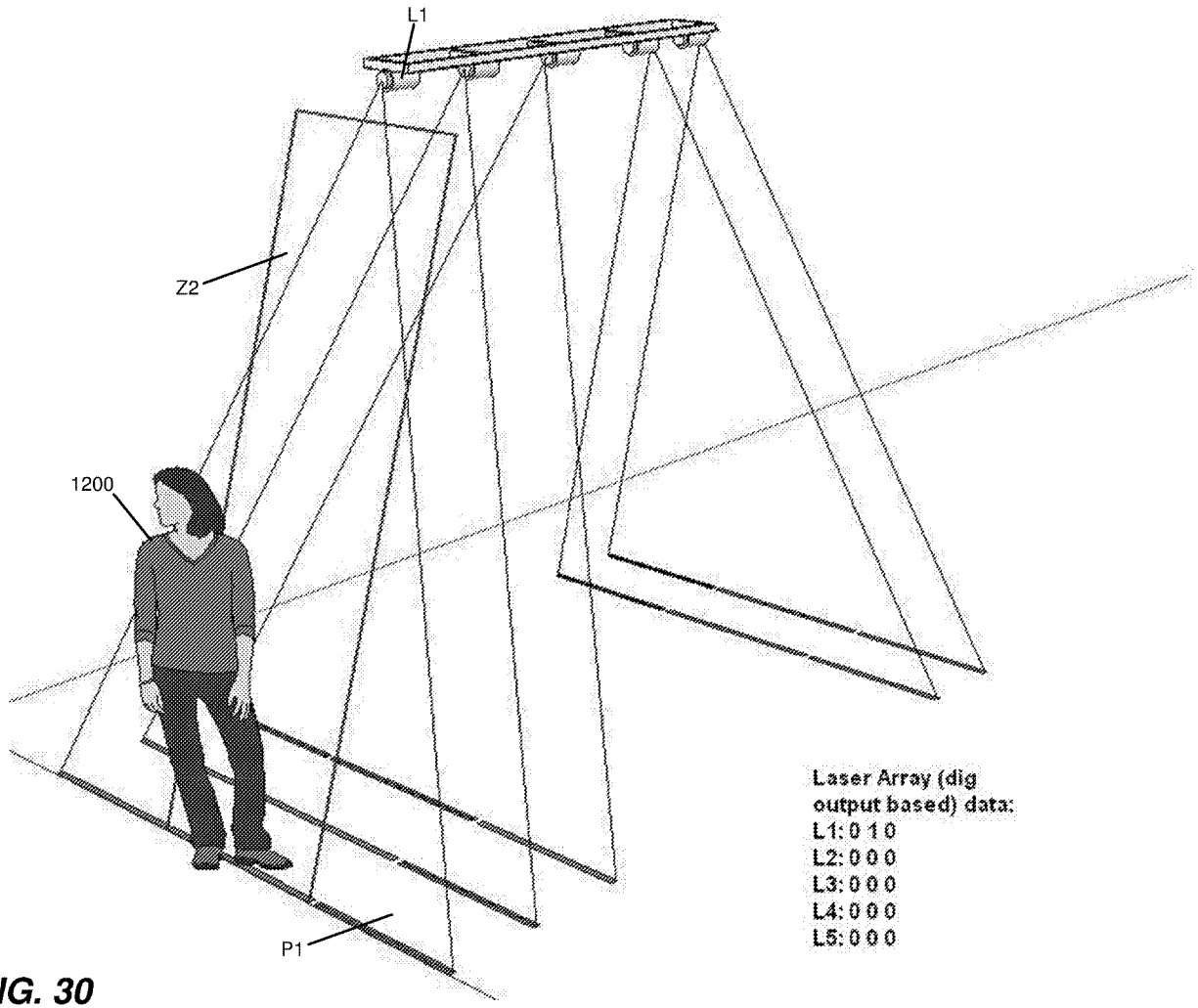

FIGS. 29 and 30 illustrate one embodiment of the restricted area automated security system with intrusion of one laser plane. For example, as illustrated in FIG. 29, laser plane 1 (P1) is breached by an individual 1200, specifically at zone 2 (Z2) (with the illustrated rectangle showing approximately the polygon that has been defined as zone 2 for laser plane 1). As such, and as illustrated in FIG. 30, output data for laser 1 (L1) indicates intrusion (movement) in zone 2 (i.e., 0 1 0).

Figure 31:
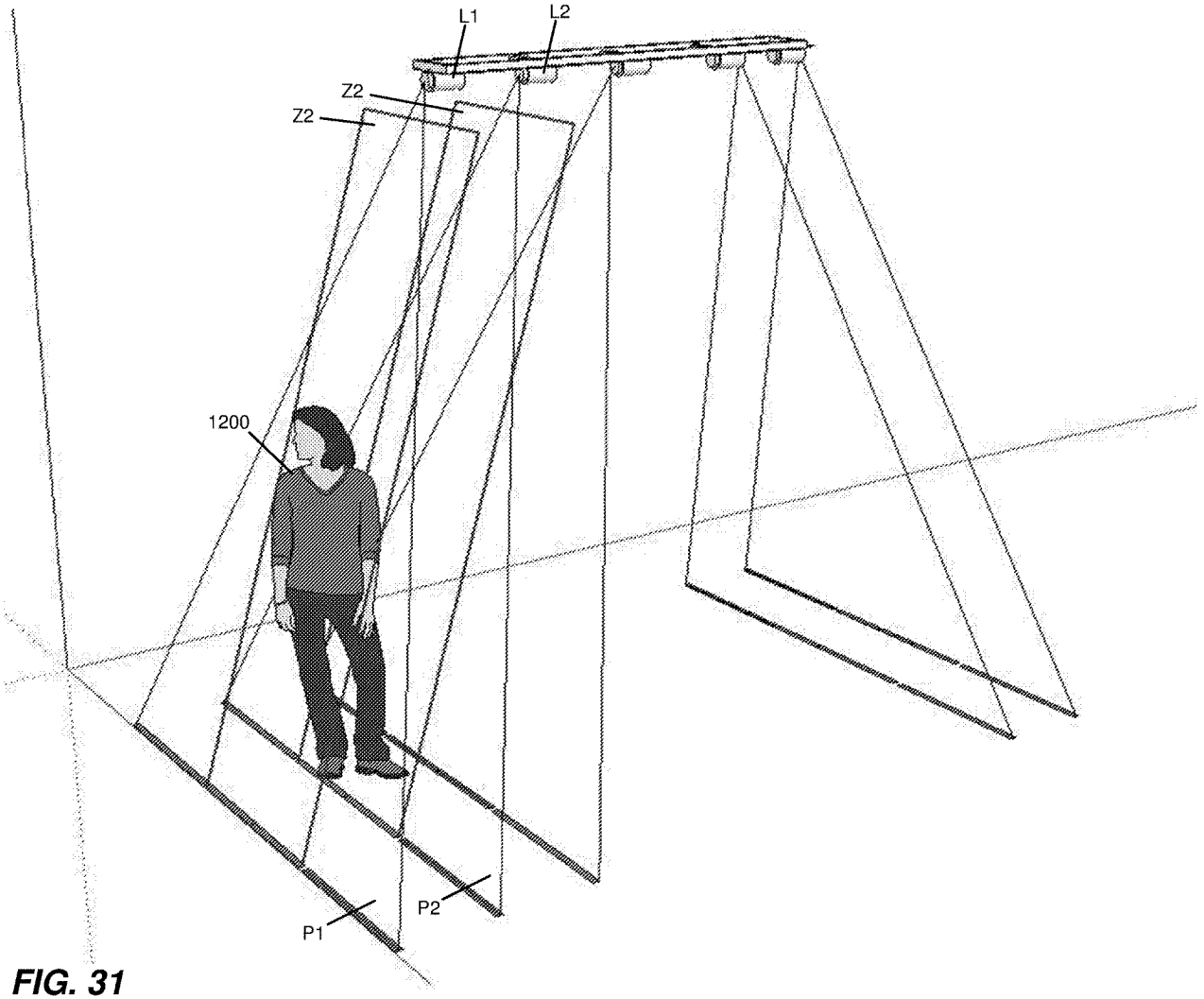
FIGS. 31, 32, and 33 illustrate one embodiment of a restricted area automated security system.
Figure 32:
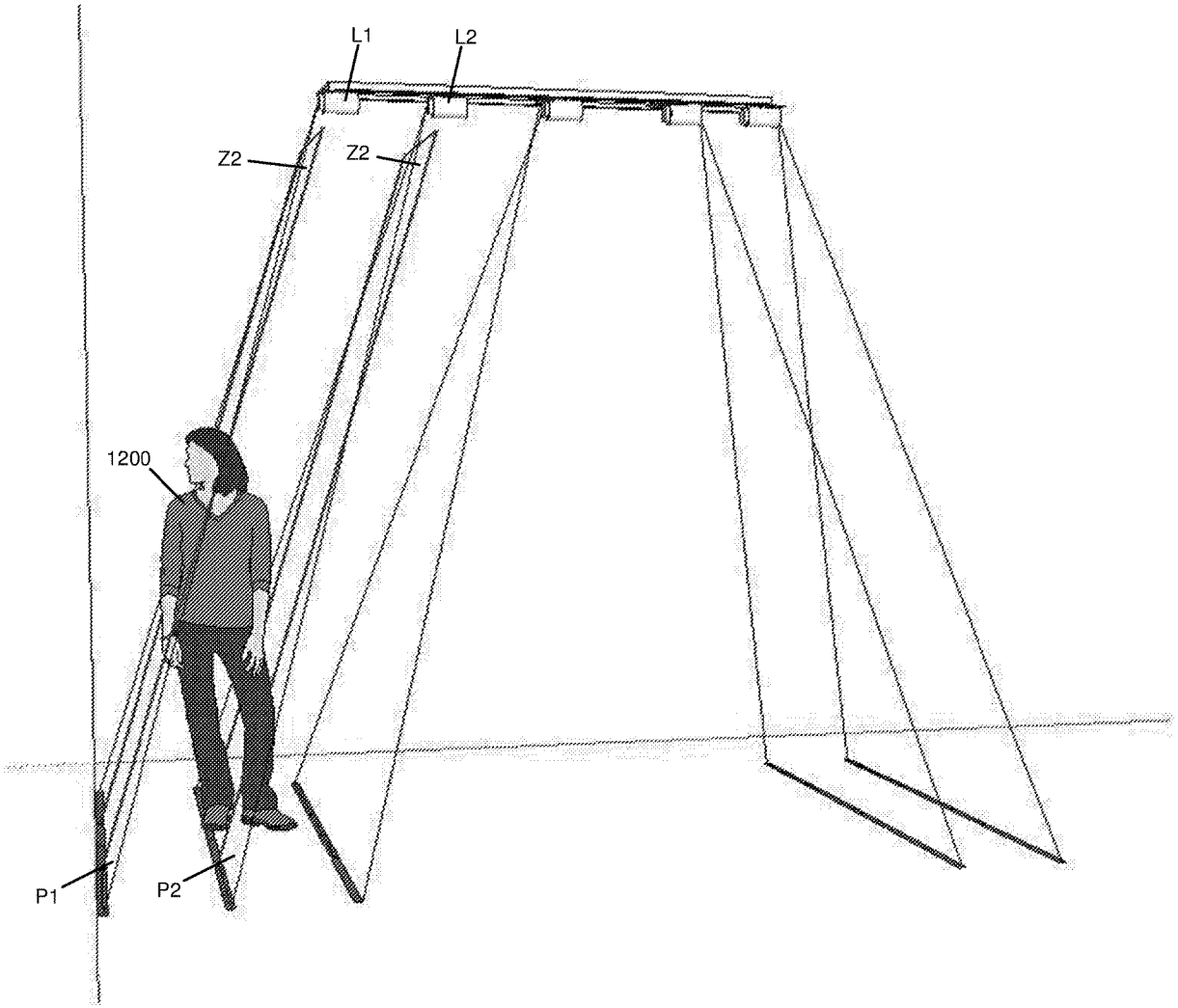
Figure 33:
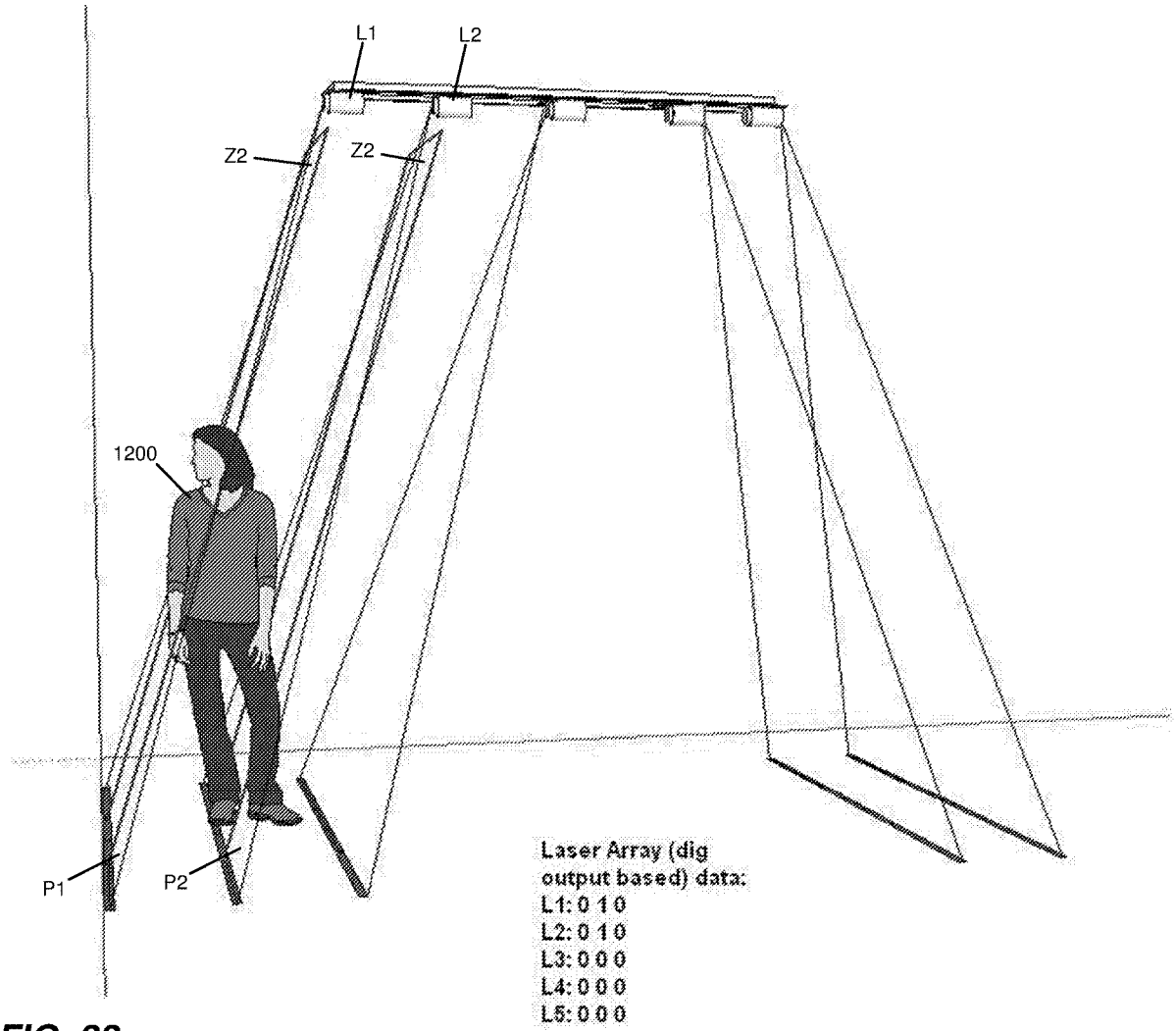

FIGS. 31, 32, and 33 (with the perspective of FIGS. 32 and 33 being rotated relative to FIG. 31 to better illustrate the position of the individual 1200 relative to the planes) illustrate one embodiment of the restricted area automated security system with intrusion of two laser planes. For example, as illustrated in FIGS. 31 and 32, laser planes 1 and 2 (P1, P2) are breached by the individual 1200, specifically at zone 2 (Z2) of each (with the illustrated rectangles showing approximately the polygons that have been defined as zone 2 for laser planes 1 and 2). As such, and as illustrated in FIG. 33, output data for laser 1 (L1) and laser 2 (L2) indicates intrusion (movement) in zone 2 of each (i.e., 0 1 0, 0 1 0).

Figure 34B:
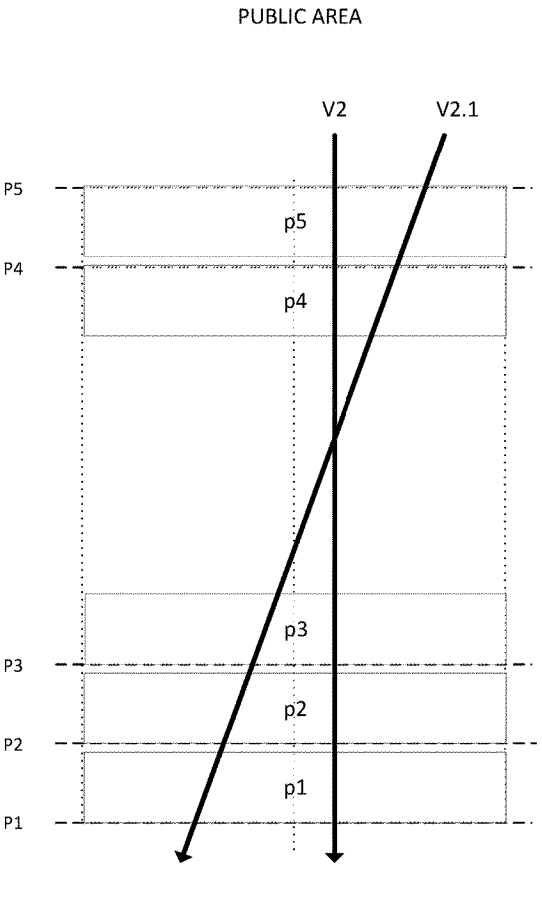
FIGS. 34A and 34B schematically illustrate one embodiment of a restricted area automated security system and method detecting example events.
Figure 34A:
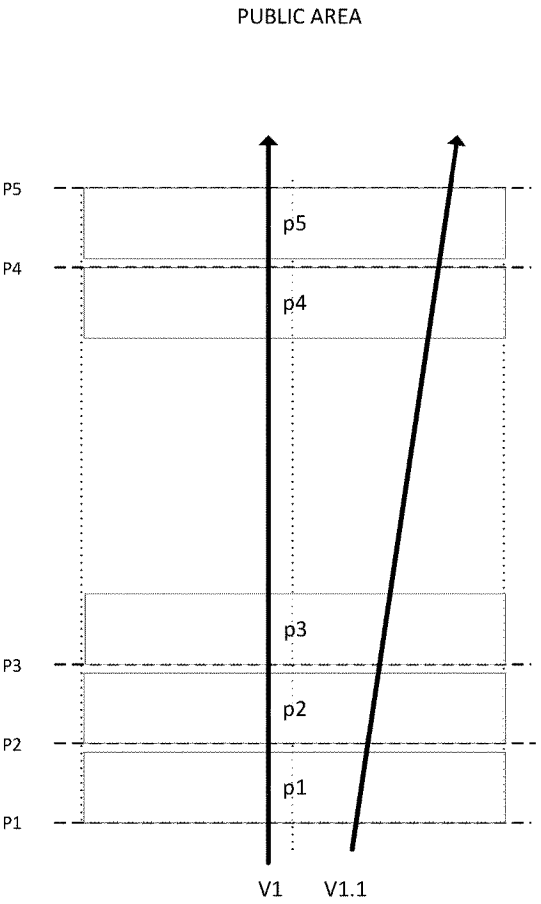

FIGS. 34A and 34B provide example overhead illustrations of the laser planes of the laser sensors/scanners (e.g., P1, P2, P3, P4, P5), and the resulting ADAs (apparent detection areas) of the planes (with one zone), as they would appear at the floor level (e.g., 5 lasers, 15 degree angled mount, 10 foot mount height), for example events. For example, FIGS. 34A and 34B include illustration of a "Sequential Plane Authorization" (referred to herein as "SPA") routine as an example of an "Analytical Logic Routine" as illustrated and described above with reference to FIGS. 2, 3, and 7. In one implementation, the SPA routine considers an order or sequence in which plane breaks occur (e.g., plane 1, then plane 2, then plane 3, then plane 4, then plane 5) (e.g., plane 5, then plane 4, then plane 3, then plane 2, then plane 1). As such, the SPA routine detects, for example, travel or movement of an individual (e.g., between a secured area and an unsecured (public) area) by routes such as V1 and V1.1 which are allowed and do not trigger alarm and/or action, and routes such as V2 and V2.1 which are disallowed and do trigger an alarm and/or action. In one implementation, regardless of whether travel or movement of an individual is solo or with another, routes such as V2 and V2.1 are disallowed and trigger an alarm and/or action.

Figure 35B:
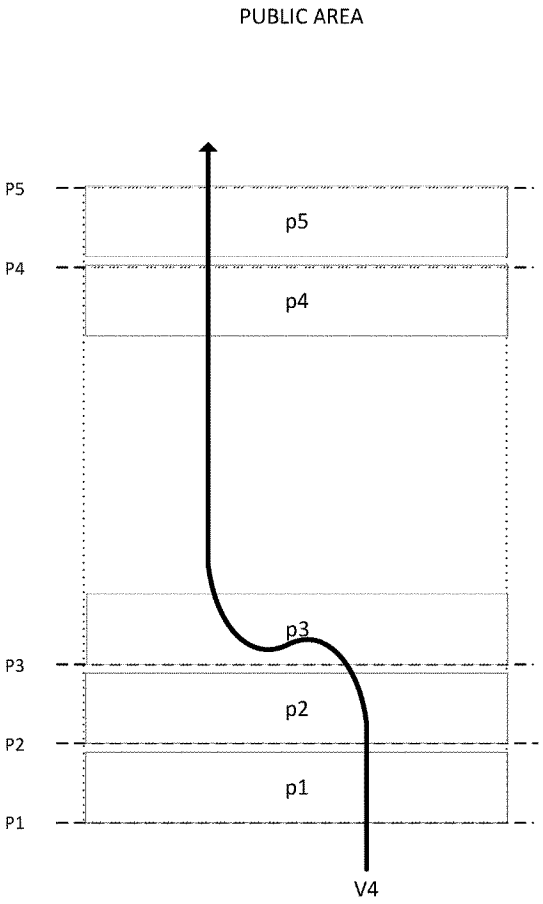
FIGS. 35A and 35B schematically illustrate one embodiment of a restricted area automated security system and method detecting example events.
Figure 35A:
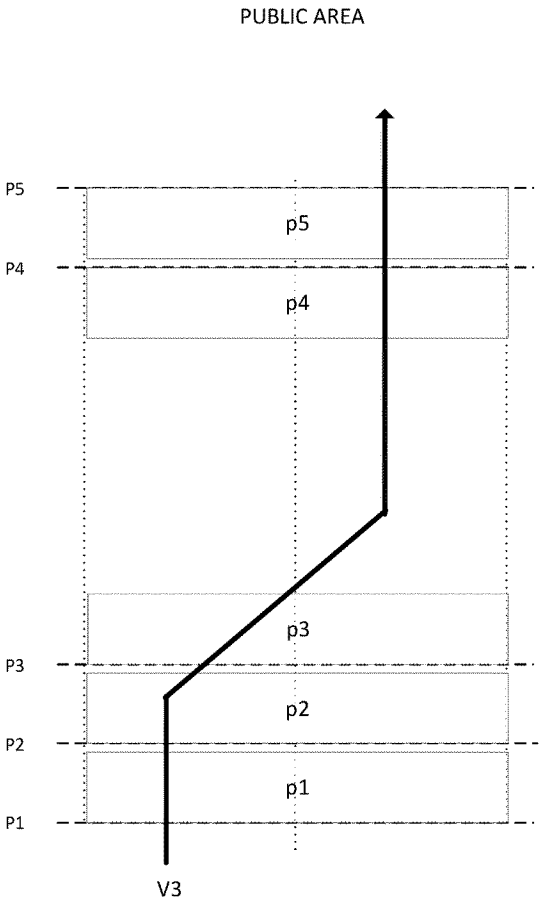

FIGS. 35A and 35B provide example overhead illustrations of the laser planes of the laser sensors/scanners (e.g., P1, P2, P3, P4, P5), and the resulting ADAs (apparent detection areas) of the planes (with one zone), as they would appear at the floor level (e.g., 5 lasers, 15 degree angled mount, 10 foot mount height), for example events. For example, FIGS. 35A and 35B include illustration of the SPA routine as an example of an "Analytical Logic Routine" as illustrated and described above with reference to FIGS. 2, 3, and 7. In one implementation, the SPA routine allows for a certain degree or amount of backtracking (or side-travel) without an alarm and/or action being initiated. For example, in one implementation, all zones within a plane are treated as one zone such that "zone-to-zone" movements may be ignored (e.g., zone 1 to zone 2) and only "plane-to-plane" transitions (e.g., P1 to P2) are analyzed. As such, movements by routes such as V3 and V4, whether "robot-like" (e.g., V3) or more "organic" or natural (e.g., V4), are treated equally and are both allowed because their overall direction of motion remains toward, for example, the unsecured (public) area.

In one implementation, the SPA routine allows for short-term backtracking, as illustrated for example in route V4 of FIG. 35B near the P2/P3 interface, such that an alarm and/or action will not be triggered. In one example, this allowance by the SPA routine remains true if entry and re-entry of a plane are separated by, for example, fractions of a second. For example, if the overall route V4 were shifted downward slightly from that illustrated in FIG. 35B such that P3 would be entered (from P2), exited (to P2), and entered again (from P2) (i.e., entered twice), an alarm and/or action will not be triggered if the departure of P3 and re-entry of P3 are separated by, for example, fractions of a second. Such forgiveness by the SPA routine allows for secondary movement (or motions) during primary movement (or travel), where a direction of the secondary movement (or motion) may be opposite a direction of the primary movement (or travel). For example, in one implementation, the SPA routine allows for movement (or motions) of an individual while walking or running, such as swinging their arm(s) and/or leg(s), sweeping their phone in an arc up to their ear, shifting their baggage on their shoulder, etc.

In one implementation, the SPA routine incorporates "debouncing." For example, in addition to hardware debouncing which may be available and active from the laser sensors/scanners themselves, the SPA routine includes software debouncing with decisions that consider the timing of anticipated dynamics within the system. For example, in one implementation, in addition to single datum debouncing (which considers the state of a datum itself and waits a certain amount of time for it to "settle"), debouncing of the SPA routine considers and/or uses information from elsewhere in the system (such as the state(s) of adjacent plane(s)) to make contextually reasonable decisions (e.g., allowing short-term backtracking).

Figure 36A:
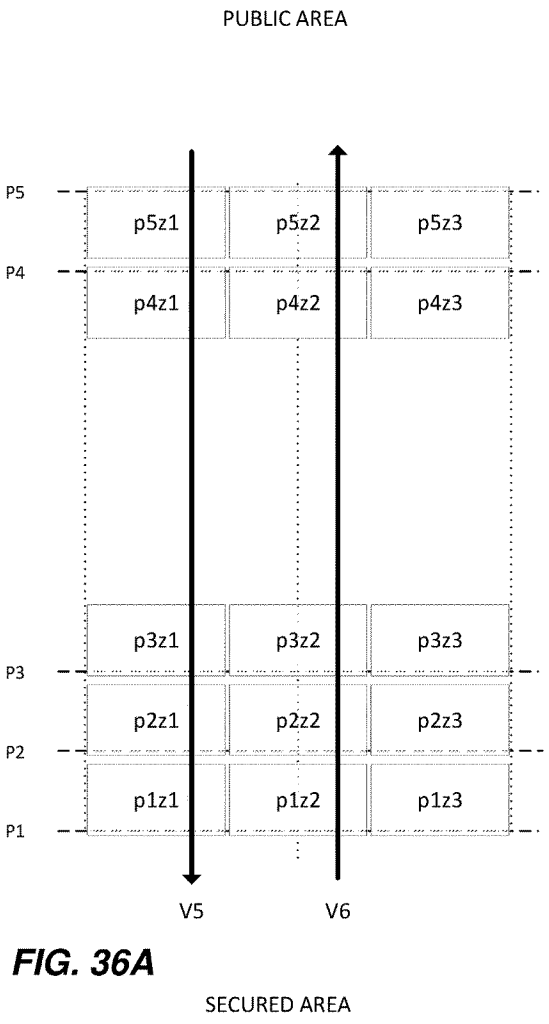
FIGS. 36A and 36B schematically illustrate one embodiment of a restricted area automated security system and method detecting example events.
Figure 36B:
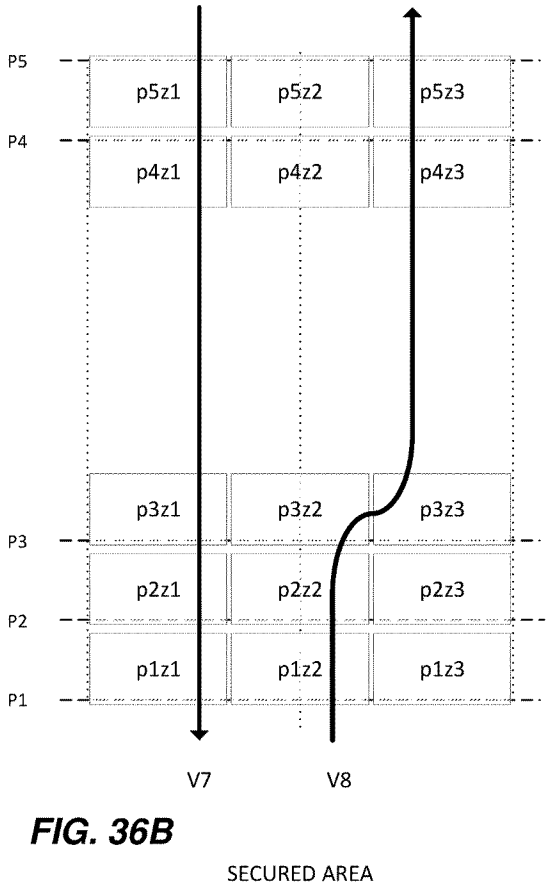

FIGS. 36A and 36B provide example overhead illustrations of the laser planes of the laser sensors/scanners (e.g., P1, P2, P3, P4, P5), and the resulting ADAs (apparent detection areas) of the zones (three per plane), as they would appear at the floor level (e.g., 5 lasers, 15 degree angled mount, 10 foot mount height), for example events. For example, FIGS. 36A and 36B include illustration of a "Reverse Sequential Plane Authorization with Timing" (referred to herein as "RSPAT") routine as an example of an "Analytical Logic Routine" as illustrated and described above with reference to FIGS. 2, 3, and 7. In one implementation, the RSPAT routine considers an order or sequence in which plane breaks occur in a direction that is the reverse of travel allowed by the SPA routine, and identifies or flags a pattern of timing that would be necessary in order to traverse the planes (in a reverse direction) in sync with travel through the planes which may be allowed by the SPA routine.

For example, as illustrated in FIGS. 36A and 36B, the RSPAT routine detects multi-party travel, including movement by an individual in a disallowed direction during simultaneous movement by a different individual in an allowed direction. For example, in one implementation, with the RSPAT routine, route V5 (wrong-way travel) with route V6 (correct way travel) will result in an alarm and/or other action. In addition, route V7 (wrong-way travel) with route V8 (correct way travel) will also result in an alarm and/or other action. (In one example, route V8 involves a "right way" individual evading collision with a wrong-way individual thereby resulting in different zones being activated.)

FIGS. 37A and 37B, FIGS. 38A and 38B, FIGS. 39A and 39B, and FIG. 40 provide example overhead illustrations of the laser planes of the laser sensors/scanners (e.g., P1, P2, P3, P4, P5), and the resulting ADAs (apparent detection areas) of the zones (three per plane), as they would appear at the floor level (e.g., 5 lasers, 15 degree angled mount, 10 foot mount height), for example events. For example, FIGS. 37A and 37B, FIGS. 38A and 38B, FIGS. 39A and 39B, and FIG. 40 include illustration of a "Delta Numerical Matrix" (referred to herein as "DNM") routine as an example of an "Analytical Logic Routine" as illustrated and described above with reference to FIGS. 2, 3, and 7. In one implementation, the DNM routine considers overall travel or movement within the system regardless of the number of entities (e.g., people, objects) or the direction of travel or movement. For example, in one implementation, with the DNM routine, the laser array zone output bits are assembled as elements in a matrix and weighted values that vary by position within the matrix are assigned to each of the output bits, such that a hash function yields information about changes in position by one or more entities (e.g., people, objects) within the detection area.

Figure 37B:
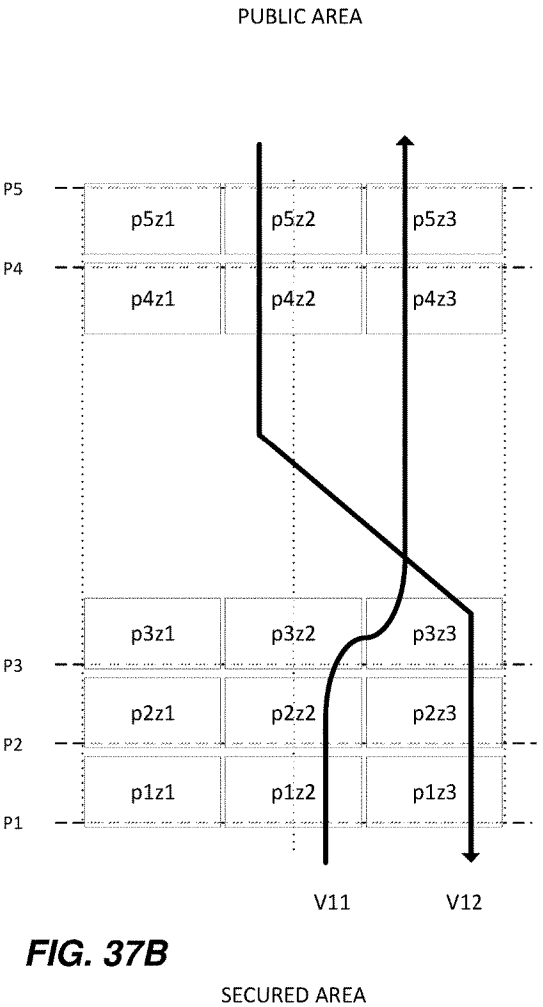
FIGS. 37A and 37B schematically illustrate one embodiment of a restricted area automated security system and method detecting example events.
Figure 37A:
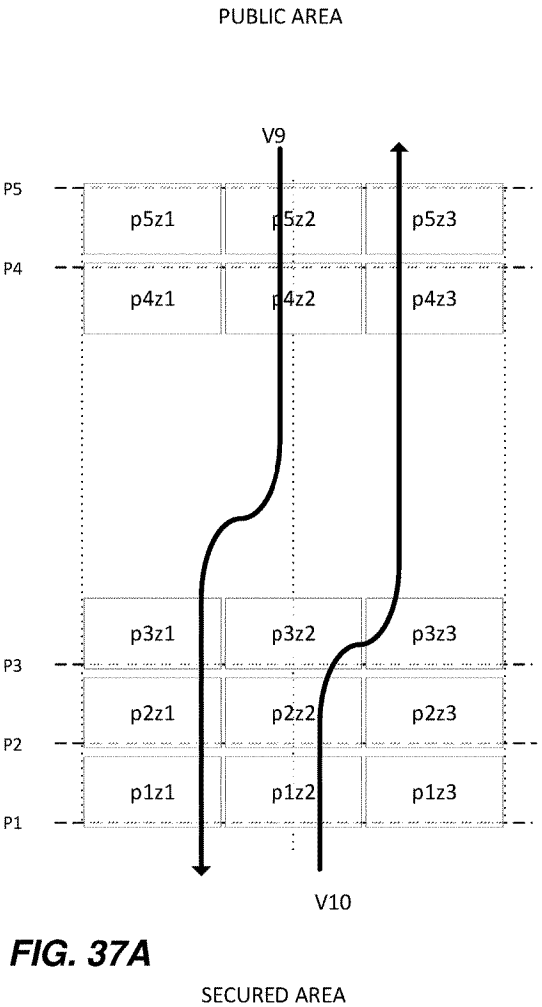

For example, as illustrated in FIGS. 37A and 37B, the DNM routine detects two individuals heading directly at each other but then swerving to avoid one another (including, for example, an individual who may be intentionally seeking cover by "trying to travel in the wake of a proper traveler") such that no final stage of travel or movement (in one direction) occurs within a "vertical column" in which it began. More specifically, no final stage of travel or movement (e.g., through zone 2 of planes 1-3) occurs within a common zone of laser planes (sequential laser planes) in which travel or movement began (e.g., through zone 2 of planes 4-5). For example, in one implementation, with the DNM routine, route V9 (wrong-way travel) during route V10 (correct way travel) will result in an alarm and/or other action. In addition, route V12 (wrong-way travel) during route V11 (correct way travel) will result in an alarm and/or other action.

Figure 38B:
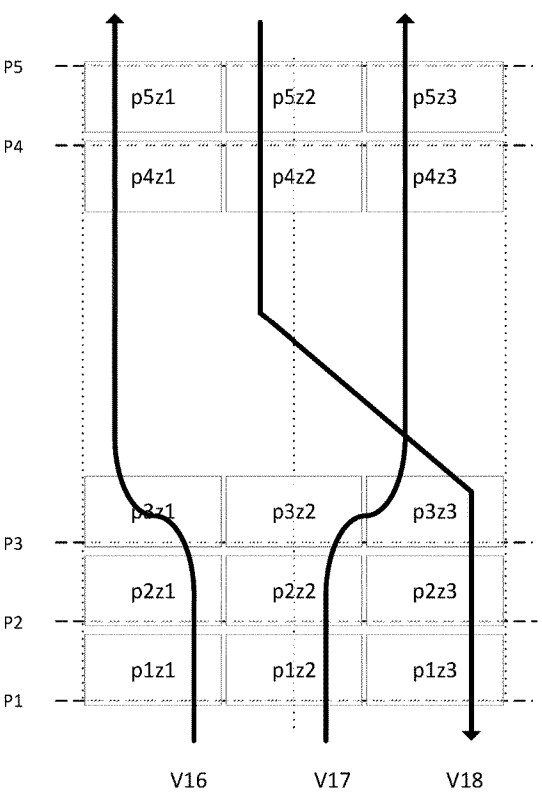
FIGS. 38A and 38B schematically illustrate one embodiment of a restricted area automated security system and method detecting example events.
Figure 38A:
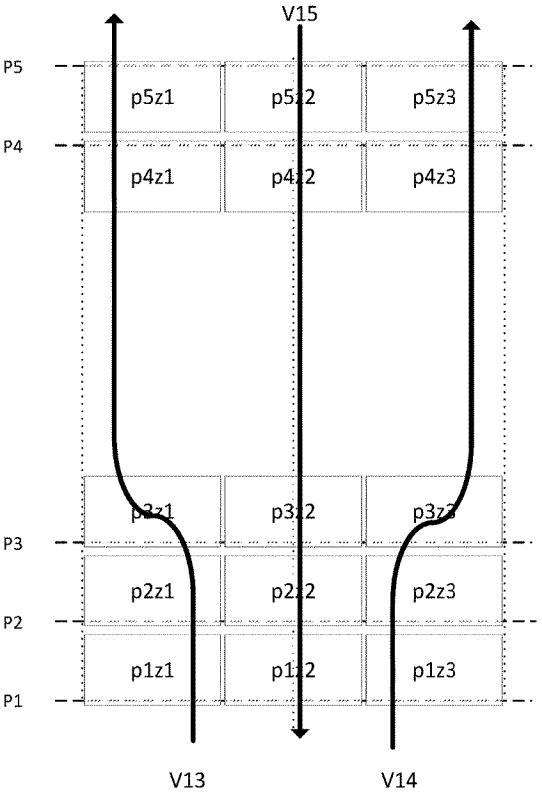

For example, as illustrated in FIGS. 38A and 38B, the DNM routine detects individuals traveling in one direction (allowed direction) and an individual traveling in an opposite direction (disallowed direction), where the individuals traveling in the one direction (allowed direction) move aside to make way for the individual traveling in the opposite direction (disallowed direction) such that the individual traveling in the opposite direction (disallowed direction) continues on. For example, in one implementation, with the DNM routine, route V15 (wrong-way travel) during routes V13 and V14 (correct way travel) will result in an alarm and/or other action. In addition, route V18 (wrong-way travel) during routes V16 and V17 (correct way travel) will result in an alarm and/or other action.

Figure 39A:
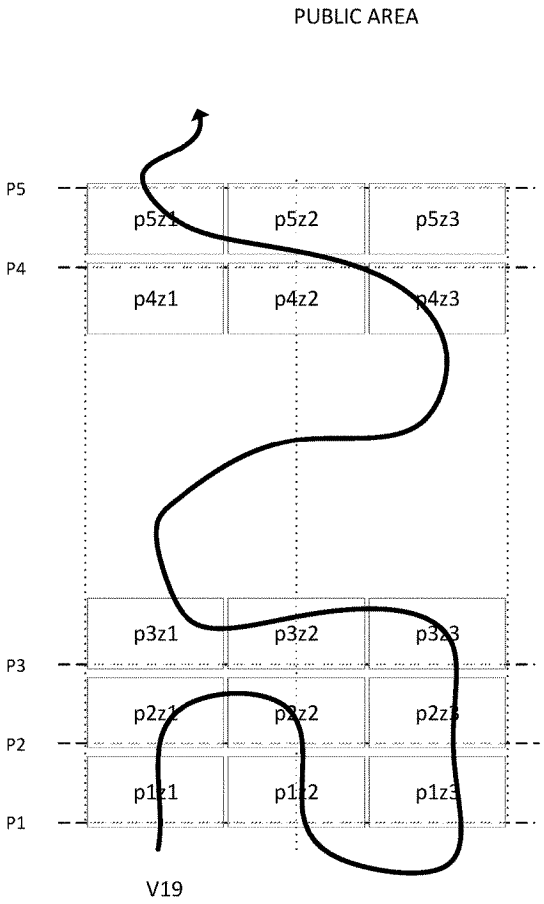
FIGS. 39A and 39B schematically illustrate one embodiment of a restricted area automated security system and method detecting example events.
Figure 39B:
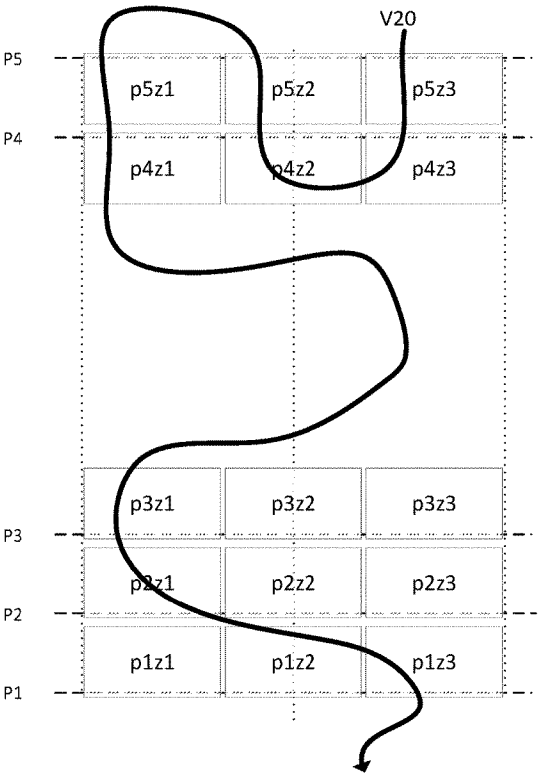
Figure 40:
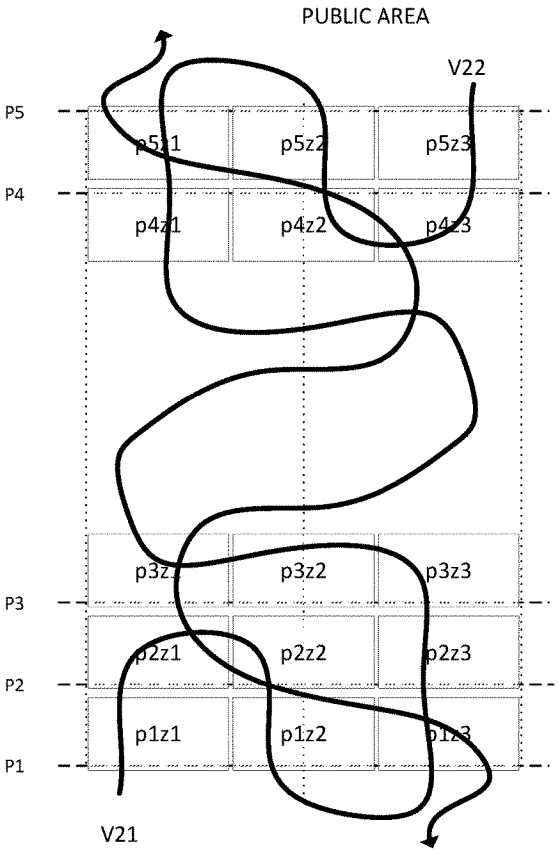
FIG. 40 schematically illustrates one embodiment of a restricted area automated security system and method detecting example events.

FIGS. 39A and 39B, and FIG. 40 illustrate examples of multi-party, dual-direction travel or movement with "unusual paths". In one implementation, with the DNM routine, route V19 (with U-turns) will not trigger an alarm and/or action, whereas route V20 (same route as V19, but opposite in direction) will trigger an alarm and/or action. In addition, route V20 during route V19 will trigger an alarm and/or action. In this situation, processing of one unusual path that is allowed (e.g., V19) does not prevent another unusual path that is disallowed (e.g., V20) from being detected.

One example environment for use of a restricted area automated security system and method as described and illustrated herein, is in an airport. An airport often includes unsecured and secured areas, whereby an individual is to be cleared via a screening process to gain access to a secured area. As such, egress from the secured area back to an unsecured or "public" area is typically monitored to prevent unauthorized entry to the secured area. Often, security personnel is present in these egress areas. When installed in an egress area, such as those at an airport, a restricted area automated security system and method as described and illustrated herein can be configured to accurately detect, without such security personnel, unauthorized intruders (attempting to cross from an unsecured area to a secured area), while allowing movement or transition from a secured area to an unsecured area.

Although the above examples describe and illustrate the detection people, the restricted area automated security system and method described herein may also detect objects, including movement of an object in the wrong direction between an unsecured (public) area and a secured area.

As described above, the restricted area automated security system and method collects data from an array of 2D laser sensors/scanners, and provides for continuously and automatically monitoring a region or zone between a secured (or restricted) area and an unsecured (or public) area. Thus, and as described above, the laser sensors/scanners provide a "triggering" device for initiating an alarm or other alert in response to a security violation of a monitored area. More specifically, the restricted area automated security system and method permits correct way travel (without triggering an alarm or other alert), and detects wrong way travel (which triggers an alarm or other alert). Furthermore, the restricted area automated security system and method detects wrong way travel or movement even during simultaneous correct way (allowed) travel or movement. Thus, the restricted area automated security system and method effectively monitors multi-party, dual-direction travel or movement. As such, with the restricted area automated security system and method disclosed herein, unauthorized entry or attempted entry to a restricted area (while allowing egress from such area) may be detected and alerted.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A security system, comprising:

a plurality of laser scanners to establish light shields in an area to be monitored, each of the light shields including at least one detection zone; and a controller to detect unauthorized entry to the area to be monitored based on a position and timing of breaks in the detection zones of the light shields, the controller to determine a direction of movement of an entity within the area to be monitored based on a sequence in which breaks in the detection zones of the light shields occur, the controller to trigger a security action if the direction of movement is disallowed, the controller not to trigger a security action if a direction of secondary movement of the entity is opposite a direction of primary movement of the entity that is allowed.

2. The security system of claim 1, the plurality of laser scanners to establish planar light shields each including at least one planar detection zone.

3. The security system of claim 1, the plurality of laser scanners to create a three dimensional matrix of two dimensional detection zones.

4. The security system of claim 1, the plurality of laser scanners to be mounted above the area to be monitored.

5. The security system of claim 1, the area to be monitored comprising an egress area from a secured area to an unsecured area.

6. The security system of claim 1, the light shield of at least one of the plurality of laser scanners to be oriented at a non-orthogonal angle to the area to be monitored.

7. The security system of claim 1, the light shields of a number of the plurality of laser sensors to be oriented substantially parallel with each other.

8. The security system of claim 1, the light shields of a first number of the plurality of laser scanners to be oriented substantially parallel with each other at a first non-orthogonal angle and the light shields of a second number of the plurality of laser scanners to be oriented substantially parallel with each other at a second non-orthogonal angle.

9. The security system of claim 1, the plurality of laser scanners to establish light shields each including a plurality of detection zones.

10. A security method, comprising:

establishing light shields with a plurality of laser scanners in an area to be monitored, each of the light shields including at least one detection zone; and detecting unauthorized entry to the area to be monitored based on a position and timing of breaks in the detection zones of the light shields determining a direction of movement of an entity within the area to be monitored based on a sequence in which breaks in the detection zones of the light shields occur, triggering a security action if the direction of movement is disallowed, not triggering a security action if a direction of secondary movement of the entity is opposite a direction of primary movement of the entity that is allowed.

11. The security method of claim 10, creating a three dimensional matrix of two dimensional detection zones with the plurality of laser scanners.

12. The security method of claim 10, orienting the light shields of a number of the plurality of laser sensors substantially parallel with each other.

13. The security method of claim 10, orienting the light shields of a first number of the plurality of laser scanners substantially parallel with each other at a first non-orthogonal angle and orienting the light shields of a second number of the plurality of laser scanners substantially parallel with each other at a second non-orthogonal angle.

* * * * *